US010054881B2

(12) United States Patent
Tsujibayashi et al.

(10) Patent No.: US 10,054,881 B2
(45) Date of Patent: Aug. 21, 2018

(54) IMAGE HEATING APPARATUS

(71) Applicant: CANON KABUSHIKI KAISHA, Tokyo (JP)

(72) Inventors: Masahiro Tsujibayashi, Nagareyama (JP); Nobuhiro Kikuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/476,407

(22) Filed: Mar. 31, 2017

(65) Prior Publication Data

US 2017/0242376 A1 Aug. 24, 2017

Related U.S. Application Data

(63) Continuation of application No. PCT/JP2015/078698, filed on Oct. 2, 2015.

(30) Foreign Application Priority Data

Oct. 3, 2014 (JP) ..... 2014-204433
Oct. 3, 2014 (JP) ..... 2014-204434

(51) Int. Cl.
*G03G 15/20* (2006.01)

(52) U.S. Cl.
CPC ..... *G03G 15/2039* (2013.01); *G03G 15/2032* (2013.01); *G03G 15/2078* (2013.01); *G03G 2215/2019* (2013.01)

(58) Field of Classification Search
CPC ..... G03G 15/2032; G03G 15/2078; G03G 2215/2019
See application file for complete search history.

(56) References Cited

U.S. PATENT DOCUMENTS 8,295,750 B2 * 10/2012 Yamana ..... G03G 15/2039 399/328
8,655,213 B2 2/2014 Tanaka et al.
(Continued)

FOREIGN PATENT DOCUMENTS

JP H10-232576 A 9/1998
JP 2006-195162 A 7/2006
(Continued)

OTHER PUBLICATIONS

PCT International Search Report and Written Opinion dated Dec. 28, 2015, in PCT/JP2015/078698, and partial translation.
(Continued)

*Primary Examiner* — Ryan Walsh
(74) *Attorney, Agent, or Firm* — Fitzpatrick, Cella, Harper & Scinto

(57) ABSTRACT

An image heating apparatus includes a first heater for heating a first roller, a second heater for heating a second roller, a first sensor for detecting a temperature of a region of an endless belt supported by the first roller, a second sensor for detecting a temperature of a region of the endless belt supported by the second roller, and a controller for controlling energization to the first heater and to the second heater. The controller executes a first mode in which the energization to the first heater is controlled using an output of the first sensor and the energization to the second heater is controlled using an output of the second sensor, and a second mode in which the energization to the first heater and the second heater is controlled using the output of the first sensor without using the output of the second sensor.

6 Claims, 29 Drawing Sheets

(56) References Cited

U.S. PATENT DOCUMENTS

| | | | | |
|---|---|---|---|---|
| 8,666,273 | B2 | 3/2014 | Tanaka | |
| 9,405,238 | B2 * | 8/2016 | Hatazaki | G03G 15/2025 |
| 2007/0122173 | A1 * | 5/2007 | Mitsuoka | G03G 15/2039 399/69 |
| 2007/0196120 | A1 * | 8/2007 | Maeda | G03G 15/2039 399/69 |
| 2007/0212094 | A1 * | 9/2007 | Asakura | G03G 15/2032 399/69 |
| 2007/0217837 | A1 * | 9/2007 | Yamana | G03G 15/2053 399/328 |
| 2007/0217838 | A1 * | 9/2007 | Yamana | G03G 15/2064 399/328 |
| 2007/0248389 | A1 * | 10/2007 | Asakura | G03G 15/2064 399/328 |
| 2008/0003009 | A1 * | 1/2008 | Minakuchi | G03G 15/2064 399/69 |
| 2009/0290888 | A1 * | 11/2009 | Mukai | G03G 15/2039 399/33 |
| 2010/0054788 | A1 * | 3/2010 | Mukai | G03G 15/5004 399/70 |
| 2010/0303496 | A1 * | 12/2010 | Mukai | G03G 15/2039 399/70 |
| 2011/0142496 | A1 * | 6/2011 | Kameda | G03G 15/2032 399/122 |
| 2011/0305474 | A1 * | 12/2011 | Tanaka | G03G 15/2053 399/69 |
| 2013/0051875 | A1 * | 2/2013 | Takahashi | G03G 15/2053 399/329 |
| 2013/0209145 | A1 * | 8/2013 | Hasegawa | G03G 15/2053 399/328 |
| 2014/0086647 | A1 * | 3/2014 | Hasegawa | G03G 15/2017 399/328 |
| 2014/0093287 | A1 * | 4/2014 | Hasegawa | G03G 15/2064 399/328 |
| 2014/0153947 | A1 * | 6/2014 | Hasegawa | G03G 15/2014 399/67 |
| 2014/0153981 | A1 * | 6/2014 | Hasegawa | G03G 15/2053 399/329 |
| 2014/0224623 | A1 * | 8/2014 | Hasegawa | G03G 15/2017 198/790 |
| 2014/0226998 | A1 * | 8/2014 | Hasegawa | G03G 15/2017 399/67 |
| 2014/0308050 | A1 * | 10/2014 | Fukamachi | G03G 15/2039 399/69 |
| 2015/0234342 | A1 * | 8/2015 | Hatazaki | G03G 15/2075 399/327 |
| 2015/0261150 | A1 * | 9/2015 | Hasegawa | G03G 15/2039 399/69 |

FOREIGN PATENT DOCUMENTS

| | | | |
|---|---|---|---|
| JP | 2012-002926 | A | 1/2012 |
| JP | 2012-093493 | A | 5/2012 |
| JP | 2012-189770 | A | 10/2012 |
| JP | 2014-085461 | A | 5/2014 |

OTHER PUBLICATIONS

Office Action dated Apr. 17, 2018, issued in Japanese Patent Application No. 2014-204433.

Office Action dated Apr. 17, 2018, issued in Japanese Patent Application No. 2014-204434.

* cited by examiner

Fig. 5A

Fig. 5B

Fig. 5

Fig. 12A

Fig. 12B

Fig. 12

Fig. 14A

Fig. 14B

Fig. 14

Fig. 16A

Fig. 16B

Fig. 16

Fig. 17A

Fig. 17B

Fig. 17

IMAGE HEATING APPARATUS

CLAIM OF PRIORITY

This application is a continuation of International Application No. PCT/JP2015/078698, filed on Oct. 2, 2015.

TECHNICAL FIELD

The present invention relates to an image heating apparatus, used in an electrophotographic (type) image forming apparatus such as a copying machine, a printer, a multifunction machine, or a facsimile machine, for heating a toner image on a recording material.

BACKGROUND ART

In the image forming apparatus of the electrophotographic type, or the like, the toner image is fixed on the recording material by heating and pressing the toner image formed on the recording material by a fixing device (image heating apparatus). In the fixing device, a pair of rotatable members is provided, and, at a nip therebetween, fixing of the toner image is carried out.

In a case when the toner image is fixed on the recording material, heat is transferred from the rotatable members to the recording material, so that a surface temperature of the rotatable members lowers.

Therefore, a type in which the rotatable member is externally heated in addition to interval heating of the rotatable members has been proposed (Japanese Laid-Open Patent Application 2012-2926). Specifically, the rotatable member is heated using an external heating belt (endless belt) stretched by two rollers. In the two rollers, heaters are incorporated, respectively, and two temperature sensors are provided opposed to the respective rollers via the external heating belt.

In such a fixing device, in a heating region where the external heating belt and the rotatable member contact each other, heat supply from the external heating belt to the rotatable member is carried out. For that reason, there is a tendency that, as compared with a temperature of the external heating belt in an upstream side of the heating region, the temperature of the external heating belt in a downstream side of the heating region lowers.

In a constitution exhibiting such a tendency, it is required that the external heating belt is controlled to a proper temperature.

SUMMARY OF THE INVENTION

According to one aspect, the present invention provides an image heating apparatus comprising a first rotatable member and a second rotatable member for forming a nip for heating a toner image on a recording material, an endless belt for heating the first rotatable member in contact with an outer surface of the first rotatable member, a first roller and a second roller, which are provided inside of the endless belt in the order named along a rotational direction of the first rotatable member, for supporting the endless belt, a first heater for heating the first roller, a second heater for heating the second roller, a first sensor for detecting a temperature of a region of the endless belt supported by the first roller, a second sensor for detecting a temperature of a region of the endless belt supported by the second roller, and a controller for controlling energization to the first heater and the second heater, wherein the controller is capable of executing a first mode in which the energization to the first heater is controlled using an output of the first sensor and the energization to the second heater is controlled using an output of the second sensor and a second mode in which the energization to the first heater and the second heater is controlled using the output of the first sensor without using the output of the second sensor.

BRIEF DESCRIPTION OF THE DRAWINGS

FIGS. 5, 5A, and 5B depict a flowchart showing control of the fixing device in the First Embodiment.

FIGS. 12, 12A, and 12B depict a flowchart showing control of a fixing device in a Third Embodiment.

FIGS. 14, 14A, and 14B depict a flowchart showing control of the fixing device in a Fourth Embodiment.

FIGS. 16, 16A, and 16B depict a flowchart showing control of a fixing device in a Fifth Embodiment.

FIGS. 17, 17A, and 17B depict a flowchart showing control of a fixing device in a Sixth Embodiment.

EMBODIMENTS FOR CARRYING OUT THE INVENTION

First Embodiment

[Image Forming Apparatus]

Figure 1:
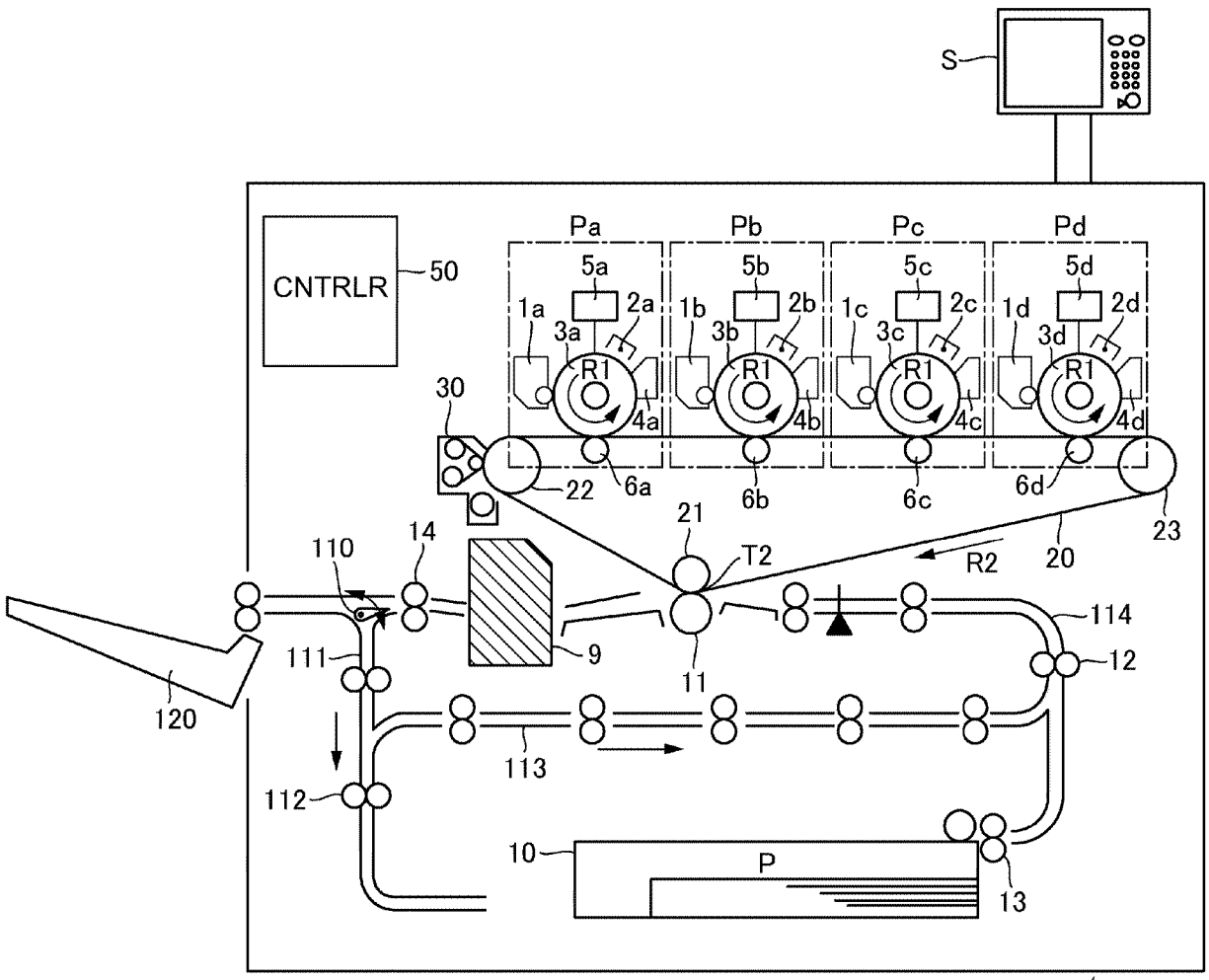
FIG. 1 is a schematic illustration of an image forming apparatus to which a fixing device according to a First Embodiment is applied.

A fixing device according to a First Embodiment of the present invention will be described using FIGS. 1 to 6. First, an image forming apparatus to which the fixing device according to this embodiment is applicable will be described using FIG. 1. An image forming apparatus 100 shown in FIG. 1 is an intermediary transfer type full-color printer of a tandem type in which image forming portions Pa, Pb, Pc, and Pd for yellow, magenta, cyan, and black are arranged along an intermediary transfer belt 20.

First, a feeding process of a recording material in this image forming apparatus 100 will be described. The recording material P is accommodated in the form of being stacked in a recording material accommodating container (sheet feeding cassette) 10, and is fed by a feeding roller 13 by being timed to image forming timing. In sheet feeding from the recording material accommodating container 10, for example, a friction separation type, or the like, is used. The recording material P fed by the feeding roller 13 is fed to registration rollers 12 provided at a halfway portion of a feeding path 114. Further, the recording material P is sent to a secondary transfer portion T2 after oblique movement correction and timing correction of the recording material P are carried out in the registration roller 12. The secondary transfer nip T2 is a transfer nip formed by opposing inner secondary transfer roller 21 and outer secondary transfer roller 11, and the toner image is attracted onto the recording material by applying a predetermined pressing force and a predetermined electrostatic load bias.

Relative to the above-described feeding process of the recording material P to the secondary transfer portion T2, a forming process of the image sent to the secondary transfer portion T2 at a similar timing will be described. First, the image forming portions are described, but the image forming portions Pa, Pb, Pc, and Pd for the respective colors are substantially similarly constituted, except that colors of the toners are yellow, magenta, cyan, and black, which are different from each other. Therefore, in the following, as a representative, the image forming portion Pb for black is described, and as regards other image forming portions Pa, Pb, and Pc, the suffix d of symbols in the description is to be described by being read as a, b, and c.

The image forming portion Pd is principally constituted by a developing device 1*d*, a charging device 2*d*, a photosensitive drum 3*d*, a photosensitive drum cleaner 4*d* and an exposure device 5*d*, and the like. In the figure, a surface of the photosensitive drum 3*d* rotationally driven in an R1 direction is electrically charged uniformly in advance by the charging device 2*d*, and, thereafter, an electrostatic latent image is formed by the exposure device 5*d* driven on the basis of a signal of image information. Then, the electrostatic latent image formed on the photosensitive drum 3*d* is subjected to toner development by the developing device 1*d* and is visualized. Thereafter, a predetermined pressing force and a predetermined electrostatic load bias are applied by a primary transfer roller 6*d* provided opposed to the image forming portion Pd by sandwiching the intermediary transfer belt 20 therebetween, so that the toner image formed on the photosensitive drum 3*d* is primary-transferred onto the intermediary transfer belt 20. Primary transfer residual toner remaining on the photosensitive drum 3*d* in a slight amount is collected by the photosensitive drum cleaner 4*d* and is prepares prepared for a subsequent image forming process. As regards the image forming portion Pd described above, in the case of a structure shown in FIG. 1, four sets for yellow, magenta, cyan, and black exist. However, the number of the colors is not limited to four (colors), and, also, an arrangement order of the colors is not limited thereto. The developing device 1*d* uses, as a developer, a two-component developer in which the toner and a magnetic carrier are mixed, for example.

The intermediary transfer belt 20 will be described. The intermediary transfer belt 20 is an endless belt, which is stretched by the inner secondary transfer roller 21, a tension roller 22 and a stretching roller 23, and which is fed and driven in an arrow R2 direction in the figure. Here, the inner secondary transfer roller 21 also functions as a driving roller for driving the intermediary transfer belt 20. Image forming processes for the respective colors to be processed in parallel by the image forming portions P are carried out at a timing when the toner images are successively superposed on the toner image(s) for the upstream(-side) color(s) primary-transferred on the intermediary transfer belt 20. As a result, finally, a full-color toner image is formed on the intermediary transfer belt 20 and is fed to the secondary transfer portion T2. Incidentally, secondary transfer residual toner after passed through the secondary transfer portion T2 is collected by a transfer cleaner device 30.

As described above, by the feeding process and the image forming process which are described, respectively, timing of the recording material P and timing of the full-color toner image coincide with each other, so that secondary transfer is carried out. Thereafter, the recording material P is fed to a fixing device 9 (image heating apparatus), and a predetermined pressure and predetermined heat quantity are applied to the recording material P, so that the toner image is melt-fixed on the recording material. Thus, the recording material P on which the image is fixed is subjected to selection by discharging rollers 14 such that the recording material P is discharged onto a sheet discharge tray 120 or subjected to double-side image formation.

In a case when the double-side image formation is required, by a switching member 110 (called a flapper, or the like), the feeding path is switched from a path leading to the sheet discharge tray 120 to a double-side feeding path 111, so that the recording material P fed by the sheet discharging rollers 14 is fed to the double-side feeding path 111. Thereafter, in synchronism with timing of a recording material P, in a subsequent job, fed from the feeding roller 13, leading and trailing ends of the recording material P (fed along the feeding path 112) are replaced with each other, and is sent again to the feeding path 114 via a double-side path 113. As regards a subsequent feeding and image forming process on the back surface, they are similar to those described above, and therefore, a description will be omitted.

Further, the image forming apparatus 100 includes an operating portion S and a controller 50. The operating portion S includes a display portion (not shown) of displaying various pieces of information, operating keys (not shown) through which user input is received, and the like. A user is capable of providing a start instruction of an image forming job by using the operation keys of the operating portion S or selectively inputting image quality setting of the image and the various species of information (for example, a type, a basis weight, and the like, of paper) of the recording material P set in the recording material accommodating container 10, from pieces of information displayed at the display portion. The controller 50 determines an image forming condition in accordance with inputted information, and controls respective portions of the image forming apparatus 100 in order to effect the image formation under the image forming condition. The controller 50 carries out control of the fixing device 9 during execution of the image forming job, so that the recording material P is heated at a predetermined temperature and the toner image is heat-fixed. As regards the control of such a fixing device 9, a description is made later, and, therefore, a detailed description will be omitted here.

[Fixing Device]

Figure 2:
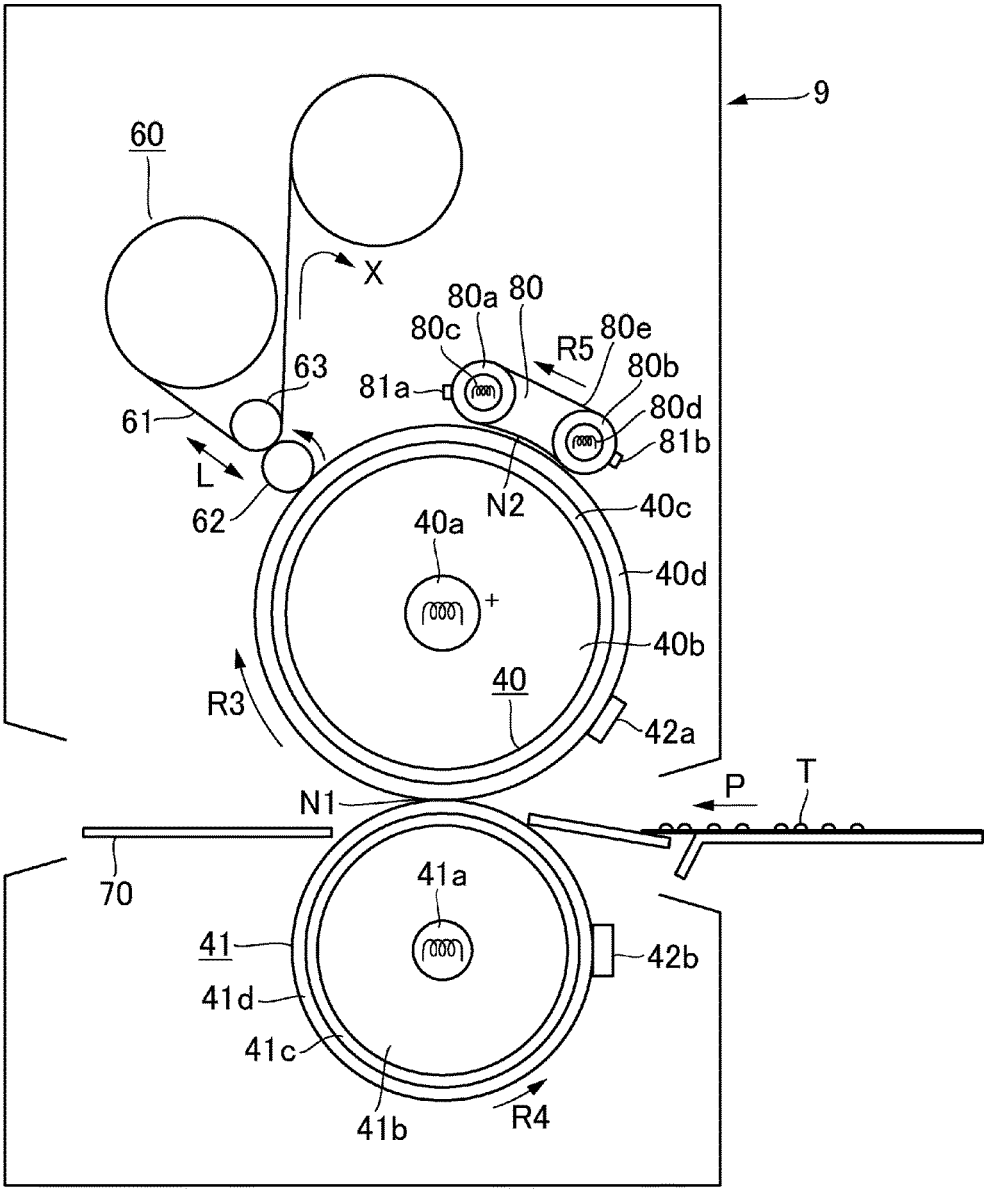
FIG. 2 is a schematic illustration of the fixing device in the First Embodiment.

Next, a structure of the fixing device 9 will be described using FIG. 2. The fixing device 9 includes a fixing roller 40 as a first rotatable member and a pressing roller 41 as a second rotatable member. The fixing roller 40 and the pressing roller 41 are rotatably shaft-supported by a housing (not shown) of the fixing device 9 via ball bearings (not shown), or the like. The fixing roller 40 and the pressing roller 41 are omitted from illustration in the figure, but gears fixed to one shaft ends thereof are connected with each other via a gear mechanism, and are integrally rotationally driven by a driving source (not shown) such as a motor via the gear mechanism.

The fixing roller 40 is formed by superposing a heat-resistant elastic layer 40*c* and a heat-resistant parting layer 40*d*, from an inner diameter side in the order named, on a metal-made core metal 40*b* formed in a cylindrical shape. For example, the core metal 40*b* of the fixing roller 40 is made of aluminum of 77 mm in outer diameter, 6 mm in thickness and 350 mm in length. The elastic layer 40*c* is formed with a 3 mm-thick HTV (high-temperature vulcanization type) silicone rubber, and coats an outer peripheral surface of the core metal 40*b*. The parting layer 40*d* is formed with a 50 μm-thick fluorine-containing resin material (for example, a PFA tube) in order to improve a parting property and coats a surface of the elastic layer 40*c*.

At an inner portion of the core metal 40*b* of the fixing roller 40, a halogen heater 40*a* of, e.g., 1200 W in normal rated power, which is subjected to output control by energization, and which thus generates heat, is provided non-rotatably almost over an entirety of the fixing roller 40 with respect to a widthwise direction (longitudinal direction, axial direction). The halogen heater 40*a* heats the fixing roller 40 from an inside of the fixing roller 40 so that a surface temperature of the fixing roller 40 is a predetermined target temperature. The surface temperature of the fixing roller 40 is detected by a thermistor 42*a*. Then, on the basis of this detection temperature, the halogen heater 40*a* is subjected to ON (energization) or OFF (non-energization) control by the controller 50 (see FIG. 1), so that the surface temperature of the fixing roller 40 is adjusted to the predetermined target temperature.

The pressing roller 41 is formed by superposing a heat-resistant elastic layer 41*c* and a heat-resistant parting layer 41*d*, from an inner diameter side in the order named, on a metal-made core metal 41*b* formed in a cylindrical shape. For example, the core metal 41*b* of the pressing roller 41 is made of aluminum of 59 mm in outer diameter, 5 mm in thickness and 350 mm in length. The elastic layer 41*c* is formed with a 1 mm-thick HTV silicone rubber, and coats an outer peripheral surface of the core metal 41*b*. The parting layer 41*d* is formed with a 50 μm-thick fluorine-containing resin material (for example, a PFA tube) and coats a surface of the elastic layer 41*c*.

At an inner portion of the core metal 41*b* of the pressing roller 41, a halogen heater 41*a* of, e.g., 400 W in normal rated power, which generates heat by energization is provided non-rotatably almost over an entirety of the pressing roller 41 with respect to a widthwise direction (longitudinal direction, axial direction). The halogen heater 41*a* heats the pressing roller 41 from an inside of the pressing roller 41 so that a surface temperature of the pressing roller 41 is a predetermined target temperature. The surface temperature of the pressing roller 41 is detected by a thermistor 42*b*. Then, on the basis of this detection temperature, the halogen heater 41*a* is subjected to the ON-OFF control by the controller 50 (see FIG. 1), so that the surface temperature of the pressing roller 41 is adjusted to a certain temperature of 100° C., for example.

The above-described pressing roller 41 is press-contacted to the fixing roller 40 with a predetermined pressure, such as pressure of 784 N (about 80 kgf), and forms a fixing nip N1 in cooperation with the fixing roller 40. The recording material P is heated and pressed by being nipped and fed at the fixing nip N1. For that reason, the fixing roller 40 is rotated in an arrow R3 direction in the figure and the pressing roller 41 is rotated in an arrow R4 direction in the figure so that the fixing roller 40 and the pressing roller 41 are rotated in the same direction at the fixing nip N2. Further, the pressing roller 41 is movable between a contact (mounted) state in which the pressing roller 41 is press-contacted to the fixing roller 40 and a spaced (demounted) state in which the predetermined roller 41 is spaced from the fixing roller 40, by an unshown pressing mounting and demounting (contacting and spacing) mechanism. The (contact)/(spaced) state of the pressing roller 41 is discriminated by the controller 50.

[Cleaning Unit]

Further, the fixing device 9 includes a cleaning unit 60 as a cleaning member for the fixing roller 40. The cleaning unit 60 includes a cleaning web 61, which is a nonwoven fabric, a collecting roller 62, and a web roller 63. The collecting roller 62 is a stainless steel-made cylindrical member formed of 20 mm in diameter, for example. The collecting roller 62 is provided rotatably in a state in which the collecting roller 62 is contacted to the fixing roller 40 over almost an entirety of the fixing roller 40 with respect to the widthwise direction (longitudinal direction, the axial direction), and collects the toner deposited on the fixing roller 40 without being fixed on the recording material P. The collecting roller 62 is always contacted to the fixing roller 40 and is rotated by the fixing roller 40.

The web roller 63 supports the cleaning web 61 and presses (urges) the supported cleaning web 61 against the collecting roller 62 with a force of, e.g., about 40 N. The cleaning web 61 is pressed against the collecting roller 62, and thus wipes off the toner, on the cleaning roller 62, collected from the fixing roller 40. The cleaning web 61 is wound up in one direction (arrow X direction in the figure), and, therefore, a fresh surface, of the cleaning web 61, where the toner is not wiped off is always supplied to a contact surface with the collecting roller 62. The web roller 63 is movable between a contact state in which the web roller 63 is press-contacted to the collecting roller 62 and a spaced state in which the web roller 63 is spaced from the collecting roller 62, by an unshown web mounting and demounting (contacting and spacing) mechanism. Incidentally, the collecting roller 62 is press-contacted to the fixing roller 40 with a force (urging) of about 10 N in the spaced state of the web roller 63 and with a force of about 50 N, obtained by adding about 40 N of the web mounting and demounting mechanism to the force of about 10 N, in the contact state of the web roller 63. The mounting/demounting state of the web roller 63 is discriminated by the controller 50.

[Externally Heating Unit]

In the image forming apparatus, even the recording material, such as a temperature difference, having a large basis weight (weight per unit area) is required to provide high productivity (the number of printed sheets per unit time). In order to enhance the productivity for the recording material having the large basis weight, it is desirable that a speed of a heating process in the fixing device 9 is increased. However, the recording material having the large basis weight takes heat in a large amount, and, therefore, a heat quantity required for fixing becomes large compared with a recording material having a small basis weight. Therefore, as shown in FIG. 2, the fixing device 9 includes an external heating unit 80 as an external heating device, and heats the fixing roller 40 from an outside of the fixing roller 40 by the external heating unit 80 as desired. More specifically, in a case when much heat is transferred from the fixing roller 40 to the recording material P, the external heating unit 80 is provided for quickly replenishing the heat quantity corresponding to an amount of heat delayed in supply by the halogen heater 41*a* in the pressing roller 41. The external heating unit 80 (specifically, an external heating belt 80*e* heats the fixing roller 40 by contacting the fixing roller 40).

The external heating unit 80 includes the external heating belt 80*e*, an external heating roller 80*a* as a first roller for stretching the external heating belt 80*e*, an external heating roller 80*b* as a second roller, and halogen heaters 80*c* and 80*d* as an external heating means. The external heating belt 80*e* as a belt member is a belt formed by coating a heat-resistant sliding layer formed of a fluorine-containing resin material (e.g., a PFA tube) on a metal-made base material of stainless steel, or the like, formed in an endless belt shape, for example. The external heating belts 80*a* and 80*b* are formed, similarly as the fixing roller 40 and the pressing roller 41, by coating a heat-resistant sliding layer formed of a fluorine-containing resin material (e.g., a PFA tube) on a metal-made core metal of aluminum or the like formed in a cylindrical shape, for example.

The external heating unit 80 is movable between a contact state in which the external heating unit 80 is press-contacted to the fixing roller 40 by the external heating belt 80*e* and a spaced state in which the external heating belt 80*e* is spaced from the fixing roller 40, by a belt mounting and demounting (contacting and spacing) mechanism 57 (see FIG. 4 described later). The contact/spaced state of the external heating unit 80 is discriminated by the controller 50.

In a case when the external heating unit 80 is in the mounted state, the external heating rollers 80*a* and 80*b* are press-contacted to the external heating belt 80*e* toward the fixing roller 40 with predetermined pressure. Then, the external heating belt 80*e* contacts the surface of the fixing roller 40, and forms an external heating contact portion N2. That is, the external heating belt 80*e* forms a broad external heating contact portion N2 in cooperation with the fixing roller 40 and is provided for increasing the heat quantity supplied to the fixing roller 40.

The external heating belt 80*e* and the external heating rollers 80*a* and 80*b* are rotated by the fixing roller 40 (arrow R5 direction in the figure). These external heating rollers 80*a* and 80*b* are disposed so as to sandwich the external heating contact portion N2 therebetween with respect to a rotational direction of the external heating belt 80*e*. Further, the external heating rollers 80*a* and 80*b* are disposed so that the external heating roller 80*a* of these rollers is adjacent to an upstream portion of the external heating contact portion N2 and so that the external heating roller 80*b* of these rollers is adjacent to a downstream portion of the external heating contact portion N2, respectively. That is, the external heating belt 80*a* is disposed, with respect to the rotational direction (arrow R3 direction in the figure) of the fixing roller 40, in a side upstream of the external heating roller 80*b* and upstream of the external heating contact portion N2.

Inside the external heating roller 80*a*, a halogen heater 80*c*, of, e.g., 1500 W in normal rated power, generating heat by energization is fixedly provided as a first heating means over almost an entirety of the external heating roller 80*a*. Inside the external heating roller 80*b*, a halogen heater 80*d*, of, e.g., 1500 W in normal rated power, generating heat by energization is fixedly provided as a second heating means over almost an entirety of the external heating roller 80*b*. In this embodiment, to the respective halogen heaters 80*c* and 80*d*, electrical power, which is the same as the normal rated power, is supplied. Incidentally, the above-described widthwise direction is also longitudinal directions and rotational axis directions of the external heating rollers 80*a* and 80*b*.

Further, the external heating unit 80 includes a thermistor 81*a* as a first temperature detecting means and a thermistor 81*b* as a second temperature detecting means. The thermistor 81*a* is provided at a position where the thermistor 81*a* contacts the external heating roller 80*a* at a portion, of an outer peripheral surface of the external heating belt 80*e* in an upstream side with respect to the rotational direction of the fixing roller 40, and detects a temperature of the external heating belt 80*e* in a region in which the external heating roller 80*a* contacts the external heating belt 80*e*. The thermistor 81*b* is provided at a position where the thermistor 81*b* contacts the external heating roller 80*b* at a portion, of an outer peripheral surface of the external heating belt 80*e* in an downstream side with respect to the rotational direction of the fixing roller 40, and detects a temperature of the external heating belt 80*e* in a region in which the external heating roller 80*b* contacts the external heating belt 80*e*.

[Controller]

The controller 50 (see FIG. 1) subjects the halogen heaters 80*a* and 80*b* to ON-OFF control on the basis of temperatures detected by the thermistors 81*a* and 81*b* in order to adjust a surface temperature of the external heating belt 80*e*, and by extension to a surface temperature of the fixing roller 40. However, the controller 50 subjects, during preparation of the image formation, the halogen heater 80*c* to the ON-OFF control on the basis of the temperature detected by the thermistor 81*a* and the halogen heater 80*d* to the ON-OFF control on the basis of the temperature detected by the thermistor 81*b*, respectively. Further, the controller 50 subjects, during image formation, both of the halogen heaters 80*c* and 80*d* to the ON-OFF control on the basis of the temperature detected by the thermistor 81*a*.

Here, during image formation is a period from a start of image formation based on a print signal for forming the image on the recording material P to completion of an image forming operation. Specifically, during image formation refers to a period from during pre-rotation after receipt of the print signal (input of an image forming job) to post-rotation (operation after the image formation), and is a period including an image forming period and a sheet interval (during non-image formation). During preparation of the image formation is a state in which a power source of the image forming apparatus 100 is turned on, but the image forming job is not executed. As described above, during image formation is a series of operations including from a pre-rotation operation, the image forming period, the sheet interval and the post-rotation, and, therefore, during preparation of the image formation refers to a period in which this services of operations is not executed in a state in which the electrical power of the image forming apparatus 100 is turned on. Further, during preparation of the image formation includes during stand-by (stand-by state), and during stand-by (stand-by state) is a state in which after the power source of the image forming apparatus 100 is turned on or after the image formation, the image forming apparatus 100 waits for receipt of the print signal in a state in which the series of operations during image formation described above is capable of being performed.

The controller 50 subjects the halogen heaters 80*c* and 80*d* to the ON-OFF control, and adjusts the surface temperature of the external heating belt 80*e*, and, by extension, to the surface temperature of the fixing roller 40, to a predetermined target temperature. In Table 1, target temperatures (represented as setting temperatures in the table) of the fixing roller 40 and the external heating belt 80*e*, which are used during stand-by and during image formation, are shown, respectively. The controller 50 subjects, as described above, the halogen heaters 40*a* and 41*a* and the halogen heaters 80*c* and 80*d* to the ON-OFF control, and adjusts the surface temperature of the external heating belt 80*e*, and, by extension, to the surface temperature of the fixing roller 40, to the target temperatures shown in Table 1. As shown in Table 1, the target temperatures of the fixing roller 40 and the external heating belt 80*e* are determined depending on the basis weight of the recording material P.

TABLE 1

| | Recording material basis weight (g/m$^2$) | | | | | |
|---|---|---|---|---|---|---|
| | 60-79 | 80-99 | 100-149 | 150-199 | 200-249 | 250-350 |
| FRST*1<br>TDSB*2 | | | 165 (° C.) | | | |
| FRST*1<br>TDIF*3 | | | 170 (° C.) | | | |
| EHBST*4<br>TDSB+2 | | | 190 (° C.) | | | |
| EHBST*4<br>TDIF*3 | | 210 (° C.) | | | | 215 |

*1"FRST" is the fixing roller setting temperature.
*2"TDSB" is the temperature during stand-by.
*3"TDIF" is the temperature during image formation.
*4"EHBST" is the external heating belt setting temperature.

Figure 3:
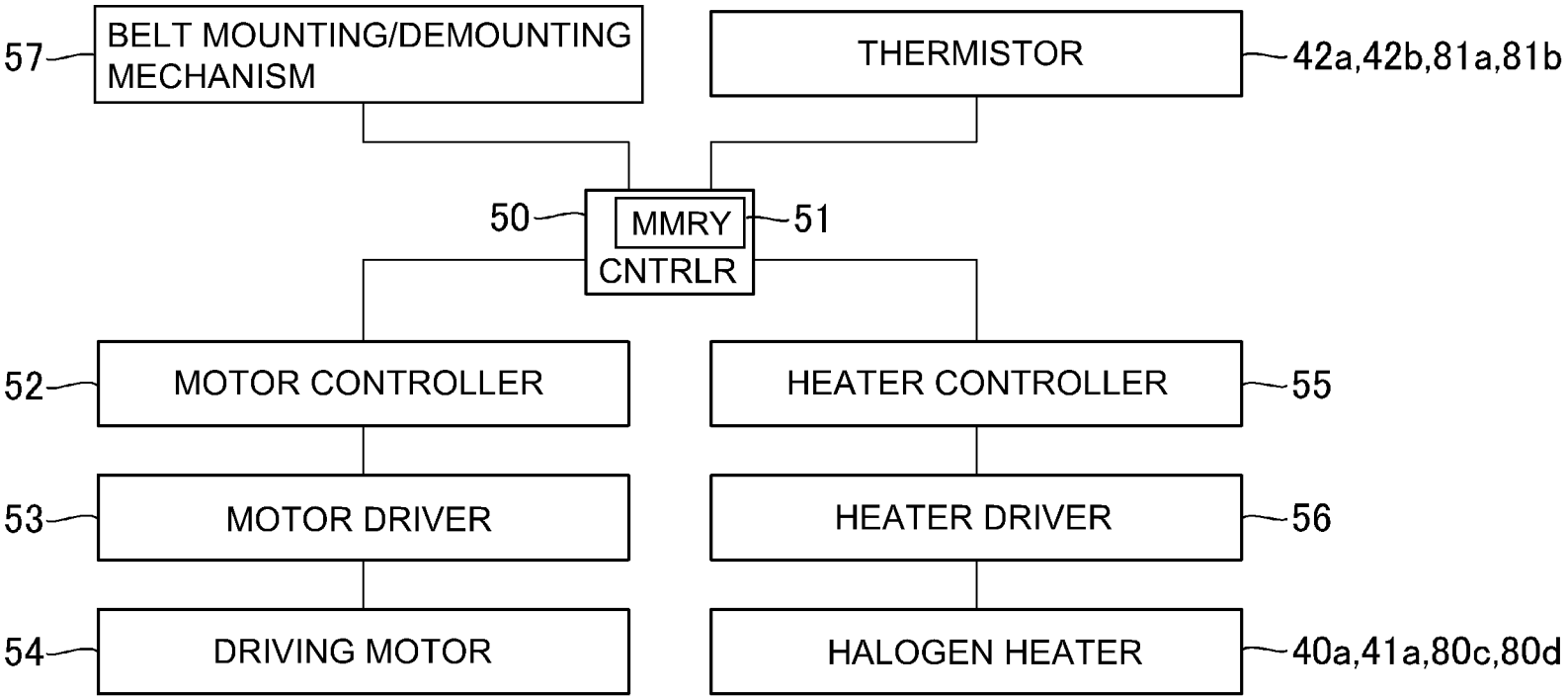
FIG. 3 is a block diagram of a control system of the fixing device in the First Embodiment.

Next, the control of the fixing device 9 will be described using FIGS. 3 to 6. First, FIG. 3 shows a block diagram of a control system of the fixing device 9. The controller 50 is a computer such as a CPU for controlling respective portions of the fixing device 9, and includes a memory 51, as shown in FIG. 3. The memory 51 is ROM, RAM, or the like, and stores various programs, data, and the like, for controlling the image forming apparatus 100. Further, the memory 51 can also temporarily store a calculation process (computation) result with execution of the program. The controller 50 is connected with the operating portion S (see FIG. 1) via an unshown interface, and receives execution start operations of the various programs such as the image forming job by a user or various data inputs by the user, or the like. The controller 50 controls, depending on the execution of the image forming job, the respective portions connected thereto via unshown interfaces and described later, and thus, operates the fixing device 9.

To the controller 50, the belt mounting and demounting mechanism 57 is connected. The belt mounting and demounting mechanism 57 moves the external heating unit 80 so as to be movable toward and away from the fixing roller 40. By this, the fixing device 9 is in a state that is either of a contact state in which the fixing roller 40 and the external heating belt 80*e* are press-contacted to each other, or a spaced state in which the fixing roller 40 and the external heating belt 80*e* are spaced from each other.

The controller 50 individually controls a plurality of driving motors 54 via a motor controller 52 and a motor driver 53. The respective driving motors 54 rotationally drive the fixing roller 40 and the pressing roller 41 in predetermined directions at predetermined speeds, respectively, depending on control by the controller 50. Further, the controller 50 individually subjects the halogen heaters 40*a*, 41*a*, 80*c*, and 80*d* to the ON/OFF control via a heater controller 55 and a heater driver 56. As already described above, depending on control of the halogen heater 40*a*, the surface temperature of the fixing roller 4 is adjusted, and depending on control of the halogen heater 41*a*, the surface temperature of the pressing roller 41 is adjusted. Further, depending on the halogen heaters 80*c* and 80*d*, the surface temperature of the external heating belt 80*e* is adjusted.

To the controller 50, the thermistors 42*a*, 42*b*, 81*a*, and 81*b* are connected via unshown interfaces. The controller 50 acquires the surface temperature of the fixing roller 40 (hereafter, referred to as a fixing roller temperature, for convenience) from the thermistor 42*a* and acquires the surface temperature of the pressing roller 41 from the thermistor 42*b*. Further, the controller 50 acquires the surface temperature of the external heating belt 80*e* in an upstream side with respect to a fixing roller rotational direction (hereafter, referred to as an external heating upstream temperature, for convenience) from the thermistor 81*a*. Further, the controller 50 acquires the surface temperature of the external heating belt 80*e* in a downstream side with respect to the fixing roller rotational direction (hereafter, referred to as an external heating downstream temperature, for convenience) from the thermistor 81*b*. The controller 50 subjects the halogen heaters 40*a*, 41*a*, 80*c*, and 80*d* to the ON-OFF control on the basis of temperatures detected by the thermistors 42*a*, 42*b*, 81*a*, and 81*b*, and thus, carries out control of adjusting the surface temperature of the fixing roller 40 to a predetermined target temperature.

Figure 4:
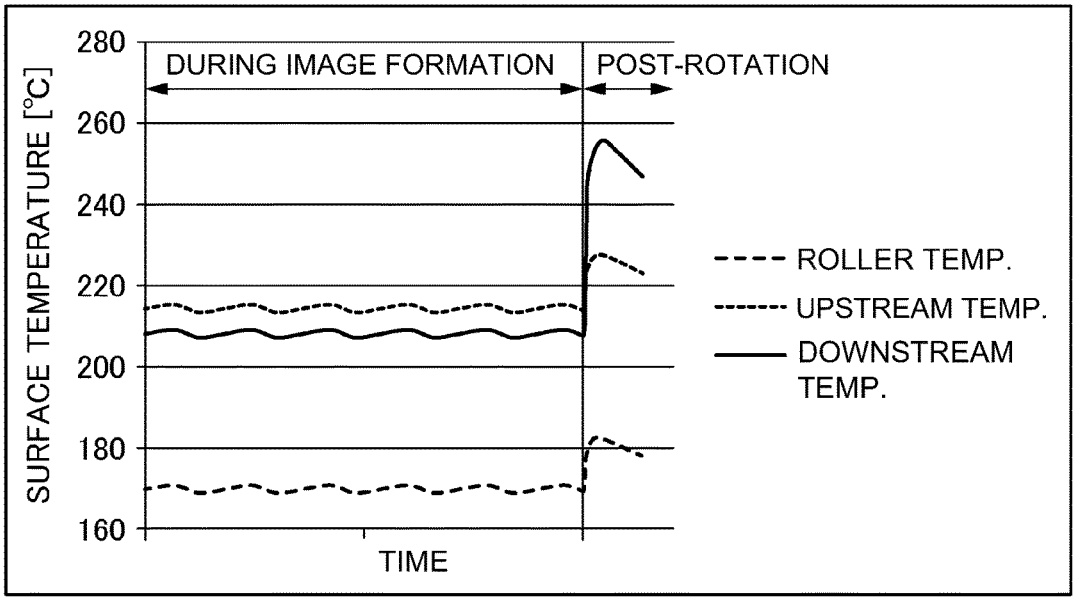
FIG. 4 is a graph showing time progressions of a fixing roller temperature, an external heating upstream temperature, and an external heating downstream temperature in a comparison example.

Here, in FIG. 4, in a case when image formation is carried out on a large number of sheets of thick paper (basis weight: 250 g/m$^2$ as an example) by using a fixing device in a comparison example, time progressions of the fixing roller temperatures, the external heating upstream temperatures and the external heating downstream temperatures detected by the thermistors 42*a*, 81*a*, and 81*b* are shown. In the fixing device in the comparison example, with regard to the external heating unit 80, the control of the halogen heater 80*c* is carried out on the basis of the temperature detected by the thermistor 81*a*, and the control of the halogen heater 80*d* is carried out on the basis of the temperature detected by the thermistor 81*b*. In FIG. 4, the ordinate represents the surface temperature, and the abscissa represents the time. In this case, a target temperature Trp of the fixing roller temperature used during image formation is 170° C., and a target temperature Tex1*p* (first target temperature) of the external heating upstream temperature and a target temperature Tex2*p* (second target temperature) of the external heating downstream temperature that are used during image formation are 215° C. (see Table 1). Incidentally, a target temperature of the surface temperature of the pressing roller 41 is always 100° C.

As shown in FIG. 4, during image formation, the fixing roller temperature and the external heating upstream temperature reach 170° C. and 215° C., respectively, which are the target temperatures thereof. The fixing roller temperature and the external heating upstream temperature during image formation change while somewhat fluctuating, but this shows that the respective surface temperatures can fluctuate with predetermined temperature ripples depending on the ON/OFF control of the halogen heaters 40*a* and 80*c*.

On the other hand, during image formation, the external heating downstream temperature changes at the target temperature or less without reaching 215° C., which is the target temperature. This is because heat supply is carried out at the external heating contact portion N2, and, thus, the surface temperature in the downstream side, with respect to the fixing roller rotational direction, immediately after passing through the external heating contact portion N2 is lower than the surface temperature in the upstream side, with respect to the fixing roller rotational direction, in front of the external heating contact portion N2. That is, when the external heating upstream temperature reaches the target temperature of 215° C., the halogen heater 80*c* is turned off, and therefore, a heat quantity supplied from the external heating belt 80*e* to the fixing roller 40 decreases. As a result, the heat quantity supplied from the external heating belt 80*e* to the fixing roller 40 becomes larger than a total heat quantity received by the external heating belt 80*e* from the external heating rollers 80*a* and 80*b*, and, therefore, the external heating downstream temperature does not reach 215° C. The external heating downstream temperature does not reach 215° C., and, therefore, the halogen heater 80*d* is not turned off and continues a turned-on state. Incidentally, also the external heating downstream temperature changes while somewhat fluctuating, but this shows a thermal fluctuation depending on heat transfer from the fixing roller 40 to the recording material P.

When the turned-on state of the halogen heater 80*d* is continued, after image formation, particularly, the temperature of the external heating roller 80*b* abruptly increases, so that the external heating downstream temperature can overshoot largely toward a high-temperature side. Every execution of the image forming job, when a state in which the external heating downstream temperature overshoots and becomes a high temperature is repeated, there is a large liability that due to thermal deterioration, not only the fixing roller 40 and the external heating roller 80*b*, but also the external heating belt 80*e* are broken.

As one of methods for solving this problem, it would be considered that during image formation, the external heating upstream temperature and the external heating downstream temperature are set at different temperatures, specifically, the external heating downstream temperature is set at a lower temperature than the external heating upstream temperature. However, a temperature difference between the external heating upstream temperature and the external heating downstream temperature varies depending on the type of paper (sheet) and the paper (sheet) interval, so that the above-described method cannot meet various sheet types and sheet intervals, and, therefore, it is difficult to employ the method.

Figure 5A:
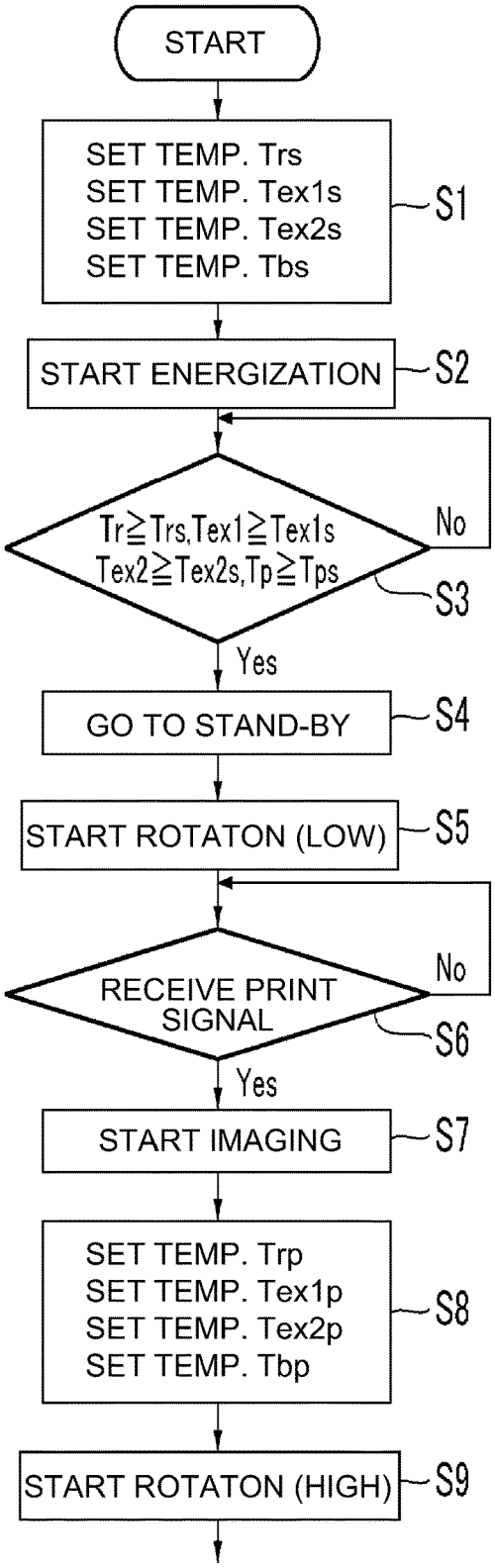
Figure 5B:
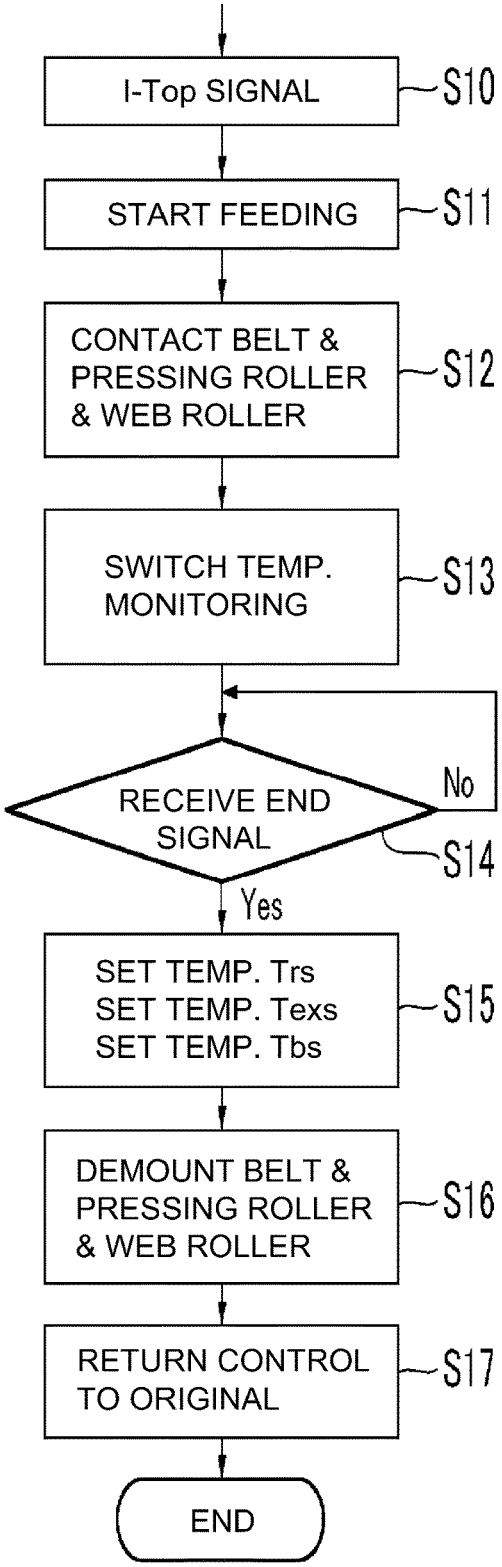

Therefore, in the image forming apparatus 100, during image formation, both of the halogen heaters 80*c* and 80*d* were simultaneously subjected to the ON/OFF control on the basis of only the temperature detected by the thermistor 81*a*. In the following, a description will be made using FIGS. 5 and 6 while appropriately making reference to FIGS. 2 and 3. FIG. 5 (5A, 5B) is a flowchart showing a control (mode) of the fixing device. This control of the fixing device is started in synchronism with the tuning-on of the power source of the apparatus main assembly by the controller 50, and is ended in synchronism with an end of the image forming job. Incidentally, here, the case when the user sets the thick paper of 250 g/m$^2$ in basis weight as the sheet type and an image forming job for carrying out continuous image formation on a large number of sheets of the thick paper is taken as an example and will be described.

As shown in FIG. 5, the controller 50 sets a target temperature Trs of the fixing roller temperature, a target temperature Tex1*s* of the external heating upstream temperature, a target temperature Tex2*s* of the external heating downstream temperature, and a target temperature Tbs, of the surface temperature of the pressing roller 41, which are to be used during stand-by (S1). From the above-described Table 1, the target temperature Trs of the fixing roller temperature used during stand-by is set at 165° C., and the target temperature Tex1*s* of the external heating upstream temperature and the target temperature Tex2*s* of the external heating downstream temperature, which are used during stand-by, are set at 190° C. Further, the target temperature Tbs of the surface temperature of the pressing roller 41 is set at 100° C.

The controller 50 starts energization to the respective halogen heaters 40*a*, 41*a*, 80*c*, and 80*d* of the fixing device 9 (S2). That is, the controller 50 carries out control for energizing (turning on) the halogen heaters 40*a*, 41*a*, 80*c* and 80*d* via the heater controller 55 and the heater driver 56. The controller 50 discriminates, after the above-described energization, whether or not the surface temperature of the fixing roller 40, the external heating upstream temperature and the external heating downstream temperature of the external heating belt 80*e*, and the surface temperature of the pressing roller 41 reach the target temperatures Trs, Tex1*s*, Tex2*s* and Tbs, respectively (S3). This discrimination is carried out on the basis of a comparison with temperatures detected by the respective thermistors 42*a*, 81*a*, 81*b*, and 42. The controller 50 repeats the process of S3 until the above-described respective surface temperatures reach the target temperatures Trs, Tex1*s*, Tex2*s*, and Tbs, and stand by (NO of S3). That is, the controller 50 controls the energization to the halogen heater 80*c* so that the detection temperature by the thermistor 81*a* is the target temperature Tex1*s* (first target temperature). Further, the controller 50 controls the energization to the halogen heater 80*d* so that the detection temperature by the thermistor 81*b* is the target temperature Tex2*s* (second target temperature). Thus, during preparation of the image formation, pre-heating of the fixing roller 40 is carried out.

In the case when the above-described respective temperatures reach the target temperatures Trs, Tex1*s*, Tex2*s*, and Tbs, respectively (YES of S3), the controller 50 causes the fixing device 9 to go to the stand-by state (S4), and causes the fixing roller 40 to start rotation at a speed lower than a speed during image formation (S5). The controller 50 controls the driving motor 54 via the motor controller 52 and the motor driver 53 and causes the fixing roller 40 to rotate at a speed that is half of a predetermined speed (e.g., 500 mm/sec) during image formation, for example. Further, in the case when the fixing device 9 is in during stand-by (stand-by state), the controller 50 subjects the respective halogen heaters to the ON/OFF control so as to maintain the target temperatures Trs, Tex1*s*, Tex2*s*, and Tbs, and thus, effect temperature adjustment.

The controller 50 discriminates whether or not the print signal is received (S6). The controller 50 repeats the process of S6 until the print signal is received and stands by (NO of S6). In the case when the print signal is received (YES of S6), the controller 50 starts image formation (S7). Then, the controller 50 changes the respective target temperatures to a target temperature Trp of the fixing roller temperature, a target temperature Tex1*p* of the external heating upstream temperature, a target temperature Tex2*p* of the external heating downstream temperature and a target temperature Tbp of the surface temperature of the pressing roller 41, which are to be used during image formation (S8). From the above-described Table 1, the target temperature Trp of the fixing roller temperature used during image formation is changed to 170° C., and the target temperature Tex1*p* of the external heating upstream temperature and the target temperature Tex2*p* of the external heating downstream temperature, which are used during image formation, are changed to 215° C. Incidentally, the target temperature Tbp of the surface temperature of the pressing roller 41 is 100° C. as it is.

The controller 50 causes the fixing roller 40 to be rotationally driven so that the speed increases up to the predetermined speed (e.g., 500 mm/sec) during image formation (S9). Further, the controller 50 starts feeding of the recording material P, depending on receipt of an image writing signal (hereafter, referred to as an I-Top signal (S10), by using a receiving time of an I-Top signal as a reference time (S11). At this time, the feeding of the recording material P may be started irrespective of whether or not the fixing roller temperature, the external heating upstream temperature, the external heating downstream temperature, and the surface temperature of the pressing roller 41 reach the target temperatures changed in the above-described S8. This is for the following reason. That is, when the surface temperatures reach the target temperatures, the halogen heaters are turned off, and, thereafter, the recording material P reaches the fixing nip N1 in some instances. In that case, core metal temperatures of the respective rollers lower, and, therefore, particularly, when the recording materials P are continuously fed, the fixing roller temperature can be below a predetermined temperature necessary to fix the toner (image) on the recording material P, i.e., the target temperature. The above is because improper toner fixing on the recording material P due to such a temperature lowering of the fixing roller temperature is avoided.

When the sheet feeding is started, the controller 50 causes the external heating belt 80*e*, the pressing roller 41, and the web roller 63 to be pressed against and contacted to the fixing roller 40 on the basis of the receiving time of the I-Top signal before the recording material P reaches the fixing nip N1 (S12). That is, the external heating belt 80*e*, the pressing roller 41 and the web roller 63 are moved to a state in which the respective members are contacted to the fixing roller, i.e., a contact state by the belt mounting and demounting mechanism, the pressing mounting and demounting mechanism and the web mounting and demounting mechanism.

Then, the controller 50 changes the temperature control of the external heating belt 80*e* so as to be carried out on the basis of only the temperature detected by the thermistor 81*a* for detecting the external heating upstream temperature (S13). That is, when detection that the external heating belt 80*e* is in the contact state is made, the controller 50 switches, on the basis of the temperature detected by the thermistor 81*a*, both of the halogen heaters 80*c* and 80*d* simultaneously so as to be subjected to the ON-OFF control. More specifically, the halogen heater 80*d* in the downstream side with respect to the rotational direction of the fixing roller 40 is switched, on the basis of the detection temperature of the thermistor 81*a* in the upstream side with respect to the rotational direction of the fixing roller 40, simultaneously with the halogen heater 80*c* so as to be subjected to the ON-OFF control. In this case, the controller 50 controls the energization to the halogen heater 80*d* simultaneously with control of the energization to the halogen heater 80*c* so that the detection temperature by the thermistor 81*a* is the target temperature Tex1*s*. Incidentally, even in the case when the temperature control of the external heating belt 80*e* is switched to control based on only the thermistor 81*a* as described above, the controller 50 monitors, on the basis of the temperature detected by the thermistor 81*b*, whether or not there is no abnormality in external heating downstream temperature. In the case when there is an abnormality in external heating downstream temperature, the controller 50 causes the display portion of the operating portion S to display an error and notifies the user of the abnormality, for example.

The controller 50 discriminates whether or not an image formation end signal is received (S14). In the case when the image formation end signal is received (YES of S14), the controller 50 changes the respective target temperatures to the target temperatures Trs, Tex1*s*, Tex2*s* and Tbs during stand-by (S15). Then, the controller 50 causes the external heating unit 80, the pressing roller 41 and the web roller 63 to be spaced from the fixing roller 40 and be placed in the spaced state, by the belt mounting and demounting mechanism, the pressing mounting and demounting mechanism, and the web mounting and demounting mechanism (S16). That is, the controller 50 causes the fixing device 9 to go to the stand-by state. In the case of the stand-by state, these members are kept in the contact state, deformation and distortion of the elastic layers at the fixing nip N1 and the external heating contact portion N2 remain, so that lateral stripes, glossy stripes (uneven glossiness), and the like, generate and, thus, an image quality can be reduced. In order to avoid this, in the stand-by state, the external heating unit 80, the pressing roller 41 and the web roller 63 are spaced from the fixing roller 40.

When the controller 50 causes the fixing device 9 to go to the stand-by state, the controller 50 returns the temperature control of the external heating belt 80*e* only by the thermistor 81*a* changed in the above-described S13 to that before the change (S17). That is, when the controller 50 detects that the external heating belt 80*e* is in the spaced state, the controller 50 returns the temperature control of the external heating belt 80*e* to the original temperature control. That is, the controller 50 returns the temperature control of the external heating belt 80*e* so that the temperature control is not effected on the basis of only the temperature detected by the thermistor 81*a* for detecting the external heating upstream temperature, but is effected on the basis of the temperatures detected by the thermistors 81*a* and 81*b*. Thus, in the case when the external heating belt 80*e* is in the spaced state, the control of the halogen heater 80*c* is carried out on the basis of the temperature detected by the thermistor 81*a* and the control of the halogen heater 80*d* is carried out on the basis of the temperature detected by the thermistor 81*b*.

Figure 6:
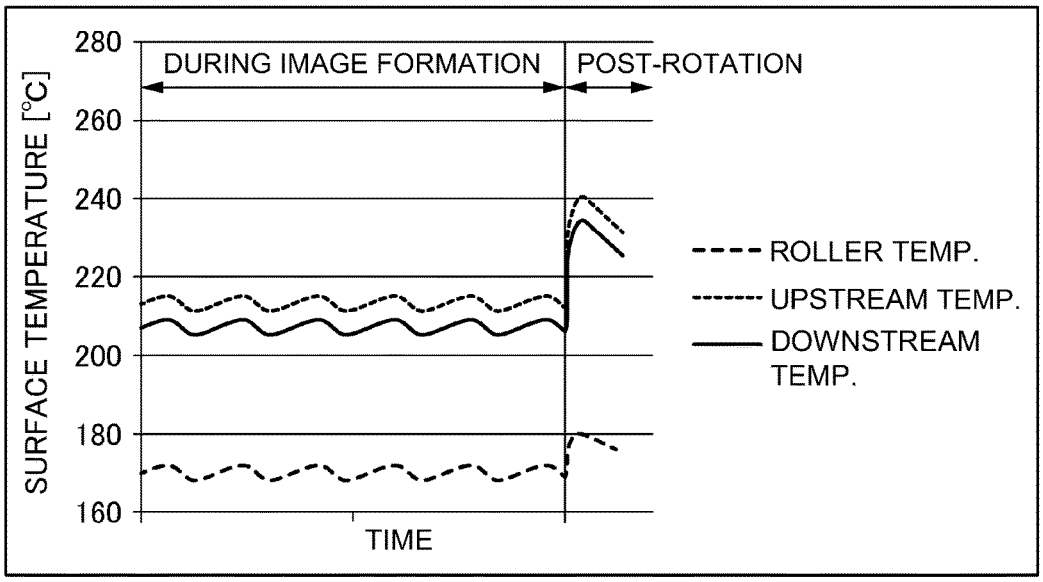
FIG. 6 is a graph showing time progressions of a fixing roller temperature, an external heating upstream temperature, and an external heating downstream temperature in the First Embodiment.

In FIG. 6, in the case when image formation is carried out on a large number of sheets of thick paper (basis weight: 250 g/m$^2$ as an example) by using a fixing device in this embodiment, time progressions of the fixing roller temperatures, the external heating upstream temperatures and the external heating downstream temperatures detected by the thermistors 42*a*, 81*a*, and 81*b* are shown. In FIG. 6, the ordinate represents the surface temperature, and the abscissa represents the time.

As can be understood by comparing FIG. 6 with FIG. 4 described above, also in the fixing device 9 in this embodiment, during image formation, the fixing roller temperature and the external heating upstream temperature reach 170° C. and 215° C., respectively, which are the target temperatures thereof. Further, during image formation, the fixing roller temperature and the external heating upstream temperature change while somewhat fluctuating, with predetermined temperature ripples depending on the ON/OFF control of the halogen heaters 40*a* and 80*c*. On the other hand, the external heating downstream temperature changes depending on the ON-OFF control of the halogen heater 80*d*, at the target temperature or less without reaching 215° C. which is the target temperature. Further, it is understood that during post-rotation, an increase in surface temperature of the external heating roller 80*b* by overshooting can be suppressed.

As described above, during image formation, the halogen heater 80*d* in the downstream side with respect to the rotational direction of the fixing roller 40 is ON-OFF controlled, on the basis of the detection temperature of the thermistor 81*a* in the upstream side with respect to the rotational direction of the fixing roller 40, simultaneously with the halogen heater 80*c*. That is, during image formation, the ON/OFF control of the halogen heater 80*d* is not carried out on the basis of the surface temperature, lower than the belt surface temperature in the upstream side with respect to the rotational direction of the fixing roller 40, of the external heating belt 80*e* after passing through the external heating contact portion N2. By doing so, localization of electrical power supply to each of the two external heating rollers 80*a* and 80*b* does not generate, so that these rollers are similarly heated. For this reason, when the external heating belt 80*e* is stopped after image formation, the surface temperature of the external heating roller 80*b* is prevented from abruptly increasing. That is, particularly, it is possible to suppress the increase in surface temperature of the external heating roller 80*b* by the overshooting. By this, a liability that not only the fixing roller 40 and the external heating roller 80*b*, but also the external heating belt 80*e* are broken due to thermal deterioration, can be reduced. Further, it is possible to lower a possibility that image defects, such as fixing non-uniformity, uneven glossiness, and color unevenness.

Second Embodiment

Incidentally, the user erroneously sets the recording material P with a basis weight larger than a set basis weight and executes the image forming job, in some instances. For example, such a case that plain paper of 81 g/m$^2$ in basis weight and thick paper of 240 g/m$^2$ in basis weight exist in a mixture, although the plain paper of 81 g/m$^2$ in basis weight is set as the recording material P exists. In this case, the thick paper of 240 g/m$^2$ in basis weight is fed substantially to the plain paper of 81 g/m$^2$ in basis weight, and, therefore, image formation on the thick paper is carried out subsequently to the plain paper. When the recording material P changes from the plain paper to the thick paper, the quantity of the heat transferred from the fixing roller 40 to the recording material P increases. For that reason, supply of the heat from the external heating unit 80 to the fixing roller 40 cannot catch up with the transfer of the quantity of the heat, with the result that the image formation on the thick paper is carried out while the surface temperature of the fixing roller 40 is lower than the target temperature necessary for the fixing. In the following, this point will be described.

First, in Table 2, a lowest (point) temperature in the case when although the plain paper of 81 g/m$^2$ in basis weight is set as the recording material P, the recording material P with a basis weight of 81 g/m$^2$ or more is fed during image formation and the surface temperature of the fixing roller 40 is lowest is shown for each of basis weights of the recording materials P.

TABLE 2

| | Recording material basis weight (g/m$^2$) | | | | |
|---|---|---|---|---|---|
| | 81 | 100 | 150 | 200 | 240 |
| FRLT*1 | 167 | 165 | 160 | 155 | 150 |

*1"FRLT" is the fixing roller lowest temperature.

In the case when the plain paper of 81 g/m$^2$ in basis weight, which is the same as user setting, is fed, the respective halogen heaters 80*c* and 80*d* are individually controlled so that the external heating upstream temperature and the external heating downstream temperature detected by the thermistors 81*a* and 81*b* are 210° C. (see Table 1). However, with image formation on a large number of sheets of the recording material P, the external heating downstream temperature detected by the thermistor 81*b* gradually lowers and is maintained at 208° C., for example. This is due to a supply of the heat from the external heating belt 80*e* to the fixing roller 40 at the external heating contact portion (nip). Further, with an increasing basis weight, heat transferred from the fixing roller 40 to the recording material P is greater, and, therefore, as shown in Table 2, with a greater basis weight of the fed recording material P than the basis weight set by the user, the external heating downstream temperature detected by the thermistor 81*b* becomes lower.

Figure 7:
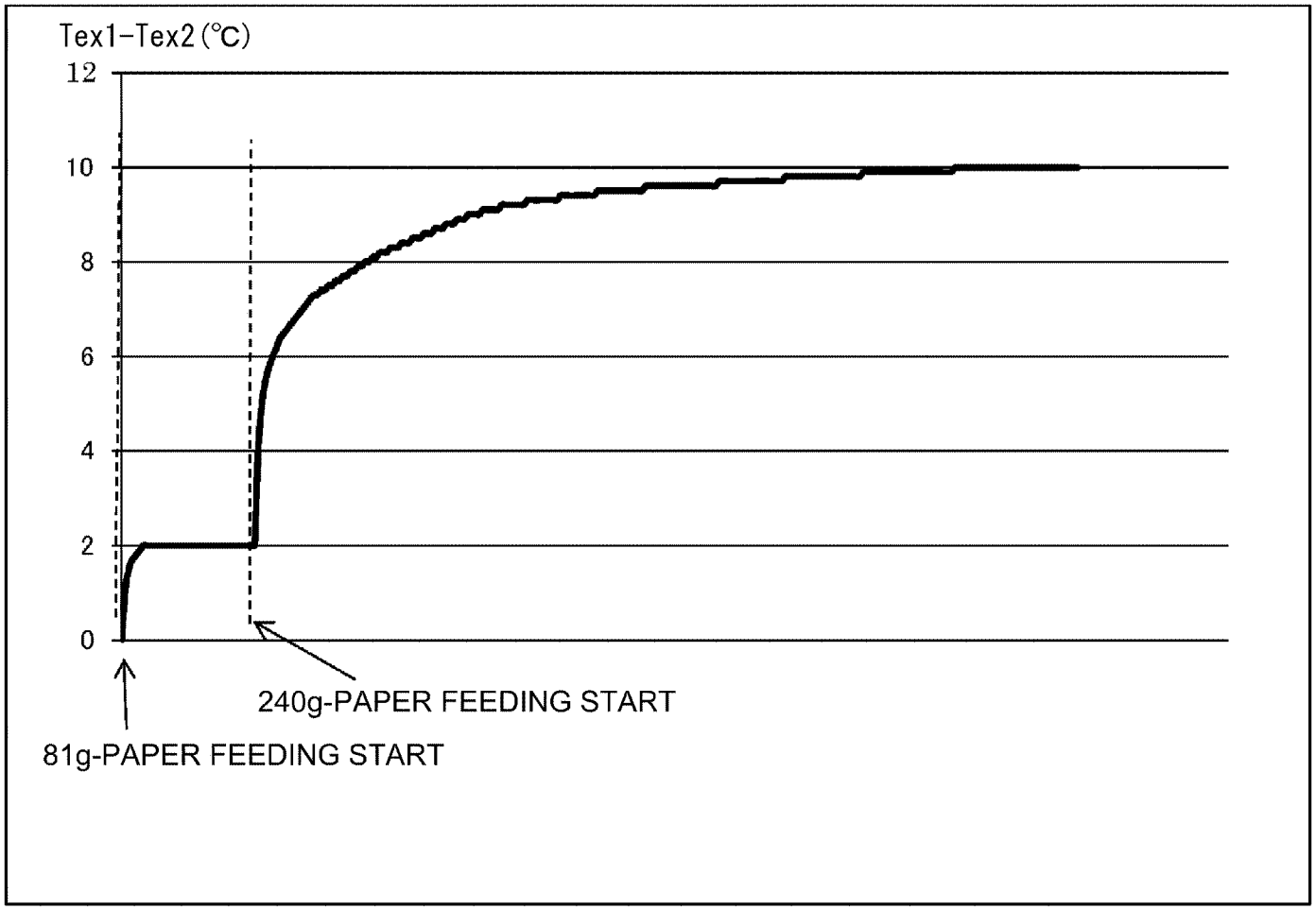
FIG. 7 is a graph showing a difference in detection temperature between a thermistor in an upstream side with respect to a rotational direction of a fixing roller and a thermistor in a downstream side with respect to the rotational direction of the fixing roller.

FIG. 7 is a graph showing a temperature difference (Tex1−Tex2) between a detection temperature Tex1 of the thermistor 81*a* and a detection temperature Tex2 of the thermistor 81*b* in the case when the thick paper of 240 g/m$^2$ in basis weight is fed subsequently to the plain paper of 81 g/m$^2$ in basis weight and the image formation is carried out.

As shown in FIG. 7, when the recording material P with the basis weight of 81 g/m$^2$ is fed and the image formation is started, the temperature difference (Tex1−Tex2) gradually extends from a state of 0° C. and is maintained at 2° C. This fixing device generates with a supply of the heat from the external heating belt 80*e* to the fixing roller 40 lowering in temperature by heat transfer to the recording material P, and, therefore, is unchanged and stabilized in the case when the recording materials P with the same basis weight are continuously fed. However, when the recording material P with the basis weight of 240 g/m$^2$ is fed, the fixing roller temperature further lowers, to that the heat supplied from the external heating belt 80*e* to the recording material P increases. Then, the temperature of the detection temperature Tex2 of the thermistor 81*b* lowers as compared with the case of the recording material P with the basis weight of 81 g/m$^2$, and, therefore, the temperature difference with the detection temperature Tex1 of the thermistor 81*a* extends to 10° C.

In Table 3, an upper-limit temperature (allowable upper-limit temperature) and a lower-limit temperature (fixable temperature) of the surface temperature, of the fixing roller 40, appropriate for the toner fixing on the recording material P are shown for each of basis weights of the recording materials P.

TABLE 3

| | Recording material basis weight (g/m$^2$) | | | | | |
|---|---|---|---|---|---|---|
| | 60-79 | 80-99 | 100-149 | 150-179 | 180-199 | 200-249 |
| AULT*1 (° C.) | 175 | 180 | 185 | 190 | 195 | 200 |
| FT*2 | 135 | 140 | 147 | 153 | 155 | 157 |

*1"AULT" is the allowable upper-limit temperature.
*2"FT" is the fixable temperature.

As described above, for example, when the recording material P with a large basis weight is fed in the case when the user setting is the basis weight of 81 g/m$^2$, the surface temperature of the fixing roller 40 is below the fixable temperature necessary for the toner fixing. That is, when the recording material P with the basis weight of 240 g/m$^2$ is fed in the case when the user setting is the basis weight of 81 g/m$^2$, the lowest temperature of the fixing roller 40 is 150° C. (see Table 2) and is below the fixable temperature of 157° C. (see Table 3) at the time of the recording material P with the basis weight of 240 g/m$^2$.

However, when the surface temperature of the fixing roller 40 is kept at a low temperature, which is below the fixable temperature, the toner image is not fixed, and a phenomenon, which is called a cold offset, such that the toner is deposited on the fixing roller 40 generates, so that this can cause generation of the image defect. Further, when the toner deposited on the fixing roller 40 is deposited on a subsequent recording material P, image contamination occurs. Further, in the case when the user continues (image formation without noting the generation of the cold offset, the toner can be deposited on, in addition to the fixing roller 40, the cleaning unit 60 and the external heating belt 80*e*, and the like. In such a state, when the operation of the fixing device 9 is stopped and the fixing device 9, specifically, the fixing device 40, the cleaning unit 60, the external heating belt 80*e*, and the like, are cooled, the toners deposited on these members stick thereto. When the toners stick thereto, there is a large liability that the fixing roller 40, the cleaning unit 60, the external heating belt 80*e*, and the like, are damaged when the fixing device 9 is operated again. Therefore, in the case such that the recording material P different in various pieces of information (for example, the basis weight) from the recording material P set by the user is fed during image formation, there is a need to increase the surface temperature of the fixing roller 40 up to a temperature exceeding at least the fixable temperature. However, as in the above-described First Embodiment, in the case when the surface temperature of the external heating belt 80*e* is controlled only by the thermistor 81*a* during image formation, it becomes difficult to increase the surface temperature of the fixing roller 40 up to the temperature exceeding the fixable temperature.

Therefore, in the following, a fixing device according to Second Embodiment, in which the above-described problem is solved, will be described. However, a constitution and a control system of the fixing device 9 according to Second Embodiment are similar to those in the above-described First Embodiment (see FIGS. 2 and 3), and, therefore, will be omitted from description.

Here, in Table 4, respective target temperatures (represented as setting temperatures in the table) of the fixing roller 40 and the external heating belt 80*e*, which are used during stand-by and during image formation, are shown. The controller 50 subjects, as described above, the halogen heaters 40*a* and 41*a* and the halogen heaters 80*c* and 80*d* to the ON-OFF control, and adjusts the surface temperature of the external heating belt 80*e*, and by extension to the surface temperature of the fixing roller 40, to the target temperatures shown in Table 4. As can be understood from Table 4, the target temperatures of the fixing roller 40 and the external heating belt 80*e* are determined depending on the basis weight of the recording material P. Further, a turning-on duty (turning-on ratio) of the external (heating) heater, i.e., the halogen heaters 80*c* and 80*d* is different for each of basis weights of the recording materials P. Incidentally, in the fixing device according to the Second Embodiment, the controller 50 effects control for energizing the halogen heaters 80*c* and 80*d* in accordance with the turning-on duty.

TABLE 4

| | Recording material basis weight (g/m$^2$) | | | | | |
|---|---|---|---|---|---|---|
| | 60-79 | 80-99 | 100-149 | 150-179 | 180-199 | 200-249 |
| FRST*1 TDSB*2 | 165 (° C.) | | | | | |
| FRST*1 TDIF*3 | 170 (° C.) | | | | | |
| EHBST*4 TDSB+2 | 190 (° C.) | | | | | |
| EHBST*4 TDIF*3 | 210 (° C.) | | | | | |
| EHTOD*5 (%) | 40 | 40 | 80 | 80 | 90 | 100 |

*1"FRST" is the fixing roller setting temperature.
*2"TDSB" is the temperature during stand-by.
*3"TDIF" is the temperature during image formation.
*4"EHBST" is the external heating belt setting temperature.
*5"EHTOD" is the external heater turning-on duty.

Figure 8:
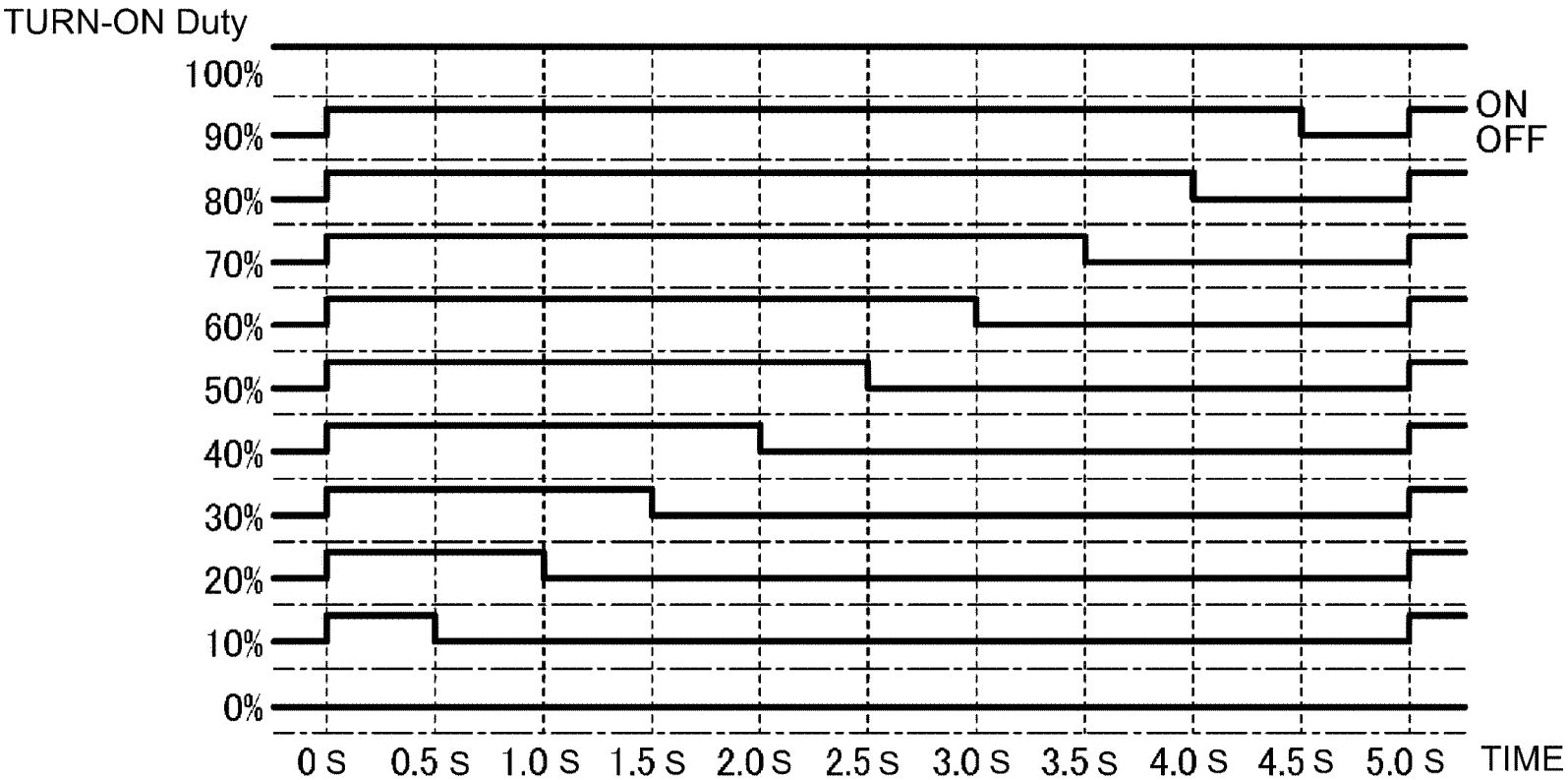
FIG. 8 is an illustration showing a relationship between a turning-on duty and an energization time of a halogen heater.

The above-described "turning-on duty" represents a proportion of a time, in which the halogen heaters 80*c* and 80*d* are energized in actuality, of a predetermined time in the case when energization to the halogen heaters 80*c* and 80*d* for a predetermined time (for five seconds, for example). In FIG. 8, a relationship of the turning-on duty with an energization time and a non-energization time of the halogen heaters 80*c* and 80*d* was shown. In FIG. 8, the ordinate represents the turning-on duty (%), and the abscissa represents the time (seconds). As shown in FIG. 8, for example, in the case when the turning-on duty is 60%, it is shown that of five seconds, for the first three seconds, the energization is made (ON), and for the remaining two seconds, the energization is not made (OFF, non-energization).

Figure 9:
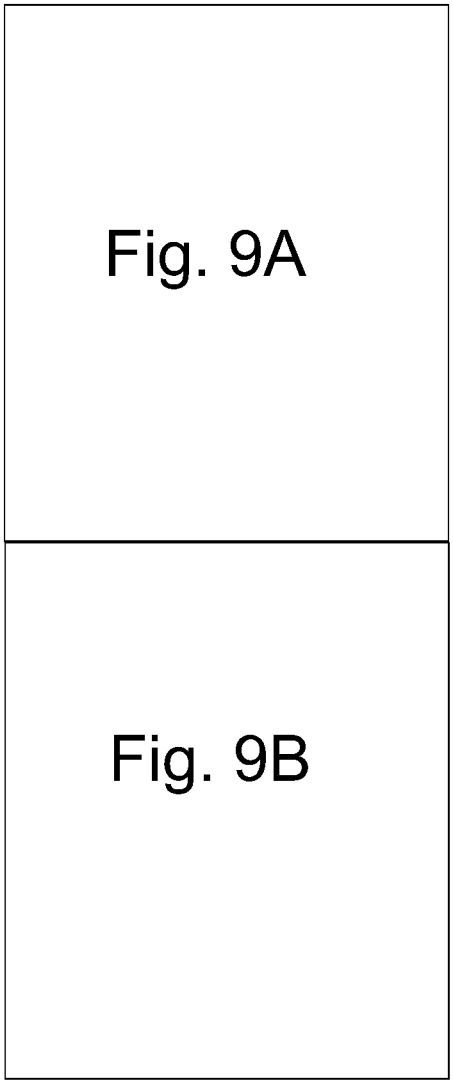
FIGS. 9, 9A, and 9B depict a flowchart showing control of a fixing roller in a Second Embodiment.
Figure 9A:
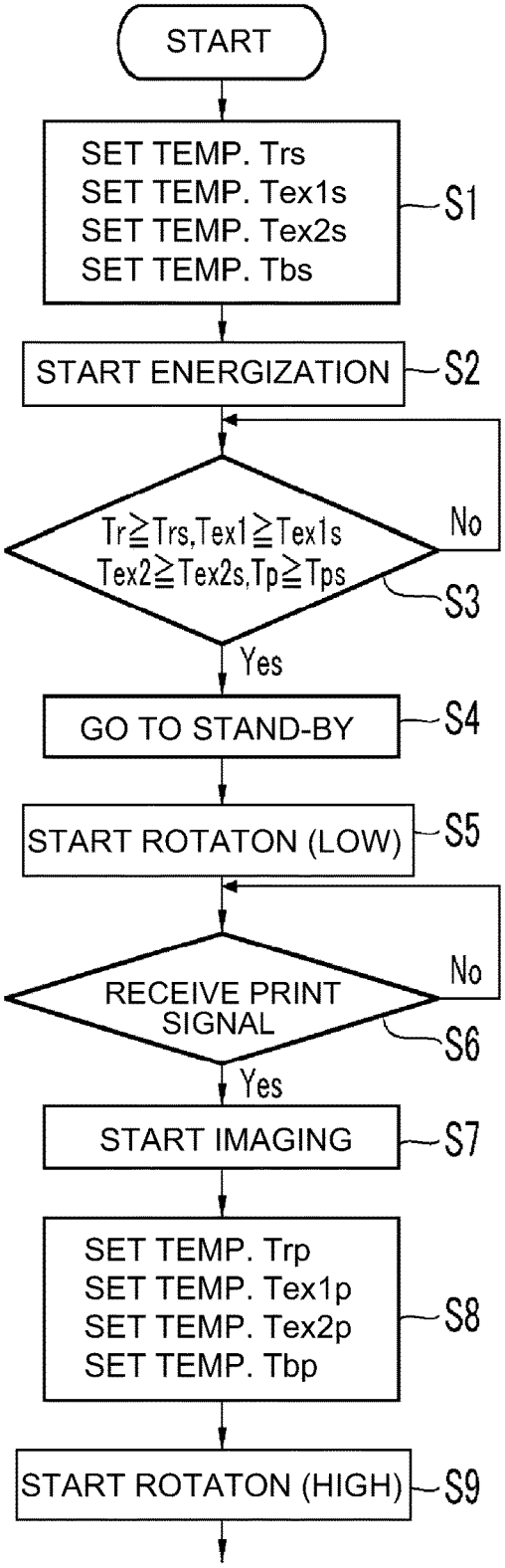
Figure 9B:
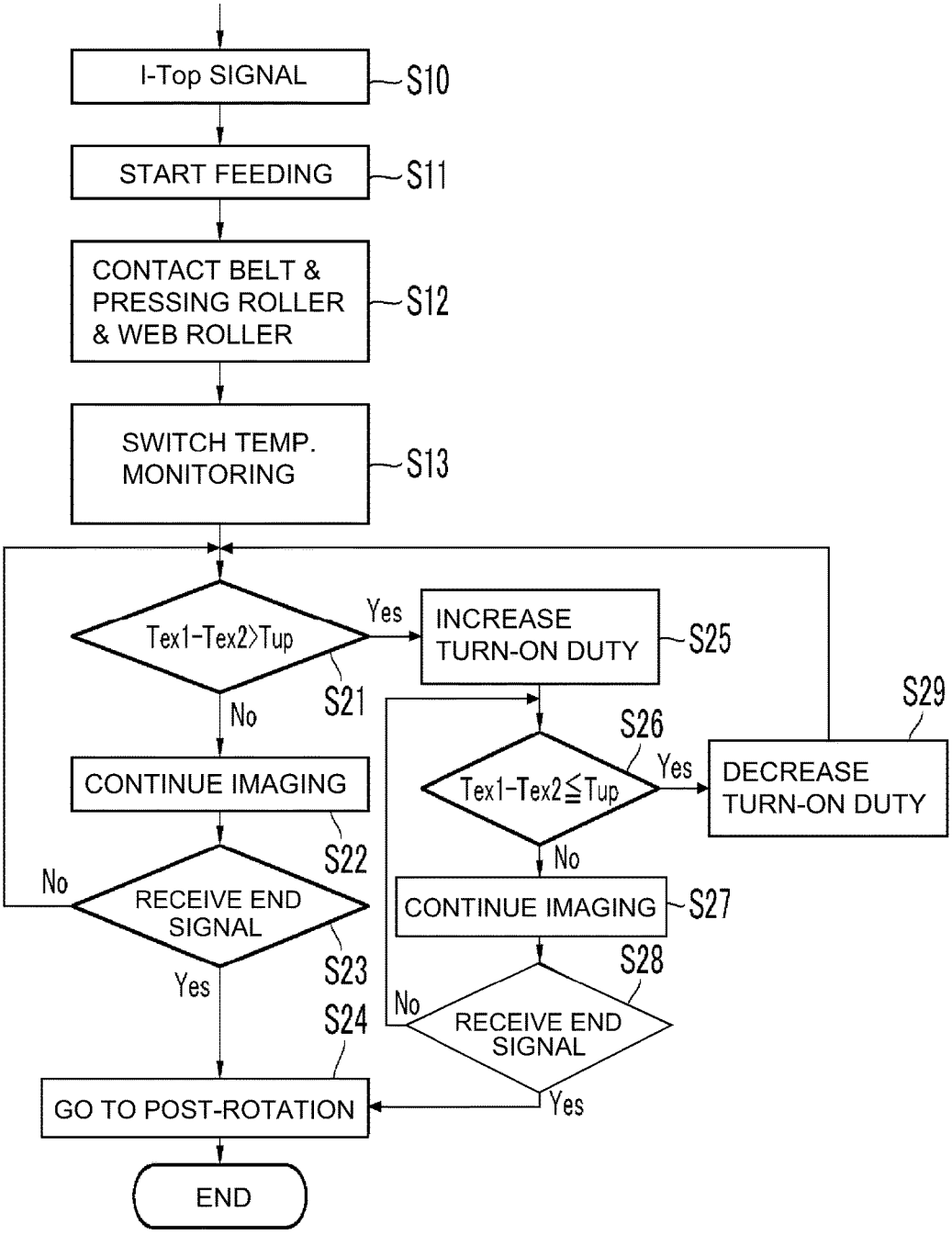

FIG. 9 is a flowchart showing the control of the fixing device in the Second Embodiment. However, a portion overlapping in description with the control shown in the above-described FIG. 5 will be omitted from explanation. Further, a description will be made by taking, as an example, the case when the thick paper with the basis weight of 240 g/m$^2$ was fed during image formation although the plain paper with the basis weight of 81 g/m$^2$ is set as the recording material P.

As shown in FIG. 9 (9A, 9B), the controller 50 starts, after a process of S1 is executed, energization to the respective halogen heaters 40*a*, 41*a*, 80*c*, and 80*d* of the fixing device (S2). However, the turning-on duty of the halogen heaters 80*c* and 80*d* in this case is 100% irrespective of the basis weight set by the user. That is, the halogen heaters 80*c* and 80*d* are always energized. Thereafter, the controller 50 executes respective processes of S3 to S7.

The controller 50 changes the respective target temperatures to a target temperature Trp of the fixing roller temperature, a target temperature Tex1*p* of the external heating upstream temperature, a target temperature Tex2*p* of the external heating downstream temperature, and a target temperature Tbp of the surface temperature of the pressing roller 41, which are to be used during image formation (S8). From the above-described Table 4, the target temperature Trp of the fixing roller temperature used during image formation is changed to 170° C., and the target temperature Tex1*p* of the external heating upstream temperature and the target temperature Tex2*p* of the external heating downstream temperature, which are used during image formation, are changed to 210° C. The target temperature Tbp of the surface temperature of the pressing roller 41 is 100° C. At this time, the turning-on duty is changed to 40% in accordance with the setting for the basis weight of 81 g/m$^2$, and the halogen heaters 80*c* and 80*d* are energized. That is, the halogen heaters are repetitively energized for two seconds with an interval of three seconds.

After execution of the respective processes S9 to S12, the controller 50 changes the temperature control of the external heating belt 80*e* so as to be carried out on the basis of only the temperature detected by the thermistor 81*a* for detecting the external heating upstream temperature (S13). That is, when the contact state of the external heating belt 80*e* is detected, the controller 50 causes, on the basis of the temperature detected by the thermistor 81*a*, both of the halogen heaters 80*c* and 80*d* simultaneously so as to be subjected to the ON-OFF controllable. However, in this Second Embodiment, even when the halogen heaters 80*c* and 80*d* are simultaneously subjected to the ON control, these heaters 80*c* and 80*d* are repetitively subjected to the energization (ON) and the non-energization (OFF) with a predetermined time interval in accordance with the turning-on duty. Thus, the overshooting of the surface temperature of external heating belt 80*e* after the image formation is suppressed.

The controller 50 discriminates whether or not the temperature difference (Tex1−Tex2) between the detection temperature Tex1 of the thermistor 81*a* and the detection temperature Tex2 of the thermistor 81*b* is greater than a temperature difference Tup (4° C., for example) as a first predetermined value (S21). In the case when the temperature difference (Tex1−Tex2) is not more than the first predetermined value, i.e., not more than the predetermined temperature difference Tup (NO of S21), the controller 50 continues image formation without changing the turning-on duty of the halogen heaters 80*c* and 80*d* from 40% (S22). That is, in this case, the temperature of the detection temperature Tex2 of the thermistor 81*b* does not largely lower, so that the temperature difference with the detection temperature Tex1 of the thermistor 81*a* is small. For that reason, there is a small liability that the surface temperature of the fixing roller 40 becomes a low temperature that is below the fixable temperature, so that there is no need to carry out control of increasing the external heating downstream temperature in order to increase the surface temperature of the fixing roller 40, i.e., control of increasing the turning-on duty of the halogen heater 80*d*.

The controller 50 discriminates whether or not a print end signal is received (S23), and in the case when the print end signal is not received (NO of S23), the process is returned to the process of the above-described S21. In the case when the print end signal is received (YES of S23), a post-rotation operation is performed (S24), and the process is ended. In the post-rotation operation in this embodiment, the controller 50 executes the above-described process S15 to S17 of FIG. 5. That is, the controller 50 changes the respective target temperatures to the target temperatures Trs, Tex1*s*, Tex2*s*, and Tbs during stand-by (S15). Then, the controller 50 causes the external heating unit 80, the pressing roller 41 and the web roller 63 to be spaced from the fixing roller 40 and be placed in the spaced state (S16). The controller 50 returns the temperature control of the external heating belt 80*e* only by the thermistor 81*a* to the temperature control before the change (S17).

On the other hand, in the case when the temperature difference (Tex1−Tex2) is larger than the predetermined temperature difference Tup (YES of S21), the controller 50 increases the turning-on duty of the halogen heater 80*d* of those of the halogen heaters 80*c* and 80*d* (S25). For example, the controller 50 increases the turning-on duty, which was 40%, up to 100%. That is, in this case, the temperature of the detection temperature Tex2 of the thermistor 81*b* largely lowers, so that the temperature difference with the detection temperature Tex1 of the thermistor 81*a* becomes large. For that reason, there is a liability that the surface temperature of the fixing roller 40 becomes a low temperature that is below the fixable temperature. Therefore, in order to increase the surface temperature of the fixing roller 40, control of increasing the external heating downstream temperature, i.e., control of increasing the turning-on duty of the halogen heater 80*d* is effected.

The controller 50 discriminates whether or not the temperature difference (Tex1−Tex2) is not more than the predetermined temperature difference Tup after the process of S25 (S26). In the case when the temperature difference (Tex1−Tex2) is greater than the predetermined temperature difference Tup (NO of S26), the controller 50 continues the image formation without returning the turning-on duty of the halogen heater 80*d* from 100%, after the change, to the original value (S27). That is, in a period in which the temperature difference (Tex1−Tex2) is greater than the predetermined temperature difference Tup, there is a liability that the surface temperature of the fixing roller 40 becomes low temperature, which is below the fixable temperature, and, therefore, there is a need to subsequently increase the external heating downstream temperature. For that reason, the halogen heater 80*d* is energized in accordance with the increased turning-on duty after the change.

The controller 50 discriminates whether or not a print end signal is received (S28), and, in the case when the print end signal is not received (NO of S28), the process is returned to the process of the above-described S26. In the case when the print end signal is received (YES of S28), a post-rotation operation is performed (S24), and the process is ended. In the post-rotation operation in this embodiment, the controller 50 executes the process S15 to S17 of FIG. 5 as described above.

In the above-described process of S26, in the case when the temperature difference (Tex1−Tex2) is not more than the predetermined temperature difference Tup (YES of S26), the controller 50 returns the turning-on duty of the halogen heater 80*d* to the turning-on duty before the change (S29). For example, the controller 50 decreases the turning-on duty, which was 100%, to 40%. That is, control of increasing the turning-on duty of the halogen heater 80*d* (see S25), and, therefore, the external heating downstream temperature increases, so that the surface temperature of the fixing roller 40 becomes a temperature exceeding the fixable temperature. However, when the surface temperature of the fixing roller 40 is further increased, the fixing roller 40, or the like, can be broken. Therefore, the turning-on duty of the halogen heater 80*d* is decreased and returned to the original value, whereby a further increase in surface temperature of the fixing roller 40 is suppressed. After the process of S29, the process is returned to the above-described process of S21, and the controller 50 repeats the processes of S21 to S29.

As described above, also in Second Embodiment, during image formation, the halogen heater 80*d* in the downstream side with respect to the rotational direction of the fixing roller 40 is ON-OFF controlled, on the basis of the detection temperature of the thermistor 81*a* in the upstream side with respect to the rotational direction of the fixing roller 40, simultaneously with the halogen heater 80*c*. Then, on the basis of a difference in detection temperature between the two thermistors 81*a* and 81*b*, control of increasing the turning-on duty of the halogen heater 80*d* is carried out in the case when the heat quantity supplied from the external heating belt 80*e* to the fixing roller 40 is insufficient. By this, during image formation, the recording material P is changed from the plain paper to the thick paper, for example, and even when the quantity of the heat transferred from the fixing roller 40 to the recording material P is increased, it is possible to carry out sufficient heat supply from the external heating unit 80 to the fixing roller 40. For that reason, the image formation on the thick paper is not effected while making the surface temperature of the fixing roller 40 lower than a necessary target temperature. Accordingly, the image defect due to the generation of the cold offset is not readily generated.

Incidentally, in the Second Embodiment, in the case when the temperature difference (Tex1–Tex2) is greater than the predetermined temperature difference Tup, the turning-on duty of only the halogen heater 80*d* is changed (see S25), but the present invention is not limited thereto, and the turning-on duty of both of the halogen heaters 80*c* and 80*d* may also be changed. In that case, in the above-described process of S26, when the temperature difference (Tex1–Tex2) is not more than the predetermined temperature difference Tup, the turning-on duty of the both of the halogen heaters 80*c* and 80*d* is returned to the turning-on duty before the change (S29).

Third Embodiment

Incidentally, when the feeding interval of the recording material P is made longer than a predetermined time during image formation, the number of sheets of the recording materials P fed to the fixing nip N1 per unit time decreases, and, therefore, a lowering (degree) of the surface temperature of the fixing roller 40 becomes smaller than an assumed degree. Then, the heat supply from the external heating unit 80 to the fixing roller 40 becomes excessive, so that the surface temperature of the fixing roller 40 can be higher than the target temperature. The toner image fixed on the recording material P at a temperature higher than the target temperature is liable to cause a non-uniformity in gloss and density. Further, when the surface temperature of the fixing roller 40 is high, viscosity of the toner becomes less than proper viscosity at which the toner image is fixed on the recording material P. In that case, a phenomenon, which is called a hot offset, such that the toner image is not fixed on the recording material P and the toner is deposited on the fixing roller 40 generates, so that a problem similar to that in the case when the cold offset as described above generates can arise. In the following, this point will be described using FIGS. 10 and 11.

Figure 10:
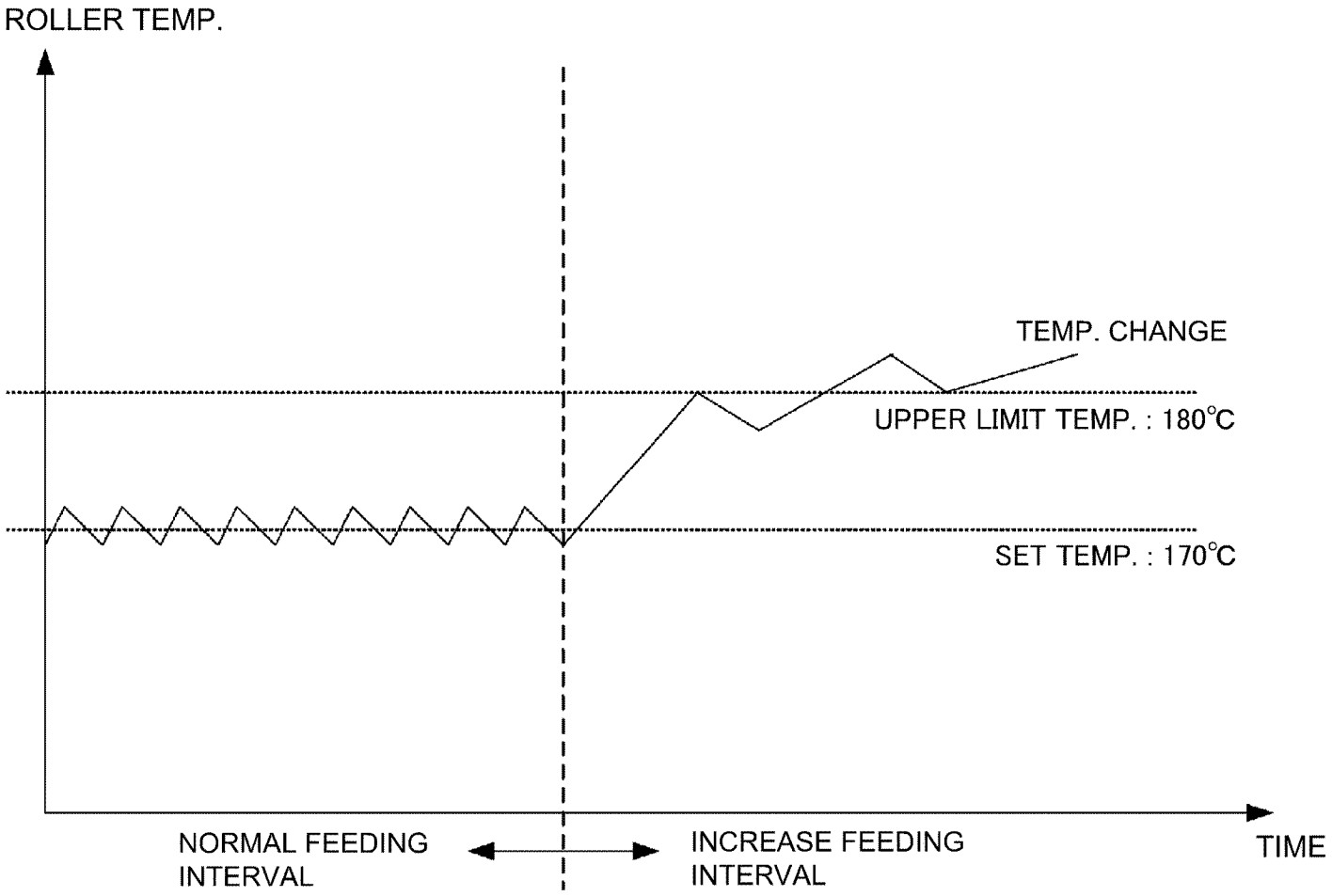
FIG. 10 is an illustration showing a time progression of a fixing roller temperature in a case when a feeding interval of a recording material is increased.

FIG. 10 shows a time progression of the surface temperature of the fixing roller 40 in the case when the feeding interval of the recording material P (basis weight: 81 g/m$^2$ as an example) is longer than a predetermined time during image formation. In this case, during image formation, the respective halogen heaters 40*a*, 41*a*, 80*c*, and 80*d* are controlled so that the surface temperature of the fixing roller 40 (fixing roller temperature) is the target temperature of 170° C. (see Table 4). However, when the feeding interval of the recording material P is longer than the predetermined time, the quantity per unit time of the heat transferred from the fixing roller 40 to the recording material P decreases. With this, the heat quantity supplied to the fixing roller 40 relatively becomes large, and, therefore, as shown in FIG. 10, the surface temperature of the fixing roller 40 gradually increases and exceeds 180° C. (see Table 3), which is a proper allowable upper-limit temperature for the toner fixing. Then, the phenomenon called the hot offset generates and becomes a cause of generation of the image defect.

Figure 11:
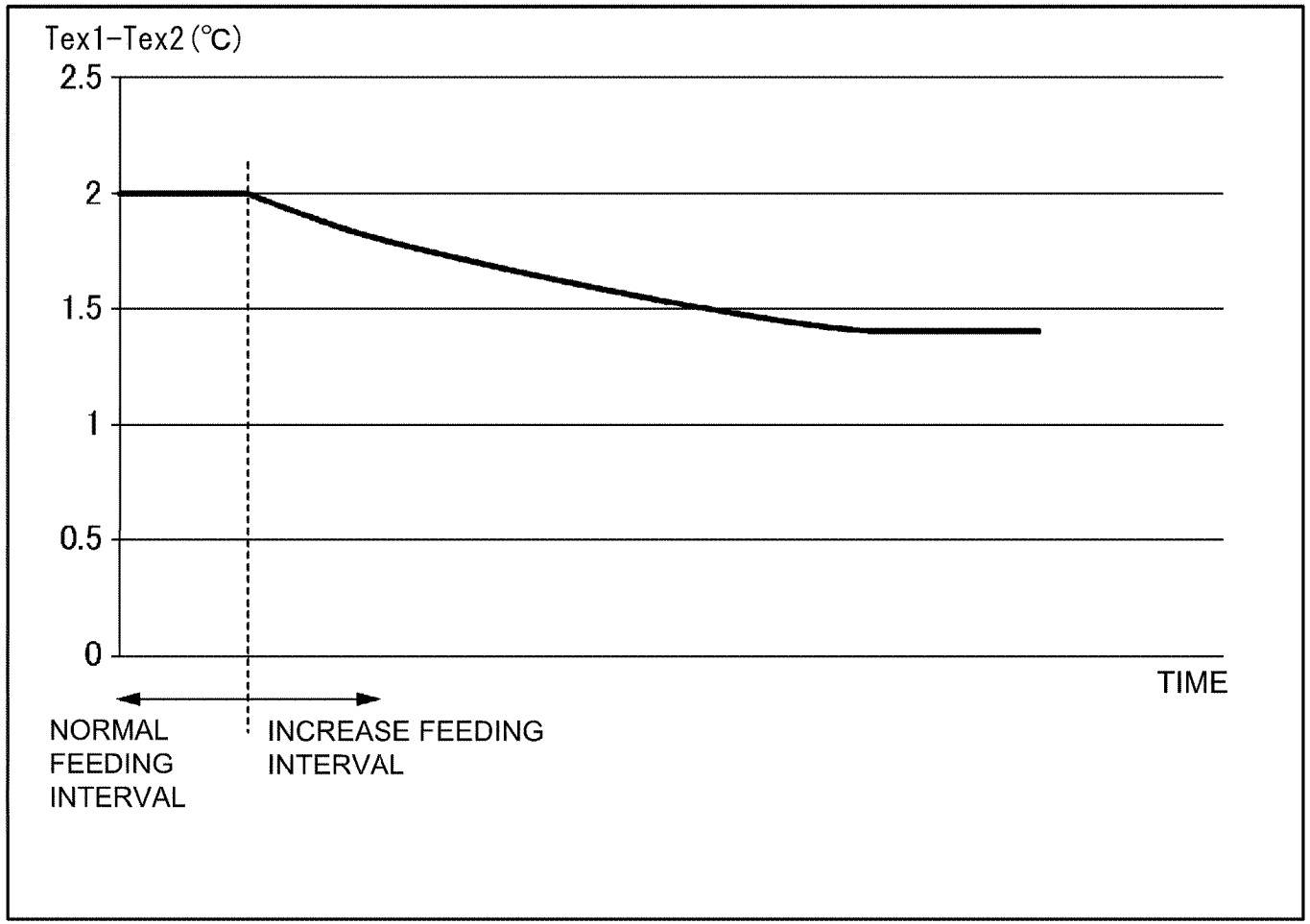
FIG. 11 is a graph showing a difference in detection temperature between a thermistor in an upstream side with respect to a rotational direction of a fixing roller and a thermistor in a downstream side with respect to the rotational direction of the fixing roller.

FIG. 11 is a graph showing a temperature difference (Tex1–Tex2) between a detection temperature Tex1 of the thermistor 81*a* and a detection temperature Tex2 of the thermistor 81*b* in the case when the feeding interval of the recording material P (basis weight: 81 g/m$^2$ as an example) is longer than the predetermined time during image formation.

As shown in FIG. 11, in the case when the recording material P is fed with a predetermined time interval, irrespective of the number of sheets of the temperatures P fed to the fixing nip N1 per unit time, the surface temperature of the fixing roller 40 lowers as estimated. For that reason, the temperature difference (Tex1–Tex2) is maintained at 2° C. As described above, this fixing device generates with a supply of the heat from the external heating belt 80*e* to the fixing roller 40 lowering in temperature by heat transfer to the recording material P. For that reason, when the recording materials P are fed with the predetermined feeding interval, the heat transfer to the recording materials P and the heat supply from the external heating belt 80*e* are balanced with each other on the fixing roller 40, so that the temperature difference (Tex1–Tex2) is unchanged, and is stabilised.

However, when the feeding interval of the recording material P is longer than the predetermined time and the number of sheets of the recording materials P fed to the fixing nip N1 per unit time decreases, the temperature difference (Tex1–Tex2) gradually becomes small as shown in FIG. 11. This is because the surface temperature of the fixing roller 40 is increased by the increase in feeding interval of the recording material P. That is, the surface temperature of the fixing roller 40 increases by the decrease in heat quantity transferred to the recording material P, and with this, the heat quantity supplied from the external heating belt 80*e* to the fixing roller 40 decreases. Then, the surface temperature of the external heating belt 80*e* is temperature-detected by the thermistor 81*b* while being high without lowering. In this case, even when the detection temperature Tex1 of the thermistor 81*a* is unchanged, the detection temperature Tex2 of the thermistor 81*b* relatively increases, so that the temperature difference (Tex1–Tex2) becomes small.

When, during image formation, the temperature difference (Tex1–Tex2) becomes small, i.e., the surface temperature of the fixing roller 40 increases, the hot offset generates, so that the image defect can generate. Therefore, in the case such that the feeding interval of the recording material P is longer than the predetermined time, there is a need to decrease the surface temperature of the fixing roller 40 down to a temperature that is below at least the allowable upper-limit temperature. However, as in the above-described First Embodiment, in the case when the surface temperature of the external heating belt 80*e* is controlled only by the thermistor 81*a* during image formation, it becomes difficult to decrease the surface temperature of the fixing roller 40 down to the temperature that is below the allowable upper-limit temperature.

Therefore, in the following, a fixing device according to a Third Embodiment in which the above-described problem is solved, will be described. However, a constitution and a control system of the fixing device 9 according to the Third Embodiment are similar to those in the above-described First Embodiment (see FIGS. 2 and 3), and, therefore, will be omitted from description.

Figure 12A:
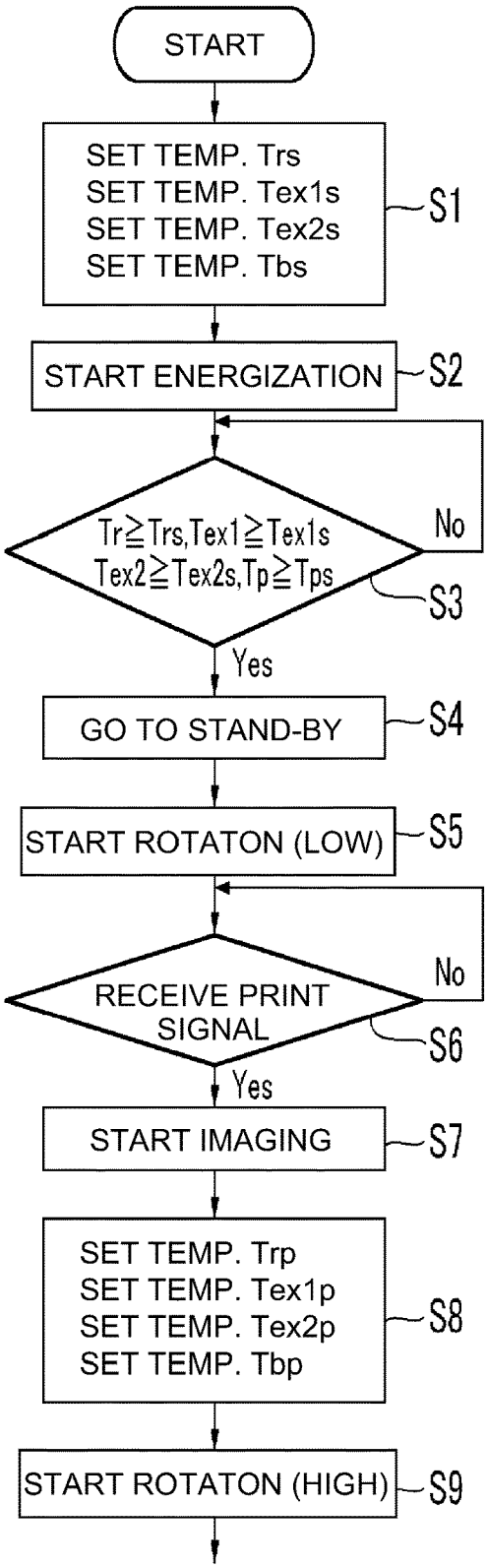
Figure 12B:
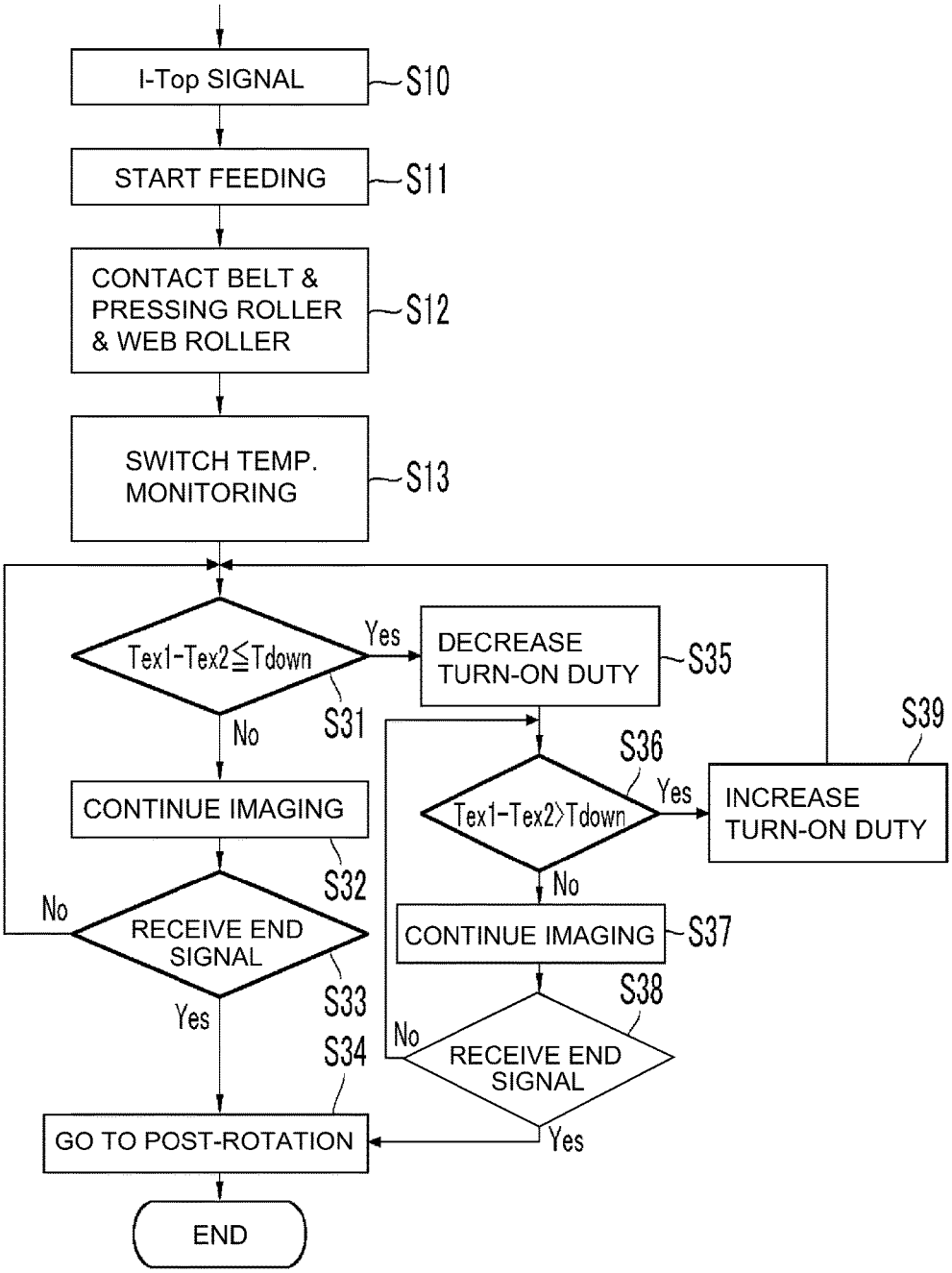

FIG. 12 is a flowchart showing the control of the fixing device in the Third Embodiment. However, a portion overlapping in description with the control shown in the above-described FIG. 5 will be omitted from explanation. Further, a description will be made by taking, as an example, the case when the plain paper, with the basis weight of 81 g/m$^2$, is used as the recording material P during image formation.

As shown in FIG. 12 (12A, 12B), the controller 50 starts, after a process of S1 is executed, energization to the respective halogen heaters 40*a*, 41*a*, 80*c*, and 80*d* of the fixing device (S2). However, the turning-on duty of the halogen heaters 80*c* and 80*d* in this case is 100%. Thereafter, the controller 50 executes respective processes of S3 to S7.

The controller 50 changes the respective target temperatures to a target temperature Trp of the fixing roller temperature, a target temperature Tex1*p* of the external heating upstream temperature, a target temperature Tex2*p* of the external heating downstream temperature, and a target temperature Tbp of the surface temperature of the pressing roller 41, which are to be used during image formation (S8). From the above-described Table 4, the target temperature Trp of the fixing roller temperature used during image formation is changed to 170° C., and the target temperature Tex1*p* of the external heating upstream temperature and the target temperature Tex2*p* of the external heating downstream temperature, which are used during image formation, are changed to 210° C. The target temperature Tbp of the surface temperature of the pressing roller 41 is 100° C. At this time, the turning-on duty is changed to 40% in accordance with the setting for the basis weight of 81 g/m$^2$, and the halogen heaters 80*c* and 80*d* are energized. That is, the halogen heaters are repetitively energized for two seconds with an interval of three seconds.

After execution of the respective processes S9 to S12, the controller 50 changes the temperature control of the external heating belt 80*e* so as to be carried out on the basis of only the temperature detected by the thermistor 81*a* for detecting the external heating upstream temperature (S13). That is, when the contact state of the external heating belt 80*e* is detected, the controller 50 causes, on the basis of the temperature detected by the thermistor 81*a*, both of the halogen heaters 80*c* and 80*d* simultaneously so as to be subjected to the ON-OFF control. However, in this Third Embodiment, even when the halogen heaters 80*c* and 80*d* are simultaneously subjected to the ON control, these heaters 80*c* and 80*d* are repetitively subjected to the energization (ON) and the non-energization (OFF) with a predetermined time interval in accordance with the turning-on duty. Thus, the overshooting of the surface temperature of external heating belt 80*e* after the image formation is suppressed.

The controller 50 discriminates whether or not the temperature difference (Tex1−Tex2) between the detection temperature Tex1 of the thermistor 81*a* and the detection temperature Tex2 of the thermistor 81*b* is not more than a temperature difference Tdown (0.3° C., for example) as a second predetermined value (S31). In the case when the temperature difference (Tex1−Tex2) is greater than the predetermined temperature difference Tdown (NO of S31), the controller 50 continues image formation without changing the turning-on duty of the halogen heaters 80*c* and 80*d* from 40% (S32). That is, in this case, the temperature of the detection temperature Tex2 of the thermistor 81*b* does not largely increase, so that the temperature difference with the detection temperature Tex1 of the thermistor 81*a* is not small. For that reason, there is a small liability that the surface temperature of the fixing roller 40 becomes a high temperature exceeding the allowable upper-limit temperature, so that there is no need to carry out control of decreasing the external heating downstream temperature in order to decrease the surface temperature of the fixing roller 40, i.e., control of decreasing the turning-on duty of the halogen heater 80*d*.

The controller 50 discriminates whether or not a print end signal is received (S33), and, in the case when the print end signal is not received (NO of S33), the process is returned to the process of the above-described S31. In the case when the print end signal is received (YES of S33), a post-rotation operation is performed (S34), and the process is ended. In the post-rotation operation in this embodiment, the controller 50 executes the process S15 to S17 of FIG. 5 as already been described above.

On the other hand, in the case when the temperature difference (Tex1−Tex2) is not more than the second predetermined value, i.e., not more than predetermined temperature difference Tdown (YES of S31), the controller 50 decreases the turning-on duty of the halogen heater 80*d* of those of the halogen heaters 80*c* and 80*d* (S35). For example, the controller 50 decreases the turning-on duty, which was 40%, down to 0%. In the case when the turning-on duty is 0%, the halogen heater 80*d* is not turned on. That is, in this case, the temperature of the detection temperature Tex2 of the thermistor 81*b* largely increases, so that the temperature difference with the detection temperature Tex1 of the thermistor 81*a* becomes small. For that reason, there is a liability that the surface temperature of the fixing roller 40 becomes a high temperature exceeding the allowable upper-limit temperature. Therefore, in order to decrease the surface temperature of the fixing roller 40, control of decreasing the external heating downstream temperature, i.e., control of decreasing the turning-on duty of the halogen heater 80*d* is effected.

The controller 50 discriminates whether or not the temperature difference (Tex1−Tex2) is greater than the predetermined temperature difference Tdown after the process of S35 (S36). In the case when the temperature difference (Tex1−Tex2) is not more than the predetermined temperature difference Tdown (NO of S36), the controller 50 continues the image formation without returning the turning-on duty of the halogen heater 80*d* from 0%, after the change, to the original value (S37). That is, in a period in which the temperature difference (Tex1−Tex2) is not more than the predetermined temperature difference Tdown, there is a liability that the surface temperature of the fixing roller 40 becomes a high temperature, exceeding the allowable upper-limit temperature, and, therefore, there is a need to subsequently decrease the external heating downstream temperature. For that reason, the halogen heater 80*d* is energized in accordance with the decreased turning-on duty after the change.

The controller 50 discriminates whether or not a print end signal is received (S38), and, in the case when the print end signal is not received (NO of S38), the process is returned to the process of the above-described S36. In the case when the print end signal is received (YES of S38), a post-rotation operation is performed (S34), and the process is ended. In the post-rotation operation in this embodiment, the controller 50 executes the process S15 to S17 of FIG. 5 as described above.

In the above-described process of S36, in the case when the temperature difference (Tex1−Tex2) is greater than the predetermined temperature difference Tdown (YES of S36), the controller 50 returns the turning-on duty of the halogen heater 80*d* to the turning-on duty before the change, i.e., the original value (S39). For example, the controller 50 increases the turning-on duty, which was 0%, to 40%. That is, control of decreasing the turning-on duty of the halogen heater 80*d* (see S35), and, therefore, the external heating downstream temperature decreases, so that the surface temperature of the fixing roller 40 becomes a temperature that is below the allowable upper-limit temperature. However, when the surface temperature of the fixing roller 40 is further decreased, there is a liability that the surface temperature becomes a low temperature that is below the fixable temperature. Therefore, the turning-on duty of the halogen heater 80*d* is increased and returned to the original value, whereby a further decrease in surface temperature of the fixing roller 40 is suppressed. After the process of S39, the process is returned to the above-described process of S31, and the controller 50 repeats the processes of S31 to S39.

As described above, also in the Third Embodiment, during image formation, the halogen heater 80*d* in the downstream side with respect to the rotational direction of the fixing roller 40 is ON-OFF controlled, on the basis of the detection temperature of the thermistor 81*a* in the upstream side with respect to the rotational direction of the fixing roller 40, simultaneously with the halogen heater 80*c*. Then, on the basis of a difference in detection temperature between the two thermistors 81*a* and 81*b*, control of decreasing the turning-on duty of the halogen heater 80*d* is carried out in the case when the heat quantity supplied from the external heating belt 80*e* to the fixing roller 40 is excessive. By this, the feeding interval of the recording material P is longer than the predetermined time, and even when the number of sheets of the recording materials P fed to the fixing nip N1 per unit time is decreased, it is possible to carry out optimum heat supply from the external heating unit 80 to the fixing roller 40. For that reason, the image formation is not effected while making the surface temperature of the fixing roller 40 higher than a necessary target temperature. Accordingly, the image defect with the generation of the hot offset is not readily generated.

[Incidentally, in the Third Embodiment, in the case when the temperature difference (Tex1−Tex2) is not more than the predetermined temperature difference Tdown, the turning-on duty of only the halogen heater 80*d* is changed (see S35), but the present invention is not limited thereto, and the turning-on duty of both of the halogen heaters 80*c* and 80*d* may also be changed. In that case, in the above-described process of S36, when the temperature difference (Tex1−Tex2) is not more than the predetermined temperature difference Tup, the turning-on duty of the both of the halogen heaters 80*c* and 80*d* is returned to the turning-on duty before the change (S39).

Incidentally, in the above-described First to Third Embodiments, as regards the halogen heaters 80*c* and 80*d*, those having the same normal rated power were used, but the halogen heaters are not limited thereto, and heaters different in normal rated power may also be used. In that case, as the halogen heater 80*d*, a heater having a normal rated power lower than that of the halogen heater 80*c* is used. This is because, when the normal rated power of the halogen heater 80*d* is greater than that of the halogen heater 80*c*, it becomes difficult to suppress the overshooting of the surface temperature of the external heating belt 80*e* after the image formation. That is, when the normal rated power of the halogen heater 80*d* is large, an output of the halogen heater 80*d* becomes large, although also the halogen heater 80*d* is subjected to the ON-OFF control on the basis of the temperature detected by the thermistor 81*a*. Then, the surface temperature of the external heating belt 80*e* can overshoot after the image formation. In order to avoid this, the halogen heater 80*d* having the normal rated power, which is not more than the normal rated power of the halogen heater 80*c*, is used. Further, each of the halogen heaters 40*a*, 41*a*, 80*c*, and 80*d* may be a single heater having a specific light distribution, but is not limited thereto, and may also include a plurality of heaters having different light distributions.

Incidentally, in the above-described First to Third Embodiments, the fixing roller 40 provided with the halogen heater 40*a* therein was employed, but a constitution in which the fixing roller 40 is not provided with a heater and in which the fixing roller 40 is heated only by the external heating unit 80 may also be employed. Further, in the above-described embodiments, the pressing roller 41 provided with the halogen heater 41*a* therein was employed, but a constitution in which the pressing roller 41 is not provided with a heater may also be employed. Further, the pressing roller 41 provided with the elastic layer on the core metal was employed, but is not limited thereto, and may also be in other forms, such as a pressing belt, and a pressing roller and a pressing belt that have an elastic layer.

Incidentally, in the above-described First to Third Embodiments, as the heating means, the halogen heater was employed. However, as the heating means, other heating means, other than the halogen heater, such as a heating means of an electromagnetic induction heating type and a planar heat generating member may also be used. Further, in the above-described First to Third Embodiments, to each of the halogen heaters, electrical power equal to associated normal rated power is supplied. However, even in the case when electrical power less than the normal rated power is supplied, it is only required that values of maximum electrical power supplied to the halogen heaters 80*c* and 80*d* are made the same, and the turning-on duty is changed as desired.

Fourth Embodiment

[Image Forming Apparatus]

An image forming apparatus to which a fixing device according to Fourth Embodiment is applicable will be described using FIG. 1. An image forming apparatus 100 shown in FIG. 1 is an intermediary transfer type full-color printer of a tandem type in which image forming portions Pa, Pb, Pc, and Pd for yellow, magenta, cyan, and black are arranged along an intermediary transfer belt 20.

First, a feeding process of a recording material in this image forming apparatus 100 will be described. The recording material P is accommodated in the form of being stacked in a recording material accommodating container (sheet feeding cassette) 10, and is fed by a feeding roller 13 by being timed to image forming timing. In sheet feeding from the recording material accommodating container 10, for example, a friction separation type, or the like, is used. The recording material P fed by the feeding roller 13 is fed to registration rollers 12 provided at a halfway portion of a feeding path 114. Further, the recording material P is sent to a secondary transfer portion T2 after oblique movement correction and timing correction of the recording material P are carried out in the registration roller 12. The secondary transfer nip T2 is a transfer nip formed by opposing inner secondary transfer roller 21 and outer secondary transfer roller 11, and the toner image is attracted onto the recording material by applying a predetermined pressing force and a predetermined electrostatic load bias.

Relative to the above-described feeding process of the recording material P to the secondary transfer portion T2, a forming process of the image sent to the secondary transfer portion T2 at a similar timing will be described. First, the image forming portions are described, but the image forming portions Pa, Pb, Pc, and Pd for the respective colors are substantially similarly constituted except that colors of the toners are yellow, magenta, cyan, and black, which are different from each other. Therefore, in the following, as a representative, the image forming portion Pb for black is described, and as regards other image forming portions Pa, Pb, and Pc, the suffix d of symbols in the description is to be described by being read as a, b, and c.

The image forming portion Pd is principally constituted by a developing device 1*d*, a charging device 2*d*, a photosensitive drum 3*d*, a photosensitive drum cleaner 4*d*, and an exposure device 5*d*, and the like. In the figure, a surface of the photosensitive drum 3*d* rotationally driven in R1 direction is electrically charged uniformly in advance by the charging device 2*d*, and, thereafter, an electrostatic latent image is formed by the exposure device 5*d* driven on the basis of a signal of image information. Then, the electrostatic latent image formed on the photosensitive drum 3*d* is subjected to toner development by the developing device 1*d* and is visualized. Thereafter, a predetermined pressing force and a predetermined electrostatic load bias are applied by a primary transfer roller 6*d* provided opposed to the image forming portion Pd by sandwiching the intermediary transfer belt 20 therebetween, so that the toner image formed on the photosensitive drum 3*d* is primary-transferred onto the intermediary transfer belt 20. Primary transfer residual toner remaining on the photosensitive drum 3*d* in a slight amount is collected by the photosensitive drum cleaner 4*d* and is prepared for a subsequent image forming process. As regards the image forming portion Pd described above, in the case of a structure shown in FIG. 1, four sets for yellow, magenta, cyan, and black exist. However, the number of the colors is not limited to four (colors), and also, an arrangement order of the colors is not limited thereto. The developing device 1*d* uses, as a developer, a two-component developer in which the toner and a magnetic carrier are mixed, for example.

The intermediary transfer belt 20 will be described. The intermediary transfer belt 20 is an endless belt, which is stretched by the inner secondary transfer roller 21, a tension roller 22 and a stretching roller 23, and which is fed and driven in an arrow R2 direction in the figure. Here, the inner secondary transfer roller 21 also functions as a driving roller for driving the intermediary transfer belt 20. Image forming processes for the respective colors to be processed in parallel by the image forming portions P are carried out at a timing when the toner images are successively superposed on the toner image(s) for the upstream(-side) color(s) primary-transferred on the intermediary transfer belt 20. As a result, finally, a full-color toner image is formed on the intermediary transfer belt 20 and is fed to the secondary transfer portion T2. Incidentally, secondary transfer residual toner after passed through the secondary transfer portion T2 is collected by a transfer cleaner device 30.

As described above, by the feeding process and the image forming process, which are described, respectively, timing of the recording material P and timing of the full-color toner image coincide with each other, so that secondary transfer is carried out. Thereafter, the recording material P is fed to a fixing device 9 (image heating apparatus), and predetermined pressure and predetermined heat quantity are applied to the recording material P, so that the toner image is melt-fixed on the recording material. Thus, the recording material P, on which the image is fixed, is subjected to selection by discharging rollers 14 such that the recording material P is discharged onto a sheet discharge tray 120 or subjected to double-side image formation.

In the case when the double-side image formation is required, by a switching member 110 (called a flapper, or the like), the feeding path is switched from a path leading to the sheet discharge tray 120 to a double-side feeding path 111, so that the recording material P fed by the sheet discharging rollers 14 is fed to the double-side feeding path 111. Thereafter, in synchronism with timing of a recording material P, in a subsequent job, fed from the feeding roller 13, leading and trailing ends of the recording material P (fed along the feeding path 112) are replaced with each other, and sent again to the feeding path 114 via a double-side path 113. As regards subsequent feeding and image forming process on the back surface, they are similar to those described above, and, therefore, a description will be omitted.

Further, the image forming apparatus 100 includes an operating portion S and a controller 50. The operating portion S includes a display portion (not shown) of displaying various pieces of information, operating keys (not shown) through which user input is received, and the like. A user is capable of providing a start instruction of an image forming job by using the operation keys of the operating portion S or selectively inputting image quality setting of the image and the various species of information (for example, a type, a basis weight, and the like, of paper) of the recording material P set in the recording material accommodating container 10, from pieces of information displayed at the display portion. The controller 50 determines an image forming condition in accordance with inputted information, and controls respective portions of the image forming apparatus 100 in order to effect the image formation under the image forming condition. The controller 50 carries out control of the fixing device 9 during execution of the image forming job, so that the recording material P is heated at a predetermined temperature and the toner image is heat-fixed. As regards the control of such a fixing device 9, description is made later, and, therefore, a detailed description will be omitted here.

[Fixing Device]

Next, a structure of the fixing device 9 will be described using FIG. 2. As shown in FIG. 2, the fixing device 9 includes a fixing roller 40 as a first rotatable member and a pressing roller 41 as a second rotatable member. The fixing roller 40 and the pressing roller 41 are rotatably shaft-supported by a housing (not shown) of the fixing device 9 via ball bearings (not shown), or the like. The fixing roller 40 and the pressing roller 41 are omitted from illustration in the figure, but gears fixed to one shaft ends thereof are connected with each other via a gear mechanism, and are integrally rotationally driven by a driving source (not shown), such as a motor, via the gear mechanism.

The fixing roller 40 is formed by superposing a heat-resistant elastic layer 40*c* and a heat-resistant parting layer 40*d*, from an inner diameter side in the order named, on a metal-made core metal 40*b* formed in a cylindrical shape. For example, the core metal 40*b* of the fixing roller 40 is made of aluminum of 77 mm in outer diameter, 6 mm in thickness, and 350 mm in length. The elastic layer 40*c* is formed with a 3 mm-thick HTV (high-temperature vulcanization type) silicone rubber, and coats an outer peripheral surface of the core metal 40*b*. The parting layer 40*d* is formed with a 50 μm-thick fluorine-containing resin material (for example, a PFA tube) in order to improve a parting property and coats a surface of the elastic layer 40*c*.

At an inner portion of the core metal 40*b* of the fixing roller 40, a halogen heater 40*a* of, e.g., 1200 W in normal rated power, which is subjected to output control by energization and, which thus generates heat is provided non-rotatably almost over an entirety of the fixing roller 40 with respect to a widthwise direction (longitudinal direction, axial direction). The halogen heater 40*a* heats the fixing roller 40 from an inside of the fixing roller 40 so that a surface temperature of the fixing roller 40 is a predetermined target temperature. The surface temperature of the fixing roller 40 is detected by a thermistor 42*a*. Then, on the basis of this detection temperature, the halogen heater 40*a* is subjected to ON (energization) or OFF (non-energization) control by the controller 50 (see FIG. 1), so that the surface temperature of the fixing roller 40 is adjusted to the predetermined target temperature.

The pressing roller 41 is formed by superposing a heat-resistant elastic layer 41*c* and a heat-resistant parting layer 41*d*, from an inner diameter side in the order named, on a metal-made core metal 41*b* formed in a cylindrical shape. For example, the core metal 41*b* of the pressing roller 41 is made of aluminum of 59 mm in outer diameter, 5 mm in thickness, and 350 mm in length. The elastic layer 41*c* is formed with a 1 mm-thick HTV silicone rubber, and coats an outer peripheral surface of the core metal 41*b*. The parting layer 41*d* is formed with a 50 μm-thick fluorine-containing resin material (for example, a PFA tube) and coats a surface of the elastic layer 41*c*.

At an inner portion of the core metal 41*b* of the pressing roller 41, a halogen heater 41*a* of, e.g., 400 W in normal rated power, which generates heat by energization is provided non-rotatably almost over an entirety of the pressing roller 41 with respect to a widthwise direction (longitudinal direction, axial direction). The halogen heater 41*a* heats the pressing roller 41 from an inside of the pressing roller 41 so that a surface temperature of the pressing roller 41 is a predetermined target temperature. The surface temperature of the pressing roller 41 is detected by a thermistor 42*b*. Then, on the basis of this detection temperature, the halogen heater 41*a* is subjected to the ON-OFF control by the controller 50 (see FIG. 1), so that the surface temperature of the pressing roller 41 is adjusted to a certain temperature of 100° C., for example.

The above-described pressing roller 41 is press-contacted to the fixing roller 40 with a predetermined pressure, such as pressure of 784 N (about 80 kgf), and forms a fixing nip N1 in cooperation with the fixing roller 40. The recording material P is heated and pressed by being nipped and fed at the fixing nip N1. For that reason, the fixing roller 40 is rotated in an arrow R3 direction in the figure, and the pressing roller 41 is rotated in an arrow R4 direction in the figure, so that the fixing roller 40 and the pressing roller 41 are rotated in the same direction at the fixing nip N2. Further, the pressing roller 41 is movable between a contact (mounted) state in which the pressing roller 41 is press-contacted to the fixing roller 40 and a spaced (demounted) state in which the predetermined roller 41 is spaced from the fixing roller 40, by an unshown a pressing mounting and demounting (contacting and spacing) mechanism. The (contact)/(spaced) state of the pressing roller 41 is discriminated by the controller 50.

[Cleaning Unit]

Further, the fixing device 9 includes a cleaning unit 60 as a cleaning member for the fixing roller 40. The cleaning unit 60 includes a cleaning web 61, which is a nonwoven fabric, a collecting roller 62 and a web roller 63. The collecting roller 62 is a stainless steel-made cylindrical member formed of 20 mm in diameter, for example. The collecting roller 62 is provided rotatably in a state in which the collecting roller 62 is contacted to the fixing roller 40 over almost an entirety of the fixing roller 40 with respect to the widthwise direction (longitudinal direction, the axial direction), and collects the toner deposited on the fixing roller 40 without being fixed on the recording material P. The collecting roller 62 is always contacted to the fixing roller 40 and is rotated by the fixing roller 40.

The web roller 63 supports the cleaning web 61 and presses (urges) the supported cleaning web 61 against the collecting roller 62 with a force of, e.g., about 40 N. The cleaning web 61 is pressed against the collecting roller 62, and thus, wipes off the toner, on the cleaning roller 62, collected from the fixing roller 40. The cleaning web 61 is wound up in one direction (arrow X direction in the figure), and, therefore, a fresh surface, of the cleaning web 61, where the toner is not wiped off, is always supplied to a contact surface with the collecting roller 62. The web roller 63 is movable between a contact state in which the web roller 63 is press-contacted to the collecting roller 62 and a spaced state in which the web roller 63 is spaced from the collecting roller 62, by an unshown web mounting and demounting (contacting and spacing) mechanism. Incidentally, the collecting roller 62 is press-contacted to the fixing roller 40 with a force (urging) of about 10 N in the spaced state of the web roller 63 and with a force of about 50 N, obtained by adding about 40 N of the web mounting and demounting mechanism to the force of about 10 N, in the contact state of the web roller 63. The mounting/demounting state of the web roller 63 is discriminated by the controller 50.

[Externally Heating Unit]

In the image forming apparatus, even the recording material, such as temperature difference, having a large basis weight (weight per unit area) is required to provide high productivity (the number of printed sheets per unit time). In order to enhance the productivity for the recording material having the large basis weight, there is a need to increase a speed of a heating process in the fixing device 9. However, the recording material having the large basis weight takes heat in a large amount, and, therefore, a heat quantity required for fixing becomes large compared with a recording material having a small basis weight. Therefore, as shown in FIG. 2, the fixing device 9 includes an external heating unit 80 as an external heating device, and heats the fixing roller 40 from an outside of the fixing roller 40 by the external heating unit 80, as desired. More specifically, in the case when much heat is transferred from the fixing roller 40 to the recording material P, the external heating unit 80 is provided for quickly replenishing the heat quantity corresponding to an amount of heat delayed in supply by the halogen heater 41*a* in the pressing roller 41. The external heating unit 80 (specifically, an external heating belt 80*e* heats the fixing roller 40 by contacting the fixing roller 40).

The external heating unit 80 includes the external heating belt 80*e*, an external heating roller 80*a* as a first roller for stretching the external heating belt 80*e*, an external heating roller 80*b* as a second roller, and halogen heaters 80*c* and 80*d* as an external heating means. The external heating belt 80*e* as a belt member is a belt formed by coating a heat-resistant sliding layer formed of a fluorine-containing resin material (e.g., a PFA tube) on a metal-made base material of stainless steel, or the like, formed in an endless belt shape, for example. The external heating belts 80*a* and 80*b* are formed, similarly as the fixing roller 40 and the pressing roller 41, by coating a heat-resistant sliding layer formed of a fluorine-containing resin material (e.g., a PFA tube) on a metal-made core metal of aluminum, or the like, formed in a cylindrical shape, for example.

The external heating unit 80 is movable between a contact state in which the external heating unit 80 is press-contacted to the fixing roller 40 by the external heating belt 80*e* and a spaced state in which the external heating belt 80*e* is spaced from the fixing roller 40, by a belt mounting and demounting (contacting and spacing) mechanism (see FIG. 4 described later). The contact/spaced state of the external heating unit 80 is discriminated by the controller 50.

In the case when the external heating unit 80 is in the mounted state, the external heating rollers 80*a* and 80*b* are press-contacted to the external heating belt 80*e* toward the fixing roller 40 with a predetermined pressure. Then, the external heating belt 80*e* contacts the surface of the fixing roller 40, and forms an external heating contact portion N2. That is, the external heating belt 80*e* forms a broad external heating contact portion N2 in cooperation with the fixing roller 40 and is provided for increasing the heat quantity supplied to the fixing roller 40.

The external heating belt 80*e* and the external heating rollers 80*a* and 80*b* are rotated by the fixing roller 40 (arrow R5 direction in the figure). These external heating rollers 80*a* and 80*b* are disposed so as to sandwich the external heating contact portion N2 therebetween with respect to a rotational direction of the external heating belt 80*e*. Further, the external heating rollers 80*a* and 80*b* are disposed so that the external heating roller 80*a* of these rollers is adjacent to an upstream portion of the external heating contact portion N2 and so that the external heating roller 80*b* of these rollers is adjacent to a downstream portion of the external heating contact portion N2, respectively. That is, the external heating belt 80*a* is disposed, with respect to the rotational direction (arrow R3 direction in the figure) of the fixing roller 40, in a side upstream of the external heating roller 80*b* and upstream of the external heating contact portion N2.

Inside the external heating roller 80*a*, a halogen heater 80*c*, of, e.g., 1500 W in normal rated power, generating heat by energization is fixedly provided as a first heating means over almost an entirety of the external heating roller 80*a*. Inside the external heating roller 80*b*, a halogen heater 80*d*, of, e.g., 1500 W in normal rated power, generating heat by energization is fixedly provided as a second heating means over almost an entirety of the external heating roller 80*b*. In this embodiment, to the respective halogen heaters 80*c* and 80*d*, electrical power, which is the same as the normal rated power, is supplied. Incidentally, the above-described widthwise direction is also longitudinal directions and rotational axis directions of the external heating rollers 80*a* and 80*b*.

Further, the external heating unit 80 includes a thermistor 81*a* as a first temperature detecting means and a thermistor 81*b* as a second temperature detecting means. The thermistor 81*a* is provided at a position where the thermistor 81*a* contacts the external heating roller 80*a* at a portion, of an outer peripheral surface of the external heating belt 80*e* in an upstream side with respect to the rotational direction of the fixing roller 40, and detects a temperature of the external heating belt 80*e* in a region in which the external heating roller 80*a* contacts the external heating belt 80*e*. The thermistor 81*b* is provided at a position where the thermistor 81*b* contacts the external heating roller 80*b* at a portion, of an outer peripheral surface of the external heating belt 80*e* in a downstream side with respect to the rotational direction of the fixing roller 40, and detects a temperature of the external heating belt 80*e* in a region in which the external heating roller 80*b* contacts the external heating belt 80*e*.

[Controller]

The controller 50 (see FIG. 1) subjects the halogen heaters 80*a* and 80*b* to ON-OFF control on the basis of temperatures detected by the thermistors 81*a* and 81*b* in order to adjust a surface temperature of the external heating belt 80*e*, and by extension to a surface temperature of the fixing roller 40. However, the controller 50 subjects, during preparation of the image formation, the halogen heater 80*c* to the ON-OFF control on the basis of the temperature detected by the thermistor 81*a* and the halogen heater 80*d* to the ON-OFF control on the basis of the temperature detected by the thermistor 81*b*, respectively. Further, the controller 50 subjects, during image formation, both of the halogen heaters 80*c* and 80*d* to the ON-OFF control on the basis of the temperature detected by the thermistor 81*a*.

Here, during image formation is a period from a start of image formation based on a print signal for forming the image on the recording material P to completion of an image forming operation. Specifically, during image formation refers to a period from during pre-rotation after receipt of the print signal (input of an image forming job) to post-rotation (operation after the image formation), and is a period including an image forming period and a sheet interval (during non-image formation). During preparation of the image formation is a state in which a power source of the image forming apparatus 100 is turned on, but the image forming job is not executed. As described above, during image formation is a series of operations including from a pre-rotation operation, the image forming period, the sheet interval and the post-rotation, and, therefore, during preparation of the image formation refers to a period in which this series of operations is not executed in a state in which the electrical power of the image forming apparatus 100 is turned on. Further, during preparation of the image formation includes during stand-by (stand-by state), and during stand-by (or stand-by state) is a state in which after the power source of the image forming apparatus 100 is turned on or after the image formation, the image forming apparatus 100 waits for receipt of the print signal in a state in which the series of operations during image formation described above is capable of being performed.

The controller 50 subjects the halogen heaters 80*c* and 80*d* to the ON-OFF control, and adjusts the surface temperature of the external heating belt 80*e*, and, by extension, to the surface temperature of the fixing roller 40, to a predetermined target temperature. In Table 1, target temperatures (represented as setting temperatures in the table) of the fixing roller 40 and the external heating belt 80*e*, which are used during stand-by and during image formation, are shown, respectively. The controller 50 subjects, as described above, the halogen heaters 40*a* and 41*a* and the halogen heaters 80*c* and 80*d* to the ON-OFF control, and adjusts the surface temperature of the external heating belt 80*e*, and, by extension, to the surface temperature of the fixing roller 40, to the target temperatures shown in Table 1. As shown in Table 1, the target temperatures of the fixing roller 40 and the external heating belt 80*e* are determined depending on the basis weight of the recording material P.

TABLE 5

| | Recording material basis weight (g/m$^2$) | | | | | |
|---|---|---|---|---|---|---|
| | 60-79 | 80-99 | 100-149 | 150-199 | 200-249 | 250-350 |
| FRST*1 TDSB*2 | | | | 165 (° C.) | | |
| FRST*1 TDIF*3 | | | | 170 (° C.) | | |
| EHBST*4 TDSB+2 | | | | 190 (° C.) | | |

TABLE 5-continued

| | Recording material basis weight (g/m$^2$) | | | | | |
|---|---|---|---|---|---|---|
| | 60-79 | 80-99 | 100-149 | 150-199 | 200-249 | 250-350 |
| EHBST*4 | | | 210 (° C.) | | | 215 |
| TDIF*3 | | | | | | |

*1"FRST" is the fixing roller setting temperature.
*2"TDSB" is the temperature during stand-by.
*3"TDIF" is the temperature during image formation.
*4"EHBST" is the external heating belt setting temperature.

Next, the control of the fixing device 9 will be described. First, FIG. 3 shows a block diagram of a control system of the fixing device 9. The controller 50 is a computer, such as a CPU, for controlling respective portions of the fixing device 9, and includes a memory 51 as shown in FIG. 3. The memory 51 is a ROM, a RAM or the like, and stores various programs, data, and the like, for controlling the image forming apparatus 100. Further, the memory 51 can also temporarily store a calculation process (computation) result with execution of the program. The controller 50 is connected with the operating portion S (see FIG. 1) via an unshown interface, and receives execution start operations of the various programs such as the image forming job by a user or various data inputs by the user, or the like. The controller 50 controls, depending on the execution of the image forming job, the respective portions connected thereto via unshown interfaces and described later, and thus operates the fixing device 9.

To the controller 50, the belt mounting and demounting mechanism 57 is connected. The belt mounting and demounting mechanism 57 moves the external heating unit 80 so as to be movable toward and away from the fixing roller 40. By this, the fixing device 9 is in a state that is either of a contact state in which the fixing roller 40 and the external heating belt 80*e* are press-contacted to each other or a spaced state in which the fixing roller 40 and the external heating belt 80*e* are spaced from each other.

The controller 50 individually controls a plurality of driving motors 54 via a motor controller 52 and a motor driver 53. The respective driving motors 54 rotationally drive the fixing roller 40 and the pressing roller 41 in predetermined directions at predetermined speeds, respectively, depending on control by the controller 50. Further, the controller 50 individually subjects the halogen heaters 40*a*, 41*a*, 80*c*, and 80*d* to the ON/OFF control via a heater controller 55 and a heater driver 56. As already described above, depending on control of the halogen heater 40*a*, the surface temperature of the fixing roller 4 is adjusted, and depending on control of the halogen heater 41*a*, the surface temperature of the pressing roller 41 is adjusted. Further, depending on the halogen heaters 80*c* and 80*d*, the surface temperature of the external heating belt 80*e* is adjusted.

To the controller 50, the thermistors 42*a*, 42*b*, 81*a*, and 81*b* are connected via unshown interfaces. The controller 50 acquires the surface temperature of the fixing roller 40 (hereafter, referred to as a fixing roller temperature, for convenience) from the thermistor 42*a* and acquires the surface temperature of the pressing roller 41 from the thermistor 42*b*. Further, the controller 50 acquires the surface temperature of the external heating belt 80*e* in an upstream side with respect to a fixing roller rotational direction (hereafter, referred to as an external heating upstream temperature, for convenience) from the thermistor 81*a*. Further, the controller 50 acquires the surface temperature of the external heating belt 80*e* in a downstream side with respect to the fixing roller rotational direction (hereafter, referred to as an external heating downstream temperature, for convenience) from the thermistor 81*b*. The controller 50 subjects the halogen heaters 40*a*, 41*a*, 80*c*, and 80*d* to the ON-OFF control on the basis of temperatures detected by the thermistor 42*a*, 42*b*, 81*a*, and 81*b*, and, thus, carries out control of adjusting the surface temperature of the fixing roller 40 to a predetermined target temperature.

Figure 13:
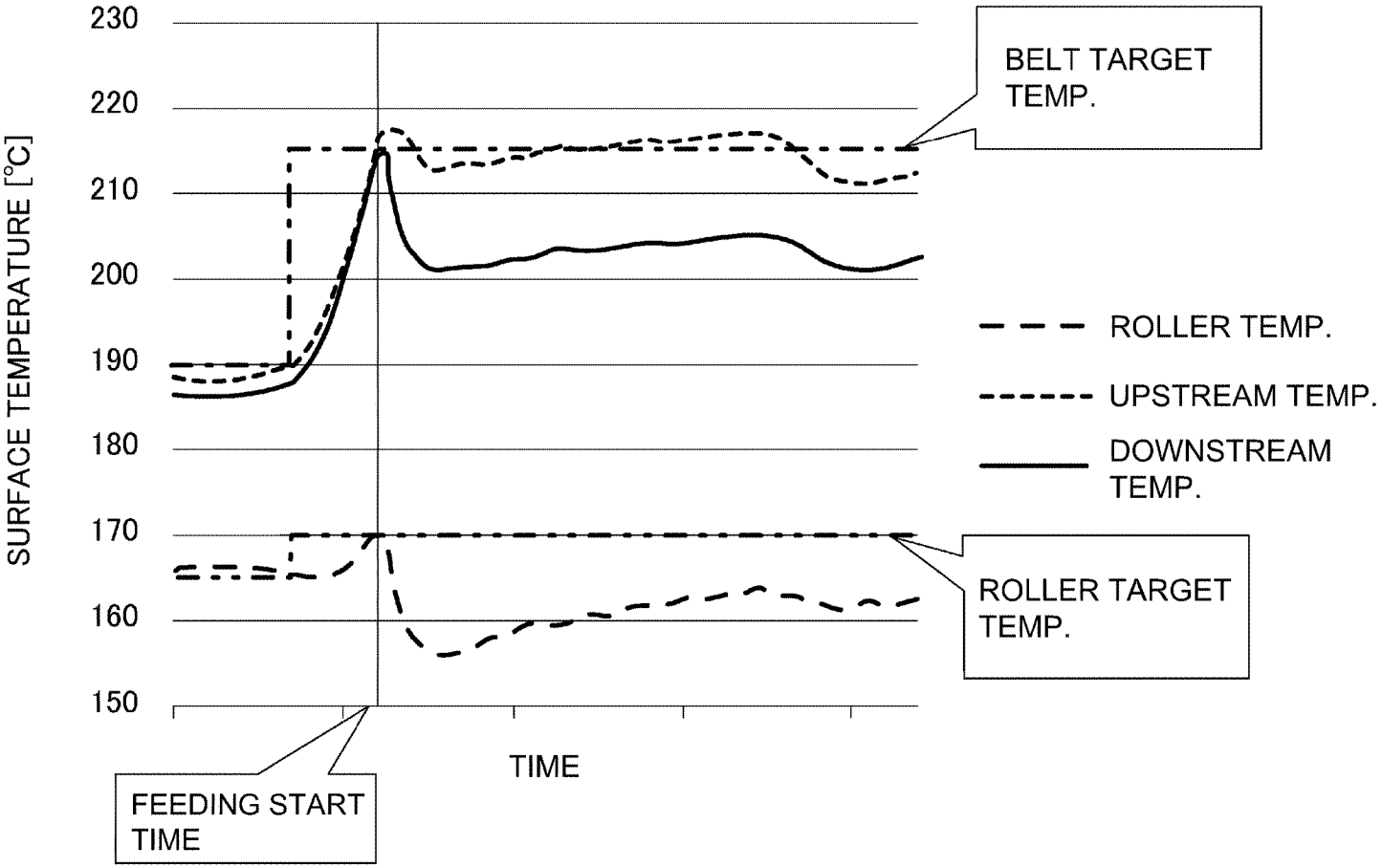
FIG. 13 is a graph showing time progressions of a fixing roller temperature, an external heating upstream temperature and an external heating downstream temperature in a comparison example.

Here, in FIG. 13, in the case when image formation is carried out on a large number of sheets of thick paper (basis weight: 250 g/m$^2$ as an example) by using a fixing device in a comparison example, time progressions of the fixing roller temperatures, the external heating upstream temperatures, and the external heating downstream temperatures detected by the thermistors 42*a*, 81*a*, and 81*b* are shown. In the fixing device in the comparison example, with regard to the external heating unit 80, the control of the halogen heater 80*c* is carried out on the basis of the temperature detected by the thermistor 81*a*, and the control of the halogen heater 80*d* is carried out on the basis of the temperature detected by the thermistor 81*b*. In FIG. 4, the ordinate represents the surface temperature, and the abscissa represents the time. In this case, a target temperature Trp of the fixing roller temperature used during image formation is 170° C., and a target temperature T ex1*p* (first target temperature) of the external heating upstream temperature and a target temperature ex2*p* (second target temperature) of the external heating downstream temperature, which are used during image formation, are 215° C. (see Table 1). Incidentally, a target temperature of the surface temperature of the pressing roller 41 is always 100° C.

As shown in FIG. 13, when the recording material P enters the fixing nip N1 for toner fixing (see feeding start time), heat transfers from the fixing roller 40 to the recording material P, so that the fixing roller temperature lowers. When the fixing roller temperature lowers, the heat is supplied from the external heating belt 80*e* to the fixing roller 40, and, therefore, also the external heating upstream temperature and the external heating downstream temperature lower. The external heating downstream temperature follows the lowering in fixing roller temperature, i.e., lowers simultaneously with entrance of the recording material P into the fixing nip N1. On the other hand, the external heating upstream temperature does not lower simultaneously with the entrance of the recording material P into the fixing nip N1 and lowers with a delay after the entrance of the recording material P into the fixing nip N1.

The thermistor 81*b* is disposed in a downstream side with respect to the rotational direction of the fixing roller 40 and detects the surface temperature (external heating downstream temperature) of the external heating belt 80*e* immediately after the heat supply to the fixing roller 40 is carried out, and, therefore, followability to the lowering of the surface temperature of the fixing roller 40 can be achieved. Accordingly, the external heating downstream temperature lowered simultaneously with the entrance of the recording material P into the fixing nip N1 is detected. On the other hand, the thermistor 81*a* is disposed in a upstream side with respect to the rotational direction of the fixing roller 40 and detects the surface temperature (external heating downstream temperature) of the external heating belt 80*e* temperature-recovered (restored) by the external heating rollers 80*a* and 80*b* after the heat supply to the fixing roller 40 is carried out. For that reason, followability to the lowering of the surface temperature of the fixing roller 40 is not good, so that supply of the electrical power to the halogen heater 81*d* is delayed. Accordingly, the external heating upstream temperature lowered with a delay after the entrance of the recording material P into the fixing nip N1 is detected.

When the supply of the electrical power to the halogen heater 81*d* in an external heating upstream side is delayed, the surface temperature of the fixing roller 40 can be lower than the fixable temperature. When the surface temperature of the fixing roller 40 becomes a low temperature that is below the fixable temperature, the phenomenon called the cold offset, such that the toner image is not fixed on the recording material P and the toner is deposited on the fixing roller 40, generates, and can become a cause of generation of the image defect. Further, when the toner deposited on the fixing roller 40 is deposited on a subsequent recording material P, image contamination generates. Further, in the case when the user continues image formation without noting the generation of the cold offset, the toner can be deposited on, in addition to the fixing roller 40, the cleaning unit 60 and the external heating belt 80*e*, and the like. In such a state, when the operation of the fixing device 9 is stopped, and the fixing device 9, specifically, the fixing roller 40, the cleaning unit 60, the external heating belt 80*e*, and the like, are cooled, the toners deposited thereon stick. When the toners stick to these members, when the fixing device 9 is operated again, there is a large liability that the fixing roller 40, the cleaning unit 60, the external heating belt 80*e*, and the like, are damaged.

Therefore, in the case when the surface temperature of the fixing roller 40 can abruptly lower, there is a need to improve followability to the lowering in the surface temperature of the fixing roller 40, and the surface temperature of the fixing roller 40 is quickly increased up to a temperature exceeding at least the fixable temperature.

Figure 14A:
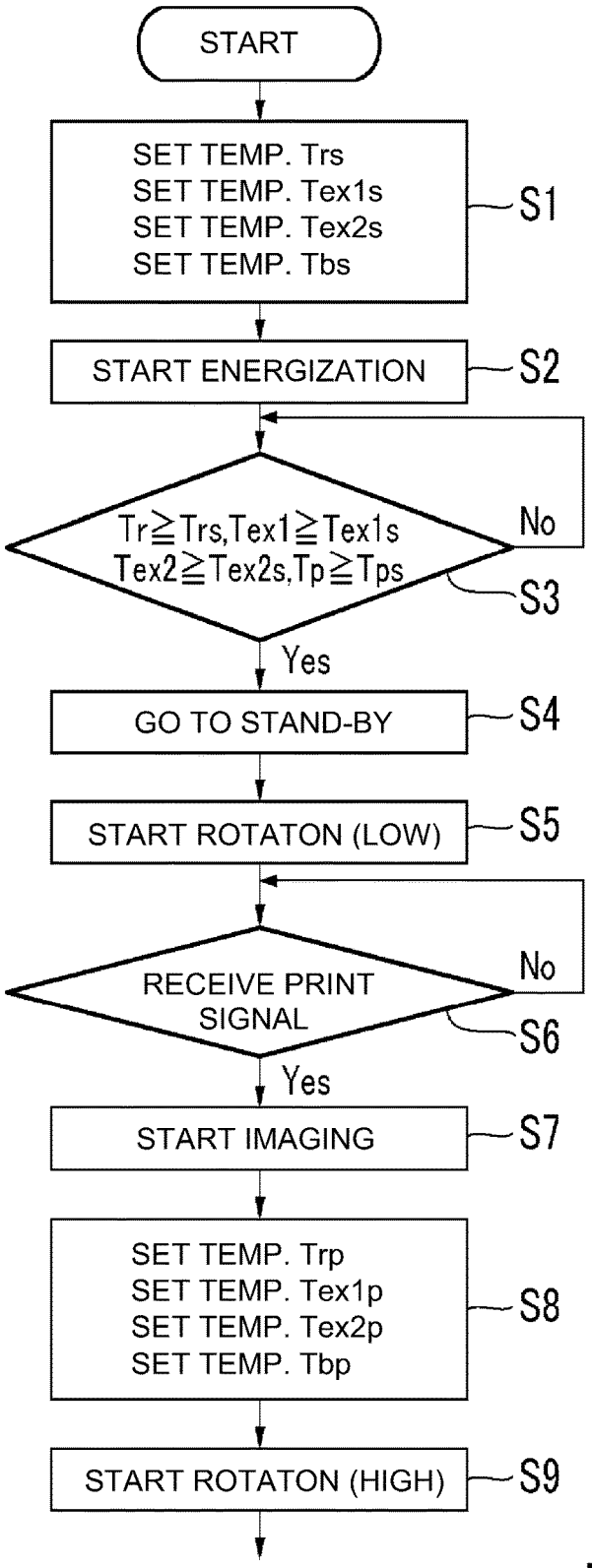
Figure 14B:
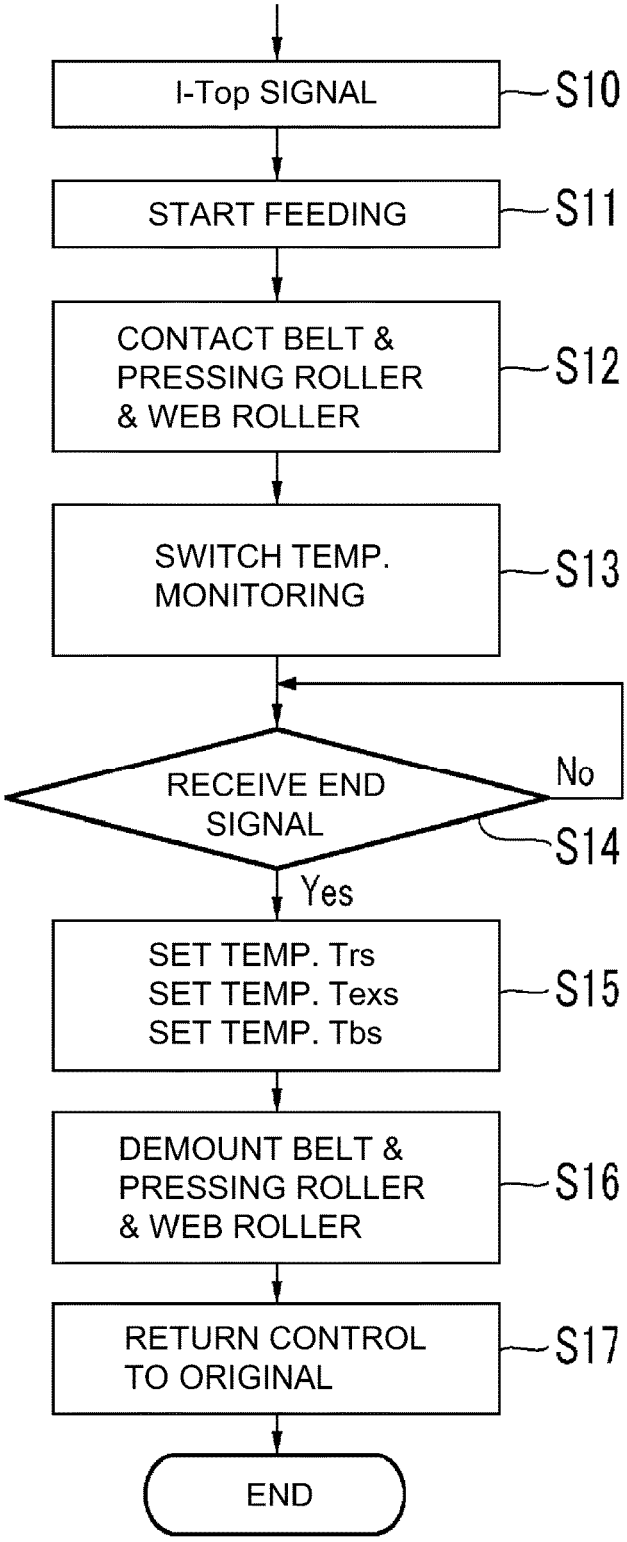

In the image forming apparatus 100, during image formation, both of the halogen heaters 80*c* and 80*d* were simultaneously subjected to the ON-OFF control on the basis of only the temperature detected by the thermistor 81*b*. In the following, a description will be made using FIGS. 14 and 15 while appropriately making reference to FIGS. 2 and 3. FIG. 14 (14A, 14B) is a flowchart showing control (mode) of the fixing device. This control of the fixing device is started in synchronism with the tuning-on of the power source of the apparatus main assembly by the controller 50, and is ended in synchronism with an end of the image forming job. Incidentally, here, the case when the user sets the thick paper of 250 g/m$^2$ in basis weight as the sheet type, and an image forming job for carrying out continuous image formation on a large number of sheets of the thick paper is taken as an example, will be described.

As shown in FIG. 5, the controller 50 sets a target temperature Trs of the fixing roller temperature, a target temperature Tex1*s* of the external heating upstream temperature, a target temperature Tex2*s* of the external heating downstream temperature and a target temperature Tbs, of the surface temperature of the pressing roller 41, which are to be used during stand-by (S1). From the above-described Table 1, the target temperature Trs of the fixing roller temperature used during stand-by is set at 165° C., and the target temperature Tex1*s* of the external heating upstream temperature and the target temperature Tex2*s* of the external heating downstream temperature that are used during stand-by are set at 190° C. Further, the target temperature Tbs of the surface temperature of the pressing roller 41 is set at 100° C.

The controller 50 starts energization to the respective halogen heaters 40*a*, 41*a*, 80*c*, and 80*d* of the fixing device 9 (S2). That is, the controller 50 carries out control for energizing (turning on) the halogen heaters 40*a*, 41*a*, 80*c*, and 80*d* via the heater controller 55 and the heater driver 56. The controller 50 discriminates, after the above-described energization, whether or not the surface temperature of the fixing roller 40, the external heating upstream temperature and the external heating downstream temperature of the external heating belt 80*e*, and the surface temperature of the pressing roller 41 reach the target temperatures Trs, Tex1*s*, Tex2*s*, and Tbs, respectively (S3). This discrimination is carried out on the basis of a comparison with temperatures detected by the respective thermistors 42*a*, 81*a*, 81*b* and 42. The controller 50 repeats the process of S3 until the above-described respective surface temperatures reach the target temperatures Trs, Tex1*s*, Tex2*s*, and Tbs, and stand by (NO of S3). That is, the controller 50 controls the energization to the halogen heater 80*c* so that the detection temperature by the thermistor 81*a* is the target temperature Tex1*s* (first target temperature). Further, the controller 50 controls the energization to the halogen heater 80*d* so that the detection temperature by the thermistor 81*b* is the target temperature Tex2*s* (second target temperature). Thus, during preparation of the image formation, pre-heating of the fixing roller 40 is carried out.

In the case when the above-described respective temperatures reach the target temperatures Trs, Tex1*s*, Tex2*s*, and Tbs, respectively (YES of S3), the controller 50 causes the fixing device 9 to go to the stand-by state (S4), and causes the fixing roller 40 to start rotation at a speed lower than a speed during image formation (S5). The controller 50 controls the driving motor 54 via the motor controller 52 and the motor driver 53, and causes the fixing roller 40 to rotate at a speed that is half of a predetermined speed (e.g., 500 mm/sec) during image formation, for example. Further, in the case when the fixing device 9 is in during stand-by (stand-by state), the controller 50 subjects the respective halogen heaters to the ON/OFF control so as to maintain the target temperatures Trs, Tex1*s*, Tex2*s*, and Tbs, and thus, effect temperature adjustment.

The controller 50 discriminates whether or not the print signal is received (S6). The controller 50 repeats the process of S6 until the print signal is received and stands by (NO of S6). In the case when the print signal is received (YES of S6), the controller 50 starts image formation (S7). Then, the controller 50 changes the respective target temperatures to a target temperature Trp of the fixing roller temperature, a target temperature Tex1*p* of the external heating upstream temperature, a target temperature Tex2*p* of the external heating downstream temperature and a target temperature Tbp of the surface temperature of the pressing roller 41, which are to be used during image formation (S8). From the above-described Table 1, the target temperature Trp of the fixing roller temperature used during image formation is changed to 170° C., and the target temperature Tex1*p* of the external heating upstream temperature and the target temperature Tex2*p* of the external heating downstream temperature, which are used during image formation, are changed to 215° C. Incidentally, the target temperature Tbp of the surface temperature of the pressing roller 41 is 100° C. as it is.

The controller 50 causes the fixing roller 40 to be rotationally driven so that the speed increases up to the predetermined speed (e.g., 500 mm/sec) during image formation (S9). Further, the controller 50 starts feeding of the recording material P, depending on receipt of an image writing signal (hereafter, referred to as an I-Top signal (S10), by using a receiving time of an I-Top signal as a reference time (S11). At this time, the feeding of the recording material P may be started irrespective of whether or not the fixing roller temperature, the external heating upstream temperature, the external heating downstream temperature, and the surface temperature of the pressing roller 41 reach the target temperatures changed in the above-described S8. This is for the following reason. That is, when the surface temperatures reach the target temperatures, the halogen heaters are turned off, and, thereafter, the recording material P reaches the fixing nip N1 in some instances. In that case, core metal temperatures of the respective rollers lower, and, therefore, particularly, when the recording materials P are continuously fed, the fixing roller temperature can be below a predetermined temperature necessary to fix the toner (image) on the recording material P, i.e., the target temperature. The above is because improper toner fixing on the recording material P due to such a temperature lowering of the fixing roller temperature is avoided.

When the sheet feeding is started, the controller 50 causes the external heating belt 80*e*, the pressing roller 41 and the web roller 63 to be pressed against and contacted to the fixing roller 40 on the basis of the receiving time of the I-Top signal before the recording material P reaches the fixing nip N1 (S12). That is, the external heating belt 80*e*, the pressing roller 41 and the web roller 63 are moved to a state in which the respective members are contacted to the fixing roller, i.e., a contact state by the belt mounting and demounting mechanism, the pressing mounting and demounting mechanism and the web mounting and demounting mechanism.

Then, the controller 50 changes the temperature control of the external heating belt 80*e* so as to be carried out on the basis of only the temperature detected by the thermistor 81*b* for detecting the external heating downstream temperature (S13). That is, when detection that the external heating belt 80*e* is in the contact state is made, the controller 50 switches, on the basis of the temperature detected by the thermistor 81*b*, both of the halogen heaters 80*c* and 80*d* simultaneously so as to be subjected to the ON-OFF control. More specifically, the halogen heater 80*c* in the upstream side with respect to the rotational direction of the fixing roller 40 is switched, on the basis of the detection temperature of the thermistor 81*b* in the downstream side with respect to the rotational direction of the fixing roller 40, simultaneously with the halogen heater 80*d* so as to be subjected to the ON-OFF control. In this case, the controller 50 controls the energization to the halogen heater 80*d* simultaneously with control of the energization to the halogen heater 80*c* so that the detection temperature by the thermistor 81*a* is the target temperature Tex1*s*. Incidentally, even in the case when the temperature control of the external heating belt 80*e* is switched to control based on only the thermistor 81*b* as described above, the controller 50 monitors, on the basis of the temperature detected by the thermistor 81*a*, whether or not there is abnormality in external heating downstream temperature. In the case when there is an abnormality in external heating upstream temperature, the controller 50 causes the display portion of the operating portion S to display an error, and notifies the user of the abnormality, for example.

The controller 50 discriminates whether or not an image formation end signal is received (S14). In the case when the image formation end signal is received (YES of S14), the controller 50 changes the respective target temperatures to the target temperatures Trs, Tex1*s*, Tex2*s*, and Tbs during stand-by (S15). Then, the controller 50 causes the external heating unit 80, the pressing roller 41 and the web roller 63 to be spaced from the fixing roller 40 and be placed in the spaced state, by the belt mounting and demounting mechanism, the pressing mounting and demounting mechanism and the web mounting and demounting mechanism (S16). That is, the controller 50 causes the fixing device 9 to go to the stand-by state. In the case of the stand-by state, these members are kept in the contact state, deformation and distortion of the elastic layers at the fixing nip N1 and the external heating contact portion N2 remain, so that lateral stripes, glossy stripes (uneven glossiness), and the like, generate and, thus, an image quality can lower. In order to avoid this, in the stand-by state, the external heating unit 80, the pressing roller 41 and the web roller 63 are spaced from the fixing roller 40.

When the controller 50 causes the fixing device 9 to go to the stand-by state, the controller 50 returns the temperature control of the external heating belt 80*e* only by the thermistor 81*b* changed in the above-described S13 to that before the change (S17). That is, when the controller 50 detects that the external heating belt 80*e* is in the spaced state, the controller 50 returns the temperature control of the external heating belt 80*e* to the original temperature control That is, the controller 50 returns the temperature control of the external heating belt 80*e* so that the temperature control is not effected on the basis of only the temperature detected by the thermistor 81*b* for detecting the external heating downstream temperature, but is effected on the basis of the temperatures detected by the thermistors 81*a* and 81*b*. Thus, in the case when the external heating belt 80*e* is in the spaced state, the control of the halogen heater 80*c* is carried out on the basis of the temperature detected by the thermistor 81*a* and the control of the halogen heater 80*d* is carried out on the basis of the temperature detected by the thermistor 81*b*.

Figure 15:
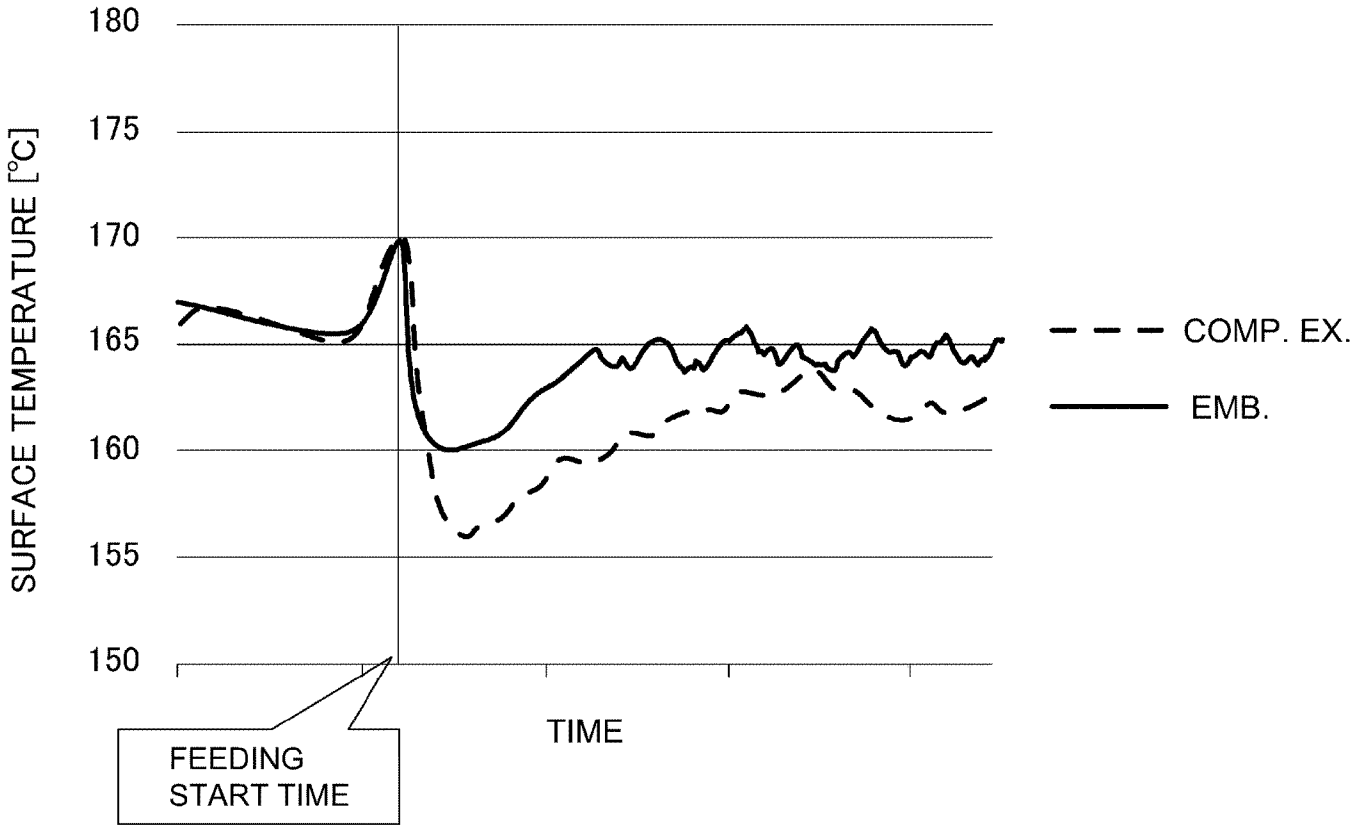
FIG. 15 is a graph showing a time progression of a fixing roller temperature in the Fourth Embodiment.

In FIG. 15, in the case when image formation is carried out on a large number of sheets of thick paper (basis weight: 250 g/m$^2$ as an example) by using a fixing device in this embodiment, a time progression of the fixing roller temperature detected by the thermistor 42*a*. However, for the purpose of easy understanding, also, a time progression of the fixing roller temperature detected by the thermistor 42*a* in the case when image formation is carried on a large number of sheets of thick paper (basis weight: 250 g/m$^2$ as an example) by using a fixing device in a comparison example is shown. In FIG. 15, the ordinate represents the surface temperature and the abscissa represents the time.

When the recording material P enters the fixing nip N1 for toner fixing (see, feeding start time), the heat transfers from the fixing roller 40 to the recording material P, so that the fixing roller temperature lowers. As can be understood from FIG. 15, in the fixing device 9 in this embodiment, the fixing roller temperature only lowers to about 160° C., but, in the fixing device 9 in the comparison example, the fixing roller temperature lowers to about 155° C. That is, it is understood that in the fixing device 9 in this embodiment, the lowering in surface temperature of the fixing roller can be suppressed.

As described above, during image formation, the halogen heater 80*c* in the upstream side with respect to the rotational direction of the fixing roller 40 is ON-OFF controlled, on the basis of the detection temperature of the thermistor 81*b* in the upstream side with respect to the rotational direction of the fixing roller 40, simultaneously with the halogen heater 80*d*. That is, during image formation, the ON-OFF control of the halogen heater 80*c* is not carried out on the basis of the surface temperature, lower than the belt surface temperature in the upstream side with respect to the rotational direction of the fixing roller 40, delayed in temperature lowering compared with the surface temperature in the downstream side with respect to the rotational direction of the fixing roller 40. By doing so, it is possible to quickly carry out the heat supply to the fixing roller 40 from the external heating belt 80*e*, particularly, from the halogen heater 80*c* in the upstream side with respect to the rotational direction of the fixing roller 40. For that reason, even in the case when the surface temperature of the fixing roller 40 can abruptly lower, the lowering in surface temperature of the fixing roller can be suppressed. By this, it is possible to lower a possibility that image defects, such as fixing non-uniformity, uneven glossiness, and color unevenness.

Fifth Embodiment

Incidentally, the user erroneously sets the recording material P with a basis weight greater than a set basis weight and executes the image forming job in some instances. For example, such a case that plain paper of 81 g/m$^2$ in basis weight and thick paper of 240 g/m$^2$ in basis weight exist in mixture although the plain paper of 81 g/m$^2$ in basis weight is set as the recording material P exists. In this case, the thick paper of 240 g/m$^2$ in basis weight is fed substantially to the plain paper of 81 g/m$^2$ in basis weight, and, therefore, image formation on the thick paper is carried out subsequently to the plain paper. When the recording material P changes from the plain paper to the thick paper, the quantity of the heat transferred from the fixing roller 40 to the recording material P increases. For that reason, supply of the heat from the external heating unit 80 to the fixing roller 40 cannot catch up with the transfer of the quantity of the heat, with the result that the image formation on the thick paper is carried out while the surface temperature of the fixing roller 40 is lower than the target temperature necessary for the fixing. In the following, this point will be described.

First, in Table 6, a lowest (point) temperature in the case when although the plain paper of 81 g/m$^2$ in basis weight is set as the recording material P, the recording material P with a basis weight of 81 g/m$^2$ or more is fed during image formation and the surface temperature of the fixing roller 40 is lowest is shown for each of basis weights of the recording materials P.

TABLE 6

| | Recording material basis weight (g/m$^2$) | | | | |
|---|---|---|---|---|---|
| | 81 | 100 | 150 | 200 | 240 |
| FRLT*1 | 167 | 165 | 160 | 155 | 150 |

*1"FRLT" is the fixing roller lowest temperature.

In the case when the plain paper of 81 g/m$^2$ in basis weight, which is the same as user setting, is fed, the respective halogen heaters 80*c* and 80*d* are individually controlled so that the external heating upstream temperature and the external heating downstream temperature detected by the thermistors 81*a* and 81*b* are 210° C. (see Table 1). However, with image formation on a large number of sheets of the recording material P, the external heating downstream temperature detected by the thermistor 81*b* gradually lowers and is maintained at 208° C., for example. This is due to supply of the heat from the external heating belt 80*e* to the fixing roller 40 at the external heating contact portion (nip). Further, with an increasing basis weight, heat transferred from the fixing roller 40 to the recording material P is larger, and, therefore, as shown in Table 2, with a greater basis weight of the fed recording material P than the basis weight set by the user, the external heating downstream temperature detected by the thermistor 81*b* becomes lower.

FIG. 7 is a graph showing a temperature difference (Tex1−Tex2) between a detection temperature Tex1 of the thermistor 81*a* and a detection temperature Tex2 of the thermistor 81*b* in the case when the thick paper of 240 g/m$^2$ in basis weight is fed subsequently to the plain paper of 81 g/m$^2$ in basis weight and the image formation is carried out. As shown in FIG. 7, when the recording material P with the basis weight of 81 g/m$^2$ is fed and the image formation is started, the temperature difference (Tex1−Tex2) gradually extends from a state of 0° C. and is maintained at 2° C. This fixing device generates with supply of the heat from the external heating belt 80*e* to the fixing roller 40 lowering in temperature by heat transfer to the recording material P, and, therefore, is unchanged and stabilized in the case when the recording materials P with the same basis weight are continuously fed. However, when the recording material P with the basis weight of 240 g/m$^2$ is fed, the fixing roller temperature further lowers, to that the heat supplied from the external heating belt 80*e* to the recording material P increases. Then, the temperature of the detection temperature Tex2 of the thermistor 81*b* lowers as compared with the case of the recording material P with the basis weight of 81 g/m$^2$, and, therefore, the temperature difference with the detection temperature Tex1 of the thermistor 81*a* extends to 10° C.

In Table 7, an upper-limit temperature (allowable upper-limit temperature) and a lower-limit temperature (fixable temperature) of the surface temperature, of the fixing roller 40, appropriate for the toner fixing on the recording material P are shown for each of basis weights of the recording materials P.

TABLE 7

| | Recording material basis weight (g/m$^2$) | | | | | |
|---|---|---|---|---|---|---|
| | 60-79 | 80-99 | 100-149 | 150-179 | 180-199 | 200-249 |
| AULT*1 (° C.) | 175 | 180 | 185 | 190 | 195 | 200 |
| FT*2 | 135 | 140 | 147 | 153 | 155 | 157 |

*1"AULT" is the allowable upper-limit temperature.
*2"FT"is the fixable temperature.

As described above, for example, when the recording material P with a large basis weight is fed in the case when the user setting is the basis weight of 81 g/m$^2$, the surface temperature of the fixing roller 40 is below the fixable temperature necessary for the toner fixing. That is, when the recording material P with the basis weight of 240 g/m$^2$ is fed in the case when the user setting is the basis weight of 81 g/m$^2$, the lowest temperature of the fixing roller 40 is 150° C. (see Table 2) and is below the fixable temperature of 157° C. (see Table 3) at the time of the recording material P with the basis weight of 240 g/m$^2$.

However, when the surface temperature of the fixing roller 40 is kept at a low temperature, which is below the fixable temperature, as described above, the toner image is not fixed, and a phenomenon that is called a cold offset, such that the toner is deposited on the fixing roller 40, generates can cause the image defect. Further, when the toners deposited on the fixing roller 40, the cleaning unit 60, the cleaning unit 60, the external heating belt 80*e*, and the like, stick, the toners can damage the fixing roller 40, the cleaning unit 60, the external heating belt 80*e*, and the like. Therefore, in the case such that the recording material P different in various pieces of information (for example, the basis weight) from the recording material P set by the user is fed during image formation, there is a need to increase the surface temperature of the fixing roller 40 up to a temperature exceeding at least the fixable temperature.

Therefore, in the following, a fixing device for solving the above-described problem will be described. However, a constitution and a control system of the fixing device 9 according to this embodiment are similar to those in the above-described Fourth Embodiment (see FIGS. 2 and 3), and, therefore, will be omitted from description.

Here, in Table 8, respective target temperatures (represented as setting temperatures in the table) of the fixing roller 40 and the external heating belt 80*e*, which are used during stand-by and during image formation, are shown. The controller 50 subjects, as described above, the halogen heaters 40*a* and 41*a* and the halogen heaters 80*c* and 80*d* to the ON-OFF control, and adjusts the surface temperature of the external heating belt 80*e*, and by extension to the surface temperature of the fixing roller 40, to the target temperatures shown in Table 4. As can be understood from Table 4, the target temperatures of the fixing roller 40 and the external heating belt 80*e* are determined depending on the basis weight of the recording material P. Further, a turning-on duty (turning-on ratio) of the external (heating) heater, i.e., the halogen heaters 80*c* and 80*d* is different for each of basis weights of the recording materials P. Incidentally, in the fixing device according to the Second Embodiment, the controller 50 effects control for energizing the halogen heaters 80*c* and 80*d* in accordance with the turning-on duty.

TABLE 8

| | Recording material basis weight (g/m$^2$) | | | | | |
|---|---|---|---|---|---|---|
| | 60-79 | 80-99 | 100-149 | 150-179 | 180-199 | 200-249 |
| FRST*1 TDSB*2 | 165 (° C.) | | | | | |
| FRST*1 TDIF*3 | 170 (° C.) | | | | | |
| EHBST*4 TDSB+2 | 190 (° C.) | | | | | |
| EHBST*4 TDIF*3 | 210 (° C.) | | | | | |
| EHTOD*5 (%) | 40 | 40 | 80 | 80 | 90 | 100 |

*1"FRST" is the fixing roller setting temperature.
*2"TDSB" is the temperature during stand-by.
*3"TDIF" is the temperature during image formation.
*4"EHBST" is the external heating belt setting temperature.
*5"EHTOD" is the external heater turning-on duty.

The above-described "turning-on duty" represents a proportion of a time, in which the halogen heaters 80*c* and 80*d* are energized in actuality, of a predetermined time in the case when energization to the halogen heaters 80*c* and 80*d* for a predetermined time (for five seconds, for example). In FIG. 8, a relationship of the turning-on duty with an energization time and a non-energization time of the halogen heaters 80*c* and 80*d* was shown. In FIG. 8, the ordinate represents the turning-on duty (%), and the abscissa represents the time (seconds). As shown in FIG. 8, for example, in the case when the turning-on duty is 60%, it is shown that of five seconds, for the first three seconds, the energization is made (ON), and for the remaining two seconds, the energization is not made (OFF, non-energization).

Figure 16A:
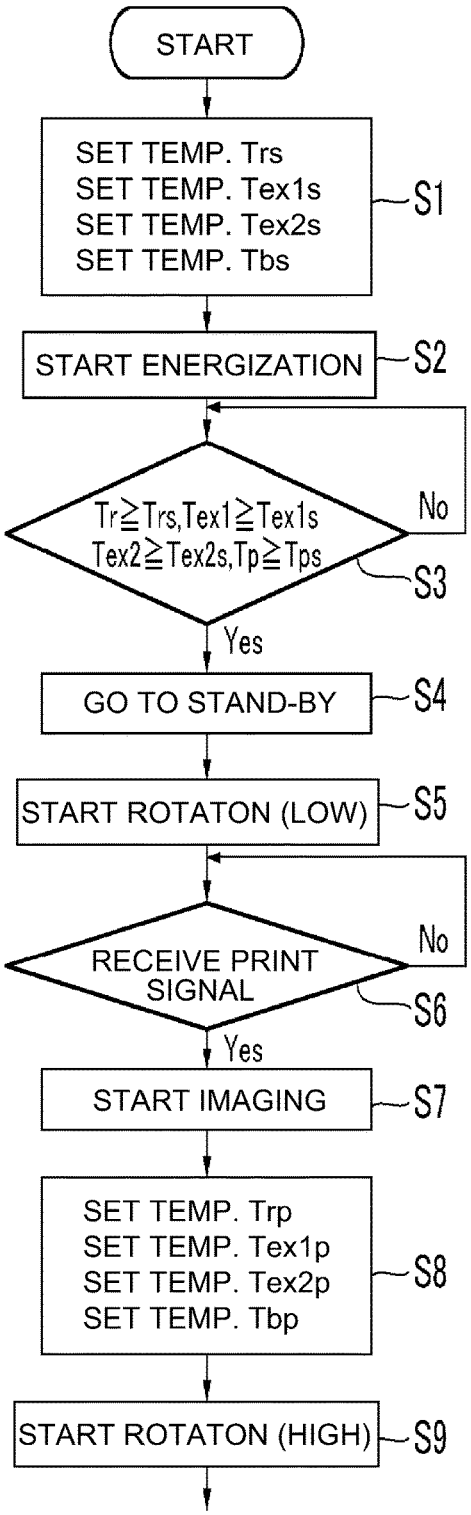
Figure 16B:
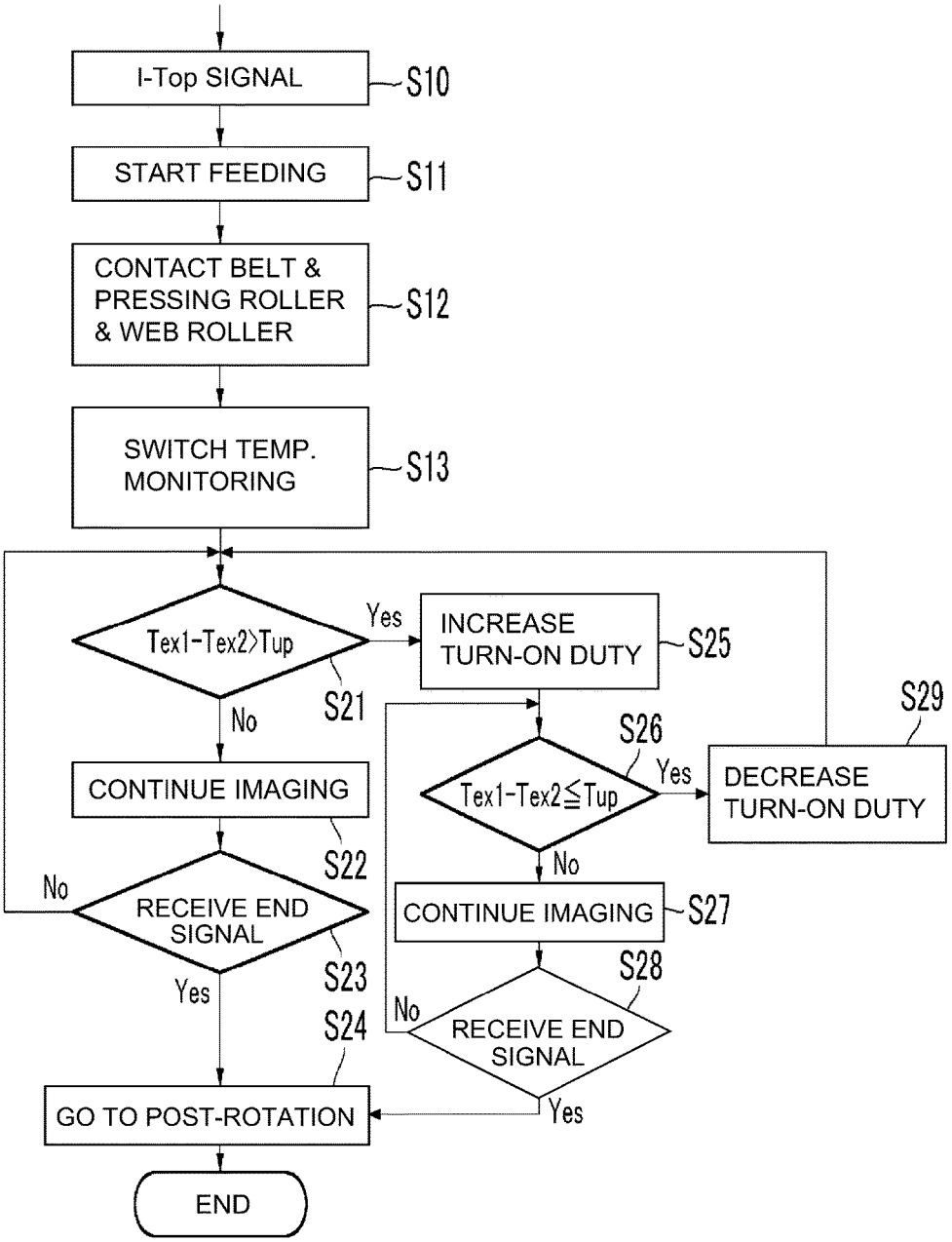

FIG. 16 is a flowchart showing the control of the fixing device in the Second Embodiment. However, a portion overlapping in description with the control shown in the above-described FIG. 14 will be omitted from explanation. Further, a description will be made by taking, as an example, the case when the thick paper with the basis weight of 240 g/m$^2$ was fed during image formation, although the plain paper with the basis weight of 81 g/m$^2$ is set as the recording material P.

As shown in FIG. 16 (16A, 16B), the controller 50 starts, after a process of S1 is executed, energization to the respective halogen heaters 40*a*, 41*a*, 80*c*, and 80*d* of the fixing device (S2). However, the turning-on duty of the halogen heaters 80*c* and 80*d* in this case is 100% irrespective of the basis weight set by the user. That is, the halogen heaters 80*c* and 80*d* are always energized. Thereafter, the controller 50 executes respective processes of S3 to S7.

The controller 50 changes the respective target temperatures to a target temperature Trp of the fixing roller temperature, a target temperature Tex1*p* of the external heating upstream temperature, a target temperature Tex2*p* of the external heating downstream temperature and a target temperature Tbp of the surface temperature of the pressing roller 41, which are to be used during image formation (S8). From the above-described Table 4, the target temperature Trp of the fixing roller temperature used during image formation is changed to 170° C., and the target temperature Tex1*p* of the external heating upstream temperature and the target temperature Tex2*p* of the external heating downstream temperature, which are used during image formation, are changed to 210° C. The target temperature Tbp of the surface temperature of the pressing roller 41 is 100° C. At this time, the turning-on duty is changed to 40% in accordance with the setting for the basis weight of 81 g/m$^2$, and the halogen heaters 80*c* and 80*d* are energized. That is, the halogen heaters are repetitively energized for two seconds with an interval of three seconds.

After execution of the respective processes S9 to S12, the controller 50 changes the temperature control of the external heating belt 80*e* so as to be carried out on the basis of only the temperature detected by the thermistor 81*b* for detecting the external heating downstream temperature (S13). That is, in the case when the contact state of the external heating belt 80*e* is detected, the controller 50 causes, on the basis of the temperature detected by the thermistor 81*b*, both of the halogen heaters 80*c* and 80*d* simultaneously so as to be subjected to the ON-OFF controllable. However, in this Second Embodiment, even when the halogen heaters 80*c* and 80*d* are simultaneously subjected to the ON control, these heaters 80*c* and 80*d* are to be repetitively subjected to the energization (ON) and the non-energization (OFF) with a predetermined time interval in accordance with the turning-on duty. By this, the overshooting of the surface temperature of external heating belt 80*e* after the image formation can be suppressed.

The controller 50 discriminates whether or not the temperature difference (Tex1−Tex2) between the detection temperature Tex1 of the thermistor 81*a* and the detection temperature Tex2 of the thermistor 81*b* is greater than a temperature difference Tup (4° C., for example) as a first predetermined value (S21). In the case when the temperature difference (Tex1−Tex2) is not more than the first predetermined value, i.e., not more than the predetermined temperature difference Tup (NO of S21), the controller 50 continues image formation without changing the turning-on duty of the halogen heaters 80*c* and 80*d* from 40% (S22). That is, in this case, the temperature of the detection temperature Tex2 of the thermistor 81*b* does not largely lower, so that the temperature difference with the detection temperature Tex1 of the thermistor 81*a* is small. For that reason, there is a small liability that the surface temperature of the fixing roller 40 becomes a low temperature that is below the fixable temperature, so that there is no need to carry out control of increasing the external heating downstream temperature in order to increase the surface temperature of the fixing roller 40, i.e., control of increasing the turning-on duty of the halogen heater 80*d*.

The controller 50 discriminates whether or not a print end signal is received (S23), and, in the case when the print end signal is not received (NO of S23), the process is returned to the process of the above-described S21. In the case when the print end signal is received (YES of S23), a post-rotation operation is performed (S24), and the process is ended. In the post-rotation operation in this embodiment, the controller 50 executes the above-described process S15 to S17 of FIG. 14. That is, the controller 50 changes the respective target temperatures to the target temperatures Trs, Tex1*s*, Tex2*s*, and Tbs during stand-by (S15). Then, the controller 50 causes the external heating unit 80, the pressing roller 41 and the web roller 63 to be spaced from the fixing roller 40 and be placed in the spaced state (S16). The controller 50 returns the temperature control of the external heating belt 80*e* only by the thermistor 81*a* to the temperature control before the change (S17).

On the other hand, in the case when the temperature difference (Tex1−Tex2) is greater than the predetermined temperature difference Tup (YES of S21), the controller 50 increases the turning-on duty of the halogen heater 80*d* of those of the halogen heaters 80*c* and 80*d* (S25). For example, the controller 50 increases the turning-on duty, which was 40%, up to 100%. That is, in this case, the temperature of the detection temperature Tex2 of the thermistor 81*b* largely lowers, so that the temperature difference with the detection temperature Tex1 of the thermistor 81*a* becomes large. For that reason, there is a liability that the surface temperature of the fixing roller 40 becomes a low temperature that is below the fixable temperature. Therefore, in order to increase the surface temperature of the fixing roller 40, control of increasing the external heating downstream temperature, i.e., control of increasing the turning-on duty of the halogen heater 80*d* is effected.

The controller 50 discriminates whether or not the temperature difference (Tex1−Tex2) is not more than the predetermined temperature difference Tup after the process of S25 (S26). In the case when the temperature difference (Tex1−Tex2) is greater than the predetermined temperature difference Tup (NO of S26), the controller 50 continues the image formation without returning the turning-on duty of the halogen heater 80*d* from 100%, after the change, to the original value (S27). That is, in a period in which the temperature difference (Tex1−Tex2) is greater than the predetermined temperature difference Tup, there is a liability that the surface temperature of the fixing roller 40 becomes a low temperature that is below the fixable temperature, and, therefore, there is a need to subsequently increase the external heating downstream temperature. For that reason, the halogen heater 80*d* is energized in accordance with the increased turning-on duty after the change.

The controller 50 discriminates whether or not a print end signal is received (S28), and, in the case when the print end signal is not received (NO of S28), the process is returned to the process of the above-described S26. In the case when the print end signal is received (YES of S28), a post-rotation operation is performed (S24), and the process is ended. In the post-rotation operation in this embodiment, the controller 50 executes the process S15 to S17 of FIG. 5 as described above.

In the above-described process of S26, in the case when the temperature difference (Tex1−Tex2) is not more than the predetermined temperature difference Tup (YES of S26), the controller 50 returns the turning-on duty of the halogen heater 80*d* to the turning-on duty before the change (S29). For example, the controller 50 decreases the turning-on duty, which was 100%, to 40%. That is, control of increasing the turning-on duty of the halogen heater 80*d* (see S25), and, therefore, the external heating downstream temperature increases, so that the surface temperature of the fixing roller 40 becomes a temperature exceeding the fixable temperature. However, when the surface temperature of the fixing roller 40 is further increased, the fixing roller 40, or the like, can be broken. Therefore, the turning-on duty of the halogen heater 80*d* is decreased and returned to the original value, whereby a further increase in surface temperature of the fixing roller 40 is suppressed. After the process of S29, the process is returned to the above-described process of S21, and the controller 50 repeats the processes of S21 to S29.

As described above, also in the Second Embodiment, during image formation, the halogen heater 80*c* in the upstream side with respect to the rotational direction of the fixing roller 40 is ON-OFF controlled, on the basis of the detection temperature of the thermistor 81*b* in the downstream side with respect to the rotational direction of the fixing roller 40, simultaneously with the halogen heater 80*d*. Then, on the basis of a difference in detection temperature between the two thermistors 81*a* and 81*b*, control of increasing the turning-on duty of the halogen heater 80*d* is carried out in the case when the heat quantity supplied from the external heating belt 80*e* to the fixing roller 40 is insufficient. By this, during image formation, the recording material P is changed from the plain paper to the thick paper, for example, and even when the quantity of the heat transferred from the fixing roller 40 to the recording material P is increased, it is possible to carry out sufficient heat supply from the external heating unit 80 to the fixing roller 40. For that reason, the image formation on the thick paper is not effected while making the surface temperature of the fixing roller 40 lower than a necessary target temperature. Accordingly, the image defect due to the generation of the cold offset is not readily generated.

Incidentally, in the Fifth Embodiment, in the case when the temperature difference (Tex1−Tex2) is greater than the predetermined temperature difference Tup, the turning-on duty of only the halogen heater 80*d* is changed (see S25), but the present invention is not limited thereto, and the turning-on duty of both of the halogen heaters 80*c* and 80*d* may also be changed. In that case, in the above-described process of S26, when the temperature difference (Tex1−Tex2) is not more than the predetermined temperature difference Tup, the turning-on duty of the both of the halogen heaters 80*c* and 80*d* is returned to the turning-on duty before the change (S29).

Sixth Embodiment

Incidentally, when the feeding interval of the recording material P is made longer than a predetermined time during image formation, the number of sheets of the recording materials P fed to the fixing nip N1 per unit time decreases, and, therefore, a lowering (degree) of the surface temperature of the fixing roller 40 becomes smaller than an assumed degree. Then, the heat supply from the external heating unit 80 to the fixing roller 40 becomes excessive, so that the surface temperature of the fixing roller 40 can be higher than the target temperature. The toner image fixed on the recording material P at a temperature higher than the target temperature is liable to cause a non-uniformity in gloss and density. Further, when the surface temperature of the fixing roller 40 is high, viscosity of the toner becomes less than a proper viscosity at which the toner image is fixed on the recording material P. In that case, a phenomenon that is called a hot offset, such that the toner image is not fixed on the recording material P and the toner is deposited on the fixing roller 40 generates, so that a problem similar to that in the case when the cold offset as described above generates can arise. In the following, this point will be described using FIGS. 10 and 11.

FIG. 10 shows a time progression of the surface temperature of the fixing roller 40 in the case when the feeding interval of the recording material P (basis weight: 81 g/m$^2$ as an example) is longer than a predetermined time during image formation. In this case, during image formation, the respective halogen heaters 40*a*, 41*a*, 80*c*, and 80*d* are controlled so that the surface temperature of the fixing roller 40 (fixing roller temperature) is the target temperature of 170° C. (see Table 4). However, when the feeding interval of the recording material P is longer than the predetermined time, the quantity per unit time of the heat transferred from the fixing roller 40 to the recording material P decreases. With this, the heat quantity supplied to the fixing roller 40 relatively becomes large, and therefore, as shown in FIG. 10, the surface temperature of the fixing roller 40 gradually increases and exceeds 180° C. (see Table 3) which is a proper allowable upper-limit temperature for the toner fixing. Then, the phenomenon called the hot offset generates and becomes a cause of generation of the image defect.

FIG. 11 is a graph showing a temperature difference (Tex1−Tex2) between a detection temperature Tex1 of the thermistor 81*a* and a detection temperature Tex2 of the thermistor 81*b* in the case when the feeding interval of the recording material P (basis weight: 81 g/m$^2$ as an example) is longer than the predetermined time during image formation.

As shown in FIG. 11, in the case when the recording material P is fed with a predetermined time interval, irrespective of the number of sheets of the temperatures P fed to the fixing nip N1 per unit time, the surface temperature of the fixing roller 40 lowers as estimated. For that reason, the temperature difference (Tex1−Tex2) is maintained at 2° C. As described above, this fixing device generates with supply of the heat from the external heating belt 80*e* to the fixing roller 40 lowering in temperature by heat transfer to the recording material P. For that reason, when the recording materials P are fed with the predetermined feeding interval, the heat transfer to the recording materials P and the heat supply from the external heating belt 80*e* are balanced with each other on the fixing roller 40, so that the temperature difference (Tex1−Tex2) is unchanged, and is stabilised.

However, when the feeding interval of the recording material P is longer than the predetermined time and the number of sheets of the recording materials P fed to the fixing nip N1 per unit time decreases, the temperature difference (Tex1−Tex2) gradually becomes small, as shown in FIG. 11. This is because the surface temperature of the fixing roller 40 is increased by the increase in feeding interval of the recording material P. That is, the surface temperature of the fixing roller 40 increases by the decrease in heat quantity transferred to the recording material P, and with this, the heat quantity supplied from the external heating belt 80*e* to the fixing roller 40 decreases. Then, the surface temperature of the external heating belt 80*e* is temperature-detected by the thermistor 81*b* while being high without lowering. In this case, even when the detection temperature Tex1 of the thermistor 81*a* is unchanged, the detection temperature Tex2 of the thermistor 81*b* relatively increases, so that the temperature difference (Tex1−Tex2) becomes small.

When, during image formation, the temperature difference (Tex1−Tex2) becomes small, i.e., the surface temperature of the fixing roller 40 increases, the hot offset generates, so that the image defect can generate. Therefore, in the case such that the feeding interval of the recording material P is longer than the predetermined time, there is a need to decrease the surface temperature of the fixing roller 40 down to a temperature that is below at least the allowable upper-limit temperature. However, as in the above-described First Embodiment, in the case when the surface temperature of the external heating belt 80*e* is controlled only by the thermistor 81*a* during image formation, it becomes difficult to decrease the surface temperature of the fixing roller 40 down to the temperature that is below the allowable upper-limit temperature.

Therefore, in the following, a fixing device according to this embodiment, in which the above-described problem is solved, will be described. However, a constitution and a control system of the fixing device 9 according to this embodiment are similar to those in the above-described Fourth Embodiment (see FIGS. 2 and 3), and, therefore, will be omitted from description.

Figure 17A:
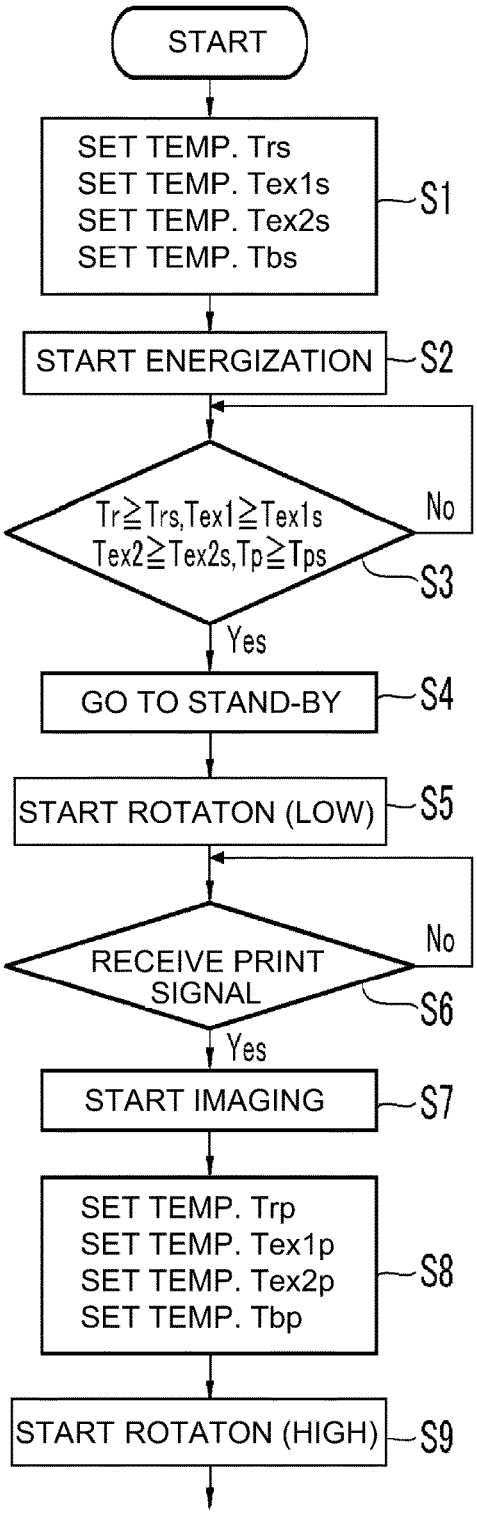
Figure 17B:
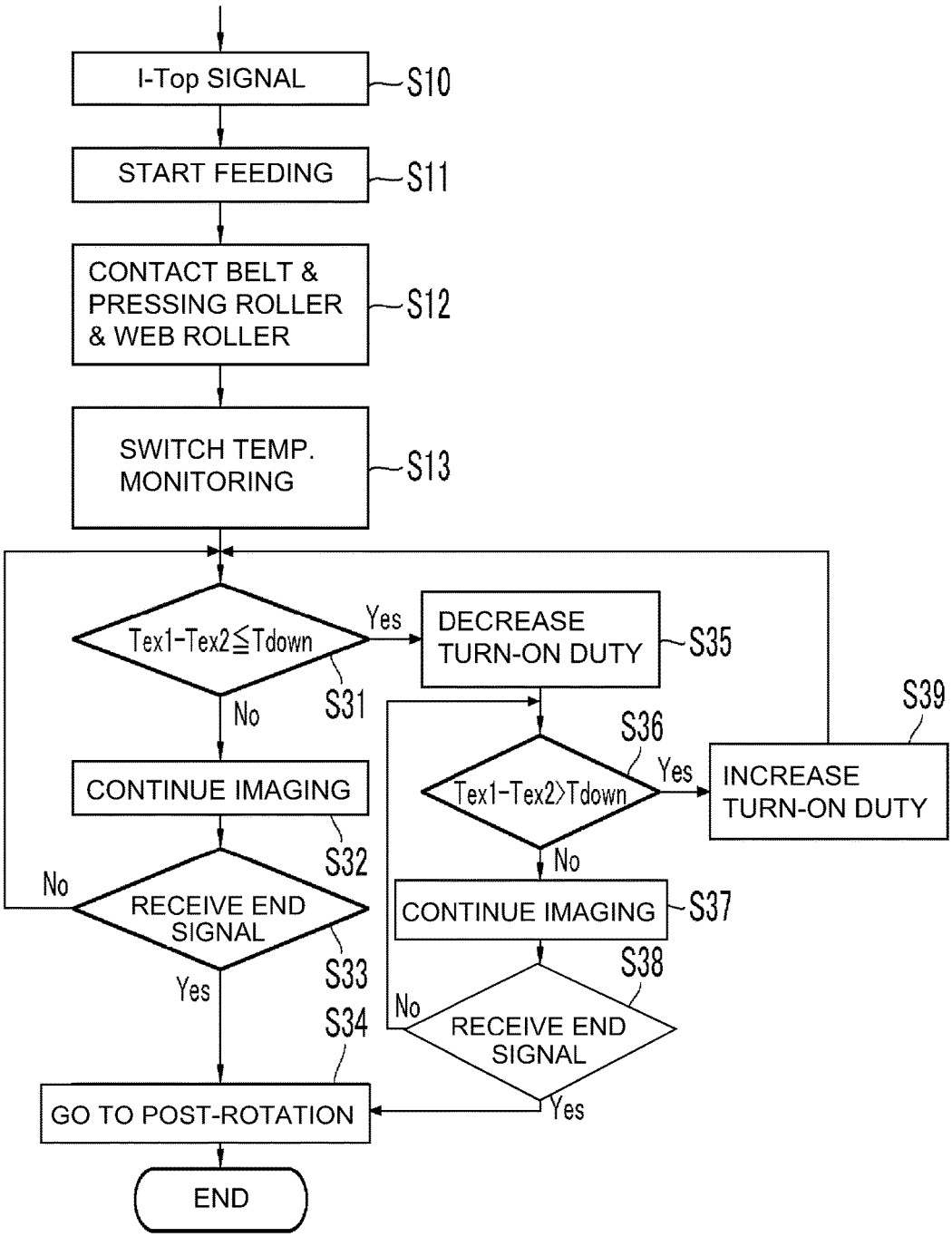

FIG. 17 is a flowchart showing the control of the fixing device in this embodiment. However, a portion overlapping in description with the control shown in the above-described FIG. 14 will be omitted from explanation. Further, a description will be made by taking, as an example, the case when the plain paper with the basis weight of 81 g/m$^2$ is used as the recording material P during image formation.

As shown in FIG. 17 (17A, 17B), the controller 50 starts, after a process of S1 is executed, energization to the respective halogen heaters 40*a*, 41*a*, 80*c*, and 80*d* of the fixing device (S2). However, the turning-on duty of the halogen heaters 80*c* and 80*d* in this case is 100%. Thereafter, the controller 50 executes respective processes of S3 to S7.

The controller 50 changes the respective target temperatures to a target temperature Trp of the fixing roller temperature, a target temperature Tex1*p* of the external heating upstream temperature, a target temperature Tex2*p* of the external heating downstream temperature, and a target temperature Tbp of the surface temperature of the pressing roller 41, which are to be used during image formation (S8). From the above-described Table 4, the target temperature Trp of the fixing roller temperature used during image formation is changed to 170° C., and the target temperature Tex1*p* of the external heating upstream temperature and the target temperature Tex2*p* of the external heating downstream temperature, which are used during image formation, are changed to 210° C. The target temperature Tbp of the surface temperature of the pressing roller 41 is 100° C. At this time, the turning-on duty is changed to 40% in accordance with the setting for the basis weight of 81 g/m$^2$, and the halogen heaters 80*c* and 80*d* are energized. That is, the halogen heaters are repetitively energized for two seconds with an interval of three seconds.

After execution of the respective processes S9 to S12, the controller 50 changes the temperature control of the external heating belt 80*e* so as to be carried out on the basis of only the temperature detected by the thermistor 81*b* for detecting the external heating downstream temperature (S13). That is, when the contact state of the external heating belt 80*e* is detected, the controller 50 causes, on the basis of the temperature detected by the thermistor 81*b*, both of the halogen heaters 80*c* and 80*d* simultaneously so as to be subjected to the ON-OFF controllable. However, in this Third Embodiment, even when the halogen heaters 80*c* and 80*d* are simultaneously subjected to the ON control, these heaters 80*c* and 80*d* are repetitively subjected to the energization (ON) and the non-energization (OFF) with a predetermined time interval in accordance with the turning-on duty. Thus, the overshooting of the surface temperature of external heating belt 80*e* after the image formation is suppressed.

The controller 50 discriminates whether or not the temperature difference (Tex1−Tex2) between the detection temperature Tex1 of the thermistor 81*a* and the detection temperature Tex2 of the thermistor 81*b* is not more than a temperature difference Tdown (0.3° C., for example) as a second predetermined value (S31). In the case when the temperature difference (Tex1−Tex2) is greater than the predetermined temperature difference Tdown (NO of S31), the controller 50 continues image formation without changing the turning-on duty of the halogen heaters 80*c* and 80*d* from 40% (S32). That is, in this case, the temperature of the detection temperature Tex2 of the thermistor 81*b* does not largely increase, so that the temperature difference with the detection temperature Tex1 of the thermistor 81*a* is not small. For that reason, there is a small liability that the surface temperature of the fixing roller 40 becomes a high temperature exceeding the allowable upper-limit temperature, so that there is no need to carry out control of decreasing the external heating downstream temperature in order to decrease the surface temperature of the fixing roller 40, i.e., control of decreasing the turning-on duty of the halogen heater 80*d*.

The controller 50 discriminates whether or not a print end signal is received (S33), and, in the case when the print end signal is not received (NO of S33), the process is returned to the process of the above-described S31. In the case when the print end signal is received (YES of S33), a post-rotation operation is performed (S34), and the process is ended. In the post-rotation operation in this embodiment, the controller 50 executes the process S15 to S17 of FIG. 5, as already been described above.

On the other hand, in the case when the temperature difference (Tex1−Tex2) is not more than the second predetermined value, i.e., not more than a predetermined temperature difference Tdown (YES of S31), the controller 50 decreases the turning-on duty of the halogen heater 80*d* of those of the halogen heaters 80*c* and 80*d* (S35). For example, the controller 50 decreases the turning-on duty, which was 40%, down to 0%. In the case when the turning-on duty is 0%, the halogen heater 80*d* is not turned on. That is, in this case, the temperature of the detection temperature Tex2 of the thermistor 81*b* largely increases, so that the temperature difference with the detection temperature Tex1 of the thermistor 81*a* becomes small. For that reason, there is a liability that the surface temperature of the fixing roller 40 becomes a high temperature, exceeding the allowable upper-limit temperature. Therefore, in order to decrease the surface temperature of the fixing roller 40, control of decreasing the external heating downstream temperature, i.e., control of decreasing the turning-on duty of the halogen heater 80*d* is effected.

The controller 50 discriminates whether or not the temperature difference (Tex1−Tex2) is greater than the predetermined temperature difference Tdown after the process of S35 (S36). In the case when the temperature difference (Tex1−Tex2) is not more than the predetermined temperature difference Tdown (NO of S36), the controller 50 continues the image formation without returning the turning-on duty of the halogen heater 80*d* from 0%, after the change, to the original value (S37). That is, in a period in which the temperature difference (Tex1−Tex2) is not more than the predetermined temperature difference Tdown, there is a liability that the surface temperature of the fixing roller 40 becomes a high temperature, exceeding the allowable upper-limit temperature, and, therefore, there is a need to subsequently decrease the external heating downstream temperature. For that reason, the halogen heater 80*d* is energized in accordance with the decreased turning-on duty after the change.

The controller 50 discriminates whether or not a print end signal is received (S38), and, in the case when the print end signal is not received (NO of S38), the process is returned to the process of the above-described S36. In the case when the print end signal is received (YES of S38), a post-rotation operation is performed (S34), and the process is ended. In the post-rotation operation in this embodiment, the controller 50 executes the process S15 to S17 of FIG. 5, as described above.

In the above-described process of S36, in the case when the temperature difference (Tex1−Tex2) is greater than the predetermined temperature difference Tdown (YES of S36), the controller 50 returns the turning-on duty of the halogen heater 80*d* to the turning-on duty before the change, i.e., the original value (S39). For example, the controller 50 increases the turning-on duty, which was 0%, to 40%. That is, control of decreasing the turning-on duty of the halogen heater 80*d* (see S35), and, therefore, the external heating downstream temperature decreases, so that the surface temperature of the fixing roller 40 becomes a temperature that is below the allowable upper-limit temperature. However, when the surface temperature of the fixing roller 40 is further decreased, there is a liability that the surface temperature becomes a low temperature that is below the fixable temperature. Therefore, the turning-on duty of the halogen heater 80*d* is increased and returned to the original value, whereby a further decrease in surface temperature of the fixing roller 40 is suppressed. After the process of S39, the process is returned to the above-described process of S31, and the controller 50 repeats the processes of S31 to S39.

As described above, also in Third Embodiment, during image formation, the halogen heater 80*c* in the upstream side with respect to the rotational direction of the fixing roller 40 is ON-OFF controlled, on the basis of the detection temperature of the thermistor 81*b* in the downstream side with respect to the rotational direction of the fixing roller 40, simultaneously with the halogen heater 80*d*. Then, on the basis of a difference in detection temperature between the two thermistors 81*a* and 81*b*, control of decreasing the turning-on duty of the halogen heater 80*d* is carried out in the case when the heat quantity supplied from the external heating belt 80*e* to the fixing roller 40 is excessive. By this, the feeding interval of the recording material P is longer than the predetermined time, and even when the number of sheets of the recording materials P fed to the fixing nip N1 per unit time is decreased, it is possible to carry out optimum heat supply from the external heating unit 80 to the fixing roller 40. For that reason, the image formation is not effected while making the surface temperature of the fixing roller 40 higher than a necessary target temperature. Accordingly, the image defect with the generation of the hot offset is not readily generated.

Incidentally, in Third Embodiment, in the case when the temperature difference (Tex1−Tex2) is not more than the predetermined temperature difference Tdown, the turning-on duty of only the halogen heater 80*d* is changed (see S35), but the present invention is not limited thereto, and the turning-on duty of both of the halogen heaters 80*c* and 80*d* may also be changed. In that case, in the above-described process of S36, when the temperature difference (Tex1–Tex2) is not more than the predetermined temperature difference Tup, the turning-on duty of the both of the halogen heaters 80*c* and 80*d* is returned to the turning-on duty before the change (S39).

Incidentally, in the above-described Fourth to Sixth Embodiments, as regards the halogen heaters 80*c* and 80*d*, those having the same normal rated power were used, but the halogen heaters are not limited thereto, and heaters different in normal rated power may also be used. In that case, as the halogen heater 80*c*, a heater a having normal rated power not more than that of the halogen heater 80*d* is used. This is because, when the normal rated power of the halogen heater 80*c* is greater than that of the halogen heater 80*d*, in the case when the surface temperature of the fixing roller 40 abruptly lowers, the external heating belt 80*e* can be excessively heated in the upstream side with respect to the rotational direction of the fixing roller 40. That is, in the case when the normal rated power of the halogen heater 80*c* is large, the halogen heater 80*c* is subjected to the ON-OFF control on the basis of the temperature detected by the thermistor 81*b*, an output of the halogen heater 80*c* is greater than that in the case of being based on the temperature detected by the thermistor 81*a*. Then, in the case when the surface temperature of the fixing roller 40 abruptly lowers, the lowering in surface temperature of the fixing roller 40 can be suppressed, but the external heating belt 80*e* is heated more than necessary, so that thermal deterioration, or the like, can be caused to generate. In order to avoid this, the halogen heater 80*c* having the normal rated power, which is not more than the normal rated power of the halogen heater 80*d*, is used. Further, each of the halogen heaters 40*a*, 41*a*, 80*c*, and 80*d* may be a single heater having a specific light distribution, but is not limited thereto, and may also include a plurality of heaters having different light distributions.

Incidentally, in the above-described Fourth to Sixth Embodiments, the fixing roller 40 provided with the halogen heater 40*a* therein was employed, but a constitution in which the fixing roller 40 is not provided with a heater and in which the fixing roller 40 is heated only by the external heating unit 80 may also be employed. Further, in the above-described embodiments, the pressing roller 41 provided with the halogen heater 41*a* therein was employed, but a constitution in which the pressing roller 41 is not provided with a heater may also be employed. Further, the pressing roller 41 provided with the elastic layer on the core metal was employed, but is not limited thereto, and may also be in other forms, such as a pressing belt, and a pressing roller and a pressing belt that have an elastic layer.

Incidentally, in the above-described Fourth to Sixth Embodiments, as the heating means, the halogen heater was employed. However, as the heating means, other heating means, other than the halogen heater, such as a heating means of an electromagnetic induction heating type and a planar heat generating member may also be used. Further, in the above-described Fourth to Sixth Embodiments, to each of the halogen heaters, electrical power equal to associated normal rated power is supplied. However, even in the case when electrical power less than the normal rated power is supplied, it is only required that values of maximum electrical power supplied to the halogen heaters 80*c* and 80*d* are made the same, and the turning-on duty is changed as desired.

INDUSTRIAL APPLICABILITY

According to the foregoing, the present invention provides an image heating apparatus capable of controlling an external heating belt to a proper temperature.

The invention claimed is:

1. An image heating apparatus comprising:

a first rotatable member and a second rotatable member for forming a nip for heating a toner image on a recording material;

an endless belt for heating said first rotatable member in contact with an outer surface of said first rotatable member;

a first roller and a second roller, which are provided inside of said endless belt in the order named along a rotational direction of said first rotatable member, for supporting said endless belt;

a first heater for heating said first roller;

a second heater for heating said second roller;

a first sensor for detecting a temperature of a region of said endless belt supported by said first roller;

a second sensor for detecting a temperature of a region of said endless belt supported by said second roller; and a controller for controlling energization to said first heater and to said second heater, wherein said controller is capable of executing a first mode in which the energization to said first heater is controlled using an output of said first sensor and the energization to said second heater is controlled using an output of said second sensor, and a second mode in which the energization to said first heater and said second heater is controlled using the output of said first sensor without using the output of said second sensor.

2. An image heating apparatus according to claim 1, further comprising a moving mechanism for moving said endless belt relative to said first rotatable member so that said endless belt is movable between a contact position where said endless belt contacts the outer surface of said first rotatable member and a spaced position where said endless belt is spaced from said first rotatable member, wherein said controller executes the first mode when said endless belt is in the spaced position and executes the second mode when said endless belt is in the contact position.

3. An image heating apparatus according to claim 2, wherein said endless belt is constituted so that said endless belt is rotated by said first rotatable member when said endless belt is in the contact position and so that said endless belt is stopped when said endless belt is in the spaced position.

4. An image heating apparatus comprising:

a first rotatable member and a second rotatable member for forming a nip for heating a toner image on a recording material;

an endless belt for heating said first rotatable member in contact with an outer surface of said first rotatable member;

a first roller and a second roller, which are provided inside of said endless belt in the order named along a rotational direction of said first rotatable member, for supporting said endless belt;

a first heater for heating said first roller;

a second heater for heating said second roller;

a first sensor for detecting a temperature of a region of said endless belt supported by said first roller;

a second sensor for detecting a temperature of a region of said endless belt supported by said second roller; and a controller for controlling energization to said first heater and to said second heater, wherein said controller is capable of executing a first mode in which the energization to said first heater is controlled using an output of said first sensor and the energization to said second heater is controlled using an output of said second sensor, and a second mode in which the energization to said first heater and said second heater is controlled using the output of said second sensor without using the output of said first sensor.

5. An image heating apparatus according to claim 4, further comprising a moving mechanism for moving said endless belt relative to said first rotatable member so that said endless belt is movable between a contact position where said endless belt contacts the outer surface of said first rotatable member and a spaced position where said endless belt is spaced from said first rotatable member, wherein said controller executes the first mode when said endless belt is in the spaced position and executes the second mode when said endless belt is in the contact position.

6. An image heating apparatus according to claim 5, wherein said endless belt is constituted so that said endless belt is rotated by said first rotatable member when said endless belt is in the contact position and so that said endless belt is stopped when said endless belt is in the spaced position.

* * * * *